United States Patent [19]

Saitoh et al.

[11] Patent Number: 4,579,798

[45] Date of Patent: Apr. 1, 1986

[54] AMORPHOUS SILICON AND GERMANIUM PHOTOCONDUCTIVE MEMBER CONTAINING CARBON

[75] Inventors: Keishi Saitoh, Ibaraki; Yukihiko Ohnuki, Kawasaki; Shigeru Ohno, Yokohama, all of Japan

[73] Assignee: Canon Kabushiki Kaisha, Tokyo, Japan

[21] Appl. No.: 647,745

[22] Filed: Sep. 6, 1984

[30] Foreign Application Priority Data

| | | | |
|---|---|---|---|
| Sep. 8, 1983 | [JP] | Japan | 58-165653 |
| Sep. 9, 1983 | [JP] | Japan | 58-166149 |
| Oct. 11, 1983 | [JP] | Japan | 58-189593 |
| Oct. 11, 1983 | [JP] | Japan | 58-189597 |
| Oct. 27, 1983 | [JP] | Japan | 58-201227 |
| Oct. 31, 1983 | [JP] | Japan | 58-204223 |

[51] Int. Cl.[4] ..... G03G 5/082

[52] U.S. Cl. ..... 430/57; 430/84; 430/95

[58] Field of Search ..... 430/69, 84, 86, 95, 430/57

[56] References Cited

U.S. PATENT DOCUMENTS

| | | | |
|---|---|---|---|
| 4,451,546 | 5/1984 | Kawamura et al. | 430/60 |
| 4,471,042 | 9/1984 | Komatsu et al. | 430/67 |
| 4,490,450 | 12/1984 | Shimizu et al. | 430/95 |

*Primary Examiner*—John L. Goodrow

*Attorney, Agent, or Firm*—Fitzpatrick, Cella, Harper & Scinto

[57] ABSTRACT

A photoconductive member comprises a support for a photoconductive member and a light receiving layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, the distribution of germanium atoms in the first layer region (G) being ununiform in the direction of layer thickness, and carbon atoms being contained in the light receiving layer.

A photoconductive member comprises a support for a photoconductive member and a light receiving layer comprising a first layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, and a second layer comprising an amorphous material containing silicon atoms as the matrix and at least one of nitrogen atoms and oxygen atoms, the distribution of germanium atoms in the first layer region (G) being ununiform in the direction of layer thickness, and carbon atoms being contained in the first layer.

62 Claims, 60 Drawing Figures

AMORPHOUS SILICON AND GERMANIUM PHOTOCONDUCTIVE MEMBER CONTAINING CARBON

BACKGROUND OF THE INVENTION

Field of the Invention

This invention relates to a photoconductive member having sensitivity to electromagnetic waves such as light (herein used in a broad sense, including ultraviolet rays, visible light, infrared rays, X-rays, gamma-rays, and the like).

Description of the Prior Art

Photoconductive materials, which constitute photoconductive layers in solid state image pickup devices, image forming members for electrophotography in the field of image formation, or manuscript reading devices and the like, are required to have a high sensitivity, a high SN ratio (photocurrent ($I_p$)/dark current ($I_d$)), spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid safety characteristic is very important.

From the standpoint as mentioned above, amorphous silicon (hereinafter referred to as a-Si) has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectric transducing reading device.

However, under the present situation, the photoconductive members of the prior art having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with the lapse of time.

For instance, when the above photoconductive member is applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigue by repeated uses or so called ghost phenomenon wherein residual images are formed.

Further, a-Si has a relatively smaller coefficient of absorption of the light on the longer wavelength side in the visible light region as compared with that on the shorter wavelength side. Accordingly, in matching to the semiconductor laser commercially applied at the present time, the light on the longer wavelength side cannot effectively be utilized, when employing a halogen lamp or a fluorescent lamp as the light source. Thus, various points remain to be improved.

On the other hand, when the light irradiated is not sufficiently absorbed in the photoconductive layer, but the amount of the light reaching the substrate is increased, interference due to multiple reflection may occur in the photoconductive layer to become a cause for "unfocused" image, in the case when the substrate itself has a high reflectance for the light transmitted through the photoconductive layer.

This effect will be increased, if the irradiated spot is made smaller for the purpose of enhancing resolution, thus posing a great problem in the case of using a semiconductor laser as the light source.

Further, a-Si materials to be used for constituting the photoconductive layer may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

That is, for example, in many cases, the life of the photocarriers generated by light irradiation in the photoconductive layer formed is insufficient, or at the dark portion, the charges injected from the substrate side cannot sufficiently impeded.

In addition, when the layer thickness becomes about ten microns or more, float and peeling of the layer from the support surface or cracking of the layer are liable to be caused after the material is taken out of a vacuum deposition chamber for layer formation and when stored in air. These phenomena often occur particularly when the support is in a form of drum which is usually used in the field of electrophotography and the problem of the phenomena should be solved so as to improve its stability as to the lapse of time.

Therefore, it is necessary to improve the characteristics of the a-Si material itself while it is necessary to solve all the problems as mentioned above upon designing the photoconductive members.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc.

It has now been found that a photoconductive member having a light receiving layer exhibiting photoconductivity which comprises an amorphous material containing at least one of hydrogen atom (H) and halogen atom (X) in a matrix of silicon atom, so-called hydrogenated amorphous silicon, halogenated amorphous silicon, or halogen-containing hydrogenated amorphous silicon (hereinafter comprehensively referred to as "a-Si(H,X)"), said photoconductive member being prepared by designing so as to have a specific structure as hereinafter described, not only exhibits practically extremely excellent characteristics, but also surpasses photoconductive members of the prior art in substantially all respects, especially having markedly excellent characteristics as a photoconductive member for electrophotography and also excellent absorption spectrum characteristics on the longer wavelength side.

SUMMARY OF THE INVENTION

A primary object of the present invention is to provide a photoconductive member having electrical, optical and photoconductive characteristics which are constantly stable and all-environment type with virtually no dependence on the environments under use, which member is excellent in photosensitive characteristics on the longer wavelength side and markedly excellent in light fatigue resistance, and also excellent in durability without causing deterioration phenomenon when used repeatedly, exhibiting no or substantially no residual potential observed.

Another object of the present invention is to provide a photoconductive member which is high in photosensitivity throughout the whole visible light region, particularly excellent in matching to a semiconductor laser and also rapid in response to light.

Still another object of the present invention is to provide a photoconductive member which exhibits excellent close adhesion between a support and a layer overlying the support and that between the laminated layers, is elaborate and stable with respect to structural arrangement and has a high layer quality.

A still further object of the present invention is to provide an excellent photoconductive member which has a sufficient charge retentivity upon charging treatment for formation of electrostatic images to such an extent that a conventional electrophotographic method can be very effectively applied when it is used as an image forming member for electrophotography and further has an excellent electrophotographic characteristics which is little lowered even under high humidity.

Still another object of the present invention is to provide a photoconductive member for electrophotography capable of easily producing images of high quality having high density, clear halftone and high resolution.

A still further object of the present invention is to provide a photoconductive member having high photosensitivity, high SN ratio characteristics, and good electrical contact with the support.

According to one aspect of the present invention, there is provided a photoconductive member which comprises a support for a photoconductive member and a light receiving layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, the distribution of germanium atoms in the first layer region (G) being ununiform in the direction of layer thickness, and carbon atoms being contained in the light receiving layer.

According to another aspect of the present invention, there is provided a photoconductive member which comprises a support for a photoconductive member and a light receiving layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, the distribution of germanium atoms in the first layer region (G) being ununiform in the direction of layer thickness, a substance controlling conductivity being contained in the first layer region (G), and carbon atoms being contained in the light receiving layer.

According to a further aspect of the present invention, there is provided a photoconductive member which comprises a support for a photoconductive member and a light receiving layer comprising a first layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, and a second layer comprising an amorphous material containing silicon atoms as the matrix and at least one of nitrogen atoms and oxygen atoms, the distribution of germanium atoms in the first layer region (G) being ununiform in the direction of layer thickness, and carbon atoms being contained in the first layer.

According to still another aspect of the present invention, there is provided a photoconductive member which comprises a support for a photoconductive member and a light receiving layer comprising a first layer constituted of a first layer region (G) comprising an amorphous material containing silicon atoms and germanium atoms and a second layer region (S) comprising an amorphous material containing silicon atoms and exhibiting photoconductivity, the first layer region (G) and the second layer region (S) being provided in the mentioned order on the support, and a second layer comprising an amorphous material containing silicon atoms as the matrix and at least one of nitrogen atoms and oxygen atoms, the distribution of germanium atoms in the first layer region (G) being ununiform in the direction of layer thickness, a substance controlling conductivity being contained in the first layer region (G), and carbon atoms being contained in the first layer.

The photoconductive member of the present invention as designed to have the above mentioned layer structure can solve the above mentioned various problems, and exhibits very excellent electric, optical, photoconductive characteristics, dielectric strength and use environmental characteristics.

In particular, when the photoconductive layer is used as an image forming member for electrophotography, the image forming member is not adversely affected by residual potential upon image formation, the electric characteristics are stable, the sensitivity is high and the SN ratio is high. In addition, the image forming member is excellent in light fatigue resistance and durability when used repeatedly, and can produce repeatedly and stably images of high quality, high density, clear halftone and high resolution.

The photoconductive member of the present invention has a light receiving layer (formed on a support) which itself is strong and is excellent in close adhesion with a support. The photoconductive member can be continuously and repeated used at a high speed for a long time.

In addition, the photoconductive member of the present invention is high in photosensitivity throughout the visible light region, particularly excellent in matching to a semiconductor laser and also rapid in response to light.

DESCRIPTION OF THE PREFERRED EMBODIMENTS

Figure 1:
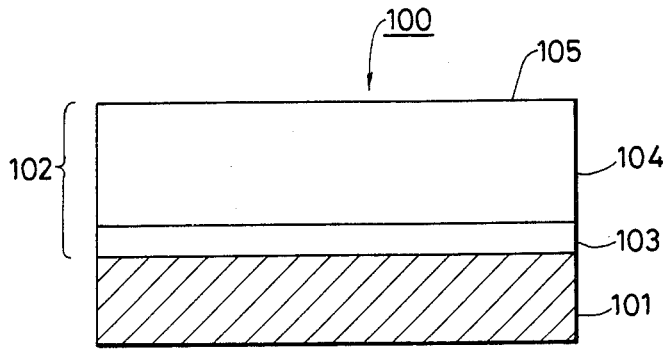
FIG. 1 and FIG. 2 schematically show layer structures of photoconductive members of the present invention.

In the following, the photoconductive member of the present invention will be explained referring to the drawing in detail below.

FIG. 1 schematically shows a layer structure of a photoconductive member of the first embodiment according to the present invention.

In FIG. 1, photoconductive member 100 has support 101 for the photoconductive member and light receiving layer 102 overlying support 101. Light receiving layer 102 has free surface 105 at one of the end surfaces. Light receiving layer 102 is constituted of a first layer region (G) 103 composed of a-Si(H,X) containing germanium atoms (hereinafter referred to as "a-SiGe(H,X)") and a second layer region (S) 104 having photoconductivity composed of a-Si(H,X). The first layer region (G) 103 and the second layer region (S) 104 are laminated on support 101 in the order as mentioned. Germanium atoms are contained in the first layer region (G) 103 such that the content is continuous in the layer thickness direction and is higher at the side of support 101 than at the side opposite to the support 101 (the side of the surface of light receiving layer 102).

In addition, the photoconductive member of the present invention is high in photosensitivity throughout the visible light region, particularly excellent in matching to a semiconductor laser and also rapid in response to light.

In the following, the photoconductive member of the present invention will be explained referring to the drawing in detail below.

Figure 2:
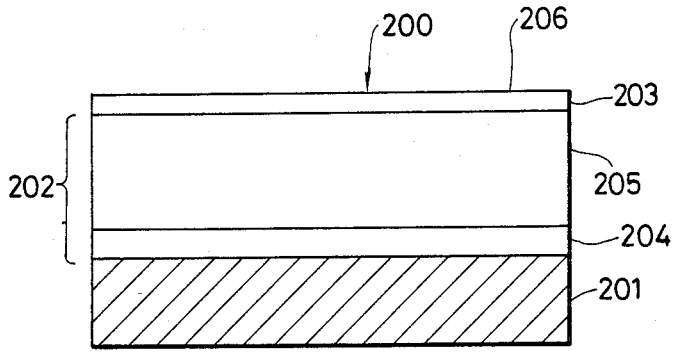

FIG. 2 schematically shows a layer structure of a photoconductive member of the second embodiment according to the present invention. In FIG. 2, photoconductive member 200 has support 201 for the photoconductive member and the light receiving layer composed of a first layer (I) 202 and a second layer (II) 203 overlying support 201. The second layer (II) 203 has free surface 206 at one of the end surfaces. The first layer (I) 02 is constituted of a first layer region (G) 204 composed of a-Si(H,X) containing germanium atoms (hereinafter referred to as "a-SiGe(H,X)") and a second layer region (S) 205 having photoconductivity composed of a-Si(H,X). The first layer region (G) 204 and the second layer region (S) 205 are laminated on support 201 in the order as mentioned. Germanium atoms are contained in the first layer region (G) 204 such that the content is continuous in the layer thickness direction and is higher at the side of support 201 than at the side opposite to the support 201 (the side of the second layer (II) of the first layer (I) 202).

The second layer 203 is constituted of an amorphous material comprising silicon atoms as matrix and at least one of oxygen atoms and nitrogen atoms, and it is preferable that at least one of hydrogen atoms and halogen atoms is contained in the second layer.

In the photoconductive member of the present invention, it is preferable that the distribution of germanium in the first layer region (G) is such as mentioned above in the layer thickness direction while the distribution in the plane parallel to the surface of the support surface is uniform.

In the present invention, germanium atoms are not contained in the second layer region (S) provided on the first layer region (G), and such a layer structure of the light receiving layer or the first layer can give a photoconductive member excellent in photosensitivity to lights of all region ranging from a relatively short wavelength containing visible light region to a relatively long wavelength.

In the first layer region (G), germanium atoms are distributed such that germanium atoms are continuously distributed over the whole layer region and the distribution concentration of germanium atoms in the layer thickness direction, C, decreases from the support side to the second layer region (S). Therefore, the affinity between the first layer region (G) and the second layer region (S) is good and further, the change in refractive index can be substantially continuous. As the result, it is possible to prevent interference due to reflection at the layer interface when a coherent light is used. Further, by making the distribution concentration, C, of germanium atoms extremely high at the support side end portion as mentioned later, it is possible that a light at the long wavelength side which is hardly absorbed at the second layer region (S) when a semiconductor laser and the like are used is substantially completely absorbed at the first layer region (G) and the interference due to reflection from the support surface is prevented.

According to the present invention, the photoconductive member comprises silicon atoms common to both amorphous materials constituting the first layer region (G) and the second layer region (S) and therefore, chemical stability at the laminate interface can be sufficiently assured.

FIGS. 3 through 11 show typical examples of ununiform distribution in the direction of layer thickness of germanium atoms contained in the first layer region (G) of the photoconductive member in the present invention.

In FIGS. 3 through 11, the abscissa indicates the content C of germanium atoms and the ordinate the layer thickness of the first layer region (G), $t_B$ showing the position of the end surface of the first layer region (G) on the support side and $t_T$ the position of the end surface of the first layer region (G) on the side opposite to the support side. That is, layer formation of the first layer region (G) containing germanium atoms proceeds from the $t_B$ side toward the $t_T$ side.

Figure 3:
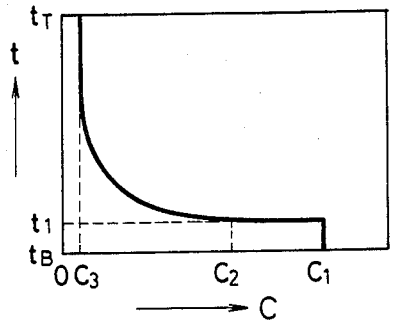
FIG. 3–FIG. 11 show the distribution of germanium atoms in each layer region (G)

In FIG. 3, there is shown a first typical embodiment of the depth profile of germanium atoms in the layer thickness direction contained in the first layer region (G).

In the embodiment as shown in FIG. 3, from the interface position $t_B$ at which the surface, on which the first layer region (G) containing germanium atoms is to be formed, is contacted with the surface of said first layer region (G) to the position $t_1$, germanium atoms are contained in the first layer region (G) formed, while the concentration C of germanium atoms taking a constant value of $C_1$, the concentration being gradually decreased from the concentration $C_2$ continuously from the position $t_1$ to the interface position $t_T$. At the interface position $t_T$, the concentration C of germanium atoms is made $C_3$.

Figure 4:
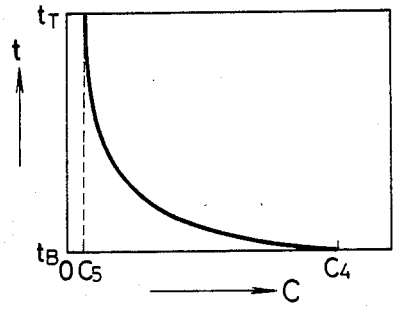

In the embodiment shown in FIG. 4, the concentration C of germanium atoms contained is decreased gradually and continuously from the position $t_B$ to the position $t_T$ from the concentration $C_4$ until it becomes the concentration $C_5$ at the position $t_T$.

Figure 5:
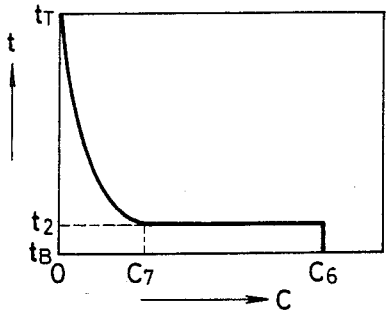

In case of FIG. 5, the concentration of germanium atoms is made constant as $C_6$ from the position $t_B$ to the position $t_2$ gradually decreased continuously from the position $t_2$ to the position $t_T$, and the concentration C is made substantially zero at the position $t_T$ (substantially zero herein means the content less than the detectable limit).

Figure 6:
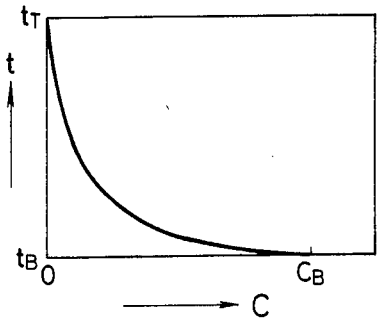

In case of FIG. 6, the concentration C of germanium atoms is decreased gradually and continuously from the position $t_B$ to the position $t_T$ from the concentration $C_8$, until it is made substantially zero at the position $t_T$.

Figure 7:
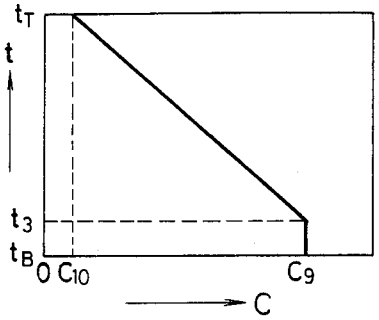

In the embodiment shown in FIG. 7, the concentration C of germanium atoms is constantly $C_9$ between the position $t_B$ and the position $t_3$, and it is made $C_{10}$ at the position $t_T$. Between the position $t_3$ and the position $t_T$, the concentration is reduced as a first order function from the position $t_3$ to the position $t_T$.

Figure 8:
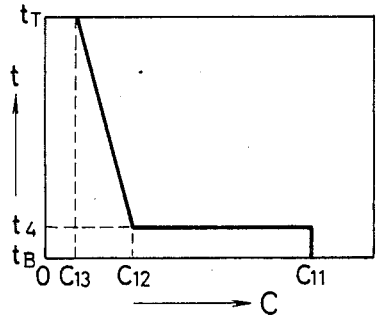

In the embodiment shown in FIG. 8, there is formed a depth profile such that the concentration C takes a constant value of $C_{11}$ from the position $t_B$ to the position $t_4$, and is decreased as a first order function from the concentration $C_{12}$ to the concentration $C_{13}$ from the position $t_4$ to the position $t_T$.

Figure 9:
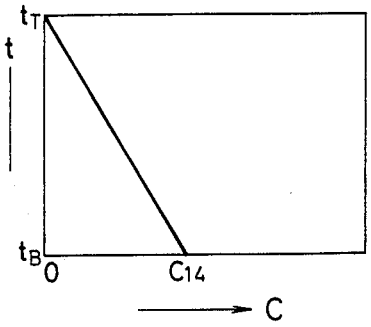

In the embodiment shown in FIG. 9, the concentration C of germanium atoms is decreased as a first order function from the concentration $C_{14}$ to substantially zero from the position $t_B$ to the position $t_T$.

Figure 10:
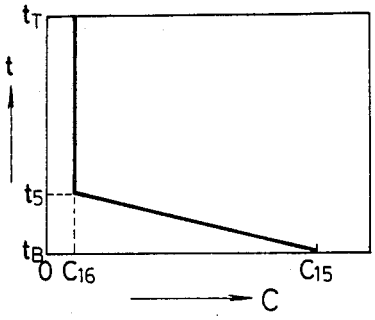

In FIG. 10, there is shown an embodiment, where the concentration C of germanium atoms is decreased as a first order function from the concentration $C_{15}$ to $C_{16}$ from the position $t_B$ to $t_5$ and made constantly at the concentration $C_{16}$ between the position $t_5$ and $t_T$.

Figure 11:
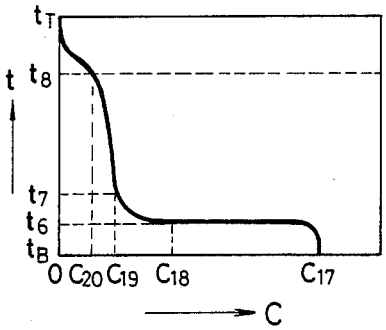

In the embodiment shown in FIG. 11, the concentration of germanium atoms is at the concentration $C_{17}$ at the position $t_B$, which concentration $C_{17}$ is initially decreased gradually and abruptly near the position $t_6$ to the position $t_6$, until it is made the concentration $C_{18}$ at the position $t_6$.

Between the position $t_6$ and the position $t_7$, the concentration C is initially decreased abruptly and thereafter gradually, until it is made the concentration $C_{19}$ at the position $t_7$. Between the position $t_7$ and the position $t_8$, the concentration is decreased very gradually to the concentration $C_{20}$ at the position $t_8$. Between the position $t_8$ and the position $t_T$, the concentration is decreased along the curve having a shape as shown in the Figure from the concentration $C_{20}$ to substantially zero.

As described above about some typical examples of depth profiles of germanium atoms contained in the first layer region (G) in the direction of the layer thickness by referring to FIGS. 3 through 11, in the present invention, the first layer region (G) is provided desirably in a depth profile so as to have a portion enriched in concentration C of germanium atoms on the support side and a portion depleted in concentration C of germanium atoms to considerably lower than that of the support side on the interface $t_T$ side.

The first layer region (G) constituting the light receiving layer or the first layer of the photoconductive member in the present invention is desired to have a localized region (A) containing germanium atoms preferably at a relatively higher concentration on the support side as described above.

In the present invention, the localized region (A), as explained in terms of the symbols shown in FIG. 3 through FIG. 11, may be desirably provided within 5 microns from the interface position $t_B$.

In the present invention, the above localized region (A) may be made to be identical with the whole layer region ($L_T$) up to the depth of 5 microns from the interface position $t_B$, or alternatively a part of the layer region ($L_T$).

It may suitably be determined depending on the characteristics required for the light receiving layer to be formed, whether the localized region (A) is made a part or whole of the layer region ($L_T$).

The localized region (A) may preferably be formed according to such a layer formation that the maximum value Cmax of the concentration of germanium atoms in a distribution in the layer thickness direction may preferably be 1000 atomic ppm or more, more preferably 5000 atomic ppm or more, most preferably $1\times10^4$ atomic ppm or more based on the sum of germanium atoms and silicon atoms.

That is, according to the present invention, the first layer region (G) containing germanium atoms is preferably formed so that the maximum value Cmax of the distribution concentration may exist within a layer thickness of 5 microns from the support side (the layer region within 5 microns thickness from $t_B$).

In the present invention, the content of germanium atoms in the first layer region (G) containing germanium atoms, which may suitably be determined as desired so as to achieve effectively the objects of the present invention, may preferably be 1 to $9.5\times10^5$ atomic ppm, more preferably 100 to $8.0\times10^5$ atomic ppm, most preferably 500 to $7\times10^5$ atomic ppm based on the sum of germanium atoms and silicon atoms.

In the photoconductive member of the present invention, the layer thickness of the first layer region (G) and the thickness of the second layer region (S) are one of important factors for accomplishing effectively the object of the present invention and therefore, sufficient care should be paid in designing of the photoconductive member so that desirable characteristics may be imparted to the photoconductive member formed.

In the present invention, the layer thickness $T_B$ of the first layer region (G) may preferably be 30 Å to 50μ, more preferably 40 Å to 40μ, most preferably 50 Å to 30μ.

On the other hand, the layer thickness T of the second layer region (S) may be preferably 0.5 to 90μ, more preferably 1 to 80μ, most preferably 2 to 50μ.

The sum of the layer thickness $T_B$ of the first layer region (G) and the layer thickness T of the second layer region (S), namely ($T_B$+T) may be suitably determined as desired in designing of the layers of the photoconductive member, based on the mutual organic relationship between the characteristics required for both layer regions and the characteristics required for the whole light receiving layer.

In the photoconductive member of the present invention, it is preferred that the numerical range for the above ($T_B$T) may preferably be from 1 to 100μ, more preferably 1 to 80μ, most preferably 2 to 50μ.

In a more preferred embodiment of the present invention, it is preferred to select the numerical values for respective thicknesses $T_B$ and T as mentioned above so that the relation of $TB/T \leqq 1$ may be satisfied.

In selection of the numerical values for the thicknesses $T_B$ and T in the above case, the values of $T_B$ and T should preferably be determined so that the relation $T_B/T \leqq 0.9$, most preferably, $T_B/T \leqq 0.8$, may be satisfied.

In the present invention, when the content of germanium atoms in the first layer region (G) is $1 \times 10^5$ atomic ppm or more, based on the sum of silicon atoms and germanium atoms the layer thickness $T_B$ of the first layer region (G) should desirably be made as thin as possible, preferably 30μ or less, more preferably 25μ or less, most preferably 20μ or less.

In the photoconductive member of the present invention, the distribution of germanium atoms in the first layer region (G) is such that germanium atoms are continuously distributed over the whole layer region (G) and the distribution concentration of germanium atoms in the layer thickness direction, C, decreases from the support side to the free surface side of the light receiving layer, and therefore, a light receiving layer having required characteristics can be produced as desired by designing the change rate curve of the distribution concentration C.

For example, by selecting a distribution concentration curve of germanium atoms such taht the distribution concentration C of germanium in the first layer region (G) is sufficiently high at the support side and is lowered as far as possible at the free surface side of the light receiving layer, the photoconductive member can be sensitive to all regions of wavelength ranging from a relatively short wavelength to a relatively long wavelength including visible light region.

As mentioned below, by rendering the distribution concentration C of germanium atoms extremely high at the support side and portion of the first layer region (G), it is possible that, when a semiconductor laser is used, a light at the long wavelength side which can not be sufficiently absorbed at the second layer region (S) at the laser irradiated surface side can be substantially completely absorbed at the layer region (G) and the interference due to reflection from the support surface can be effectively prevented.

In the case of the photoconductive member of the present invention, carbon atoms are incorporated in the light receiving layer or the first layer for the purpose of enhancing the photosensitivity and dark resistance and further, improving the close contact property between the support and the light receiving layer.

Carbon atoms contained in the light receiving layer or the first layer may be distributed all over the whole layer region, or contained locally only at a part of the layer region.

In addition, the distribution of carbon atoms may be such that the distribution concentration C(C) is uniform in the direction of the light receiving layer thickness or the first layer or ununiform in the layer thickness direction in a way similar to the distribution state of germanium as mentioned in FIG. 3–FIG. 11.

In short, when the distribution concentration of carbon atoms C(C) is ununiform in the layer thickness direction, the distribution of carbon atoms can be explained in a way similar to that of germanium atoms in FIG. 3–FIG. 11.

In the present invention, when improvement in photoconductivity and dark resistance is the main purpose, the layer region (C) containing carbon atoms provided in the light receiving layer or the first layer is provided such that the layer region (C) occupies the whole layer region of the light receiving layer. When strengthening the close contact property between the support and the light receiving layer is the main purpose, the layer region (C) is provided at the support side end portion layer region (E) of the light receiving layer or the first layer.

In the former case, it is preferable that the content of carbon atoms in layer region (C) is relatively low so as to keep a high photosensitivity while in the latter case the content of nitrogen is preferably relatively high so as to assure to strengthen the close contact property with the support.

In order to attain both the former and the latter purposes, the carbon atom distribution in layer region (C) is as follows: carbon atoms may be contained at the support side in a relatively high concentration and at the free surface side of the light receiving layer or the first layer in a relatively low concentration, or carbon atoms may not be positively contained in the layer region at the free surface side of the light receiving layer or the first layer.

In the present invention, the carbon atom content in the layer region (C) provided in the light receiving layer or the first layer may be optionally selected in an organic relationship of characteristics required for the layer region (C) itself, characteristics at the interface contacting the support (when the layer region (C) is directly mounted on the support) and the like.

When other layer region is directly provided in contact with on the layer region (C), the carbon atom content is optionally selected taking into consideration the characteristics of said other layer region and characteristics at the interface contacting said other layer region.

The amount of carbon atoms in layer region (C) is optionally selected depending upon the characteristics required to photoconductive members to be formed. It is preferably 0.001–50 atomic %, more preferably 0.002–40 atomic %, most preferably 0.003–30 atomic %.

In the present invention, when the layer region (C) occupies the whole region of the light receiving layer or the first layer, or though the layer region (C) does not occupy the whole region of the light receiving layer or the first layer, the ratio of layer thickness ($T_0$) of the layer region (C) to layer thickness (T) of the light receiving layer or the first layer is sufficiently large, it is desired that the upper limit of nitrogen atom content in layer region (C) is sufficiently less than the abovementioned value.

According to the present invention, when the layer thickness $T_0$ of layer region (C) is 2/5 times or more the layer thickness T, the upper limit of carbon atoms in layer region (C) is preferably 30 atomic % or less, more preferably 20 atomic % or less, most preferably 10 atomic % or less.

In the present invention, it is preferable that layer region (C) containing carbon atoms constituting the light receiving layer or the first layer is formed, as mentioned above, in such a way that there is a localized region (B) which is at the support side and contains carbon atoms at a relatively high concentration, and in this case, the close contact property between the support and the light receiving layer can be more improved.

The above-mentioned localized region (B) is preferably present within 5 microns from the position of interface $t_B$ when explained using the sign in FIG. 3–FIG. 11.

The above-mentioned localized region (B) may be the whole layer region ($L_T$) from the interface position $t_B$ to 5 microns thick or may be a part of the layer region ($L_T$).

It optionally depends on the characteristics required for the light receiving layer or the first layer whether the localized layer (B) is a part or the whole of the layer region ($L_T$).

Carbon atoms are distributed in the localized region (B) in the layer thickness direction such that the maximum distribution concentration of carbon atoms, Cmax, is preferably 500 atomic ppm or more, more preferably 800 atomic ppm or more, most preferably 1000 atomic ppm or more.

That is, it is preferable that the layer region (C) containing carbon atoms is formed such that the maximum distribution concentration Cmax is present within 5 microns of layer thickness from the support side (a layer region of 5 microns thick from $t_B$).

In the present invention, halogen atom (X), if desired, contained in the first layer region (G) and the second layer region (S) constituting the light receiving layer or the first layer may be fluorine, chlorine, bromine and iodine, preferably fluorine and chlorine.

In the present invention, formation of the first layer region (G) constituted of a-SiGe(H,X) may be conducted according to the vacuum deposition method utilizing discharging phenomenon, such as glow discharge method, sputtering method, ion-plating method and the like. For example, for formation of the first layer region (G) constituted of a-SiGe(H,X) according to the glow discharge method, the basic procedure comprises introducing a starting gas for Ge supply capable of supplying germanium atoms (Ge) together with a starting gas for Si supply capable of supplying silicon atoms (Si), and optionally a starting gas for introduction of hydrogen atoms (H) and/or a starting gas for introduction of halogen atoms (X) at a desired gas pressure into a deposition chamber which can be internally brought to a reduced pressure, and exciting glow discharge in said deposition chamber, thereby effecting layer formation on the surface of a support placed at a predetermined position. A layer consisting of a-SiGe(H,X) may be formed while controlling the depth profile of germanium atoms according to a desired change rate curve. Alternatively, for formation according to the sputtering method, when carrying out sputtering by use of a target constituted of Si or two sheets of targets of said target and a target constituted of Ge, or a target of a mixture of Si and Ge in an atmosphere of an inert gas such as Ar, He, etc. or a gas mixture based on these gases, a starting gas for Ge supply, if desired, diluted with a diluting gas such as He, Ar and the like, together with, if desired, a gas for introduction of hydrogen atoms (H) and/or a gas for introduction of halogen atoms (X) may be introduced into a deposition chamber for sputtering, thereby forming a plasma atmosphere of a desired gas, and sputtering of the aforesaid target may be effected, while controlling the gas flow rates of the starting gas for supply of Ge according to a desired change rate curve.

In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere, otherwise following the same procedure as in the case of sputtering.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred with respect to easy handling during layer formation and efficiency for supplying Ge.

Effective starting gases for introduction of halogen atoms to be used in the present invention may include a large number of halogenic compounds, as exemplified preferably by gaseous or gasifiable halogenic compounds such as halogenic gases, halides, interhalogen compounds, silane derivatives substituted with halogens, and the like.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

When the characteristic photoconductive member of the present invention is formed according to the glow discharge method by employment of such a silicon compound containing halogen atoms, it is possible to form the first layer region (G) comprising a-SiGe containing halogen atoms on a desired substitute without use of a hydrogenated silicon gas as the starting gas capable of supplying Si together with the starting gas for Ge supply.

In the case of forming the first layer region (G) containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio and a gas flow-rate into the deposition chamber for formation of the first layer region (G) and exciting glow discharge to form a plasma atmosphere of these gases, whereby the first layer region (G) can be formed on a desired support. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

In the present invention, as the starting gas for introduction of halogen atoms, the halides or halocontaining silicon compounds as mentioned above can effectively be used. Otherwise, it is also possible to use effectively as the starting material for formation of the first layer region (G) gaseous or gasifiable substances, including halides containing hydrogen atom as one of the constituents, e.g. hydrogen halide such as HF, HCl, HBr, HI, etc., halo-substituted hydrogenated silicon such as $SiH_2F_2$, $SiH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2Cl_2$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing hydrogen atoms can preferably be used as the starting material for introduction of halogen atoms, because hydrogen atoms, which are very effective for controlling electrical or photoconductive characteristics, can be introduced into the layer simultaneously with introduction of halogen atoms during formation of the first layer region (G).

For introducing hydrogen atoms structurally into the first layer region (G), other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

According to a preferred embodiment of the present invention, the amount of hydrogen atoms (H) or the amount of halogen atoms (X) or the sum of the amounts of hydrogen atoms and halogen atoms (H+X) to be contained in the first layer region (G) constituting the light-receiving layer or the first layer to be formed should preferably be 0.01 to 40 atomic %, more preferably 0.05 to 30 atomic %, most preferably 0.1 to 25 atomic %.

For controlling the amount of hydrogen atoms (H) and/or halogen atoms (X) to be contained in the first layer region (G), for example, the support temperature and/or the amount of the starting materials used for incorporation of hydrogen atoms (H) or halogen atoms (X) to be introduced into the deposition device system, discharging power, etc. may be controlled.

In the present invention, in order to from the second layer region (S) composed of a-Si(H,X), a starting materials which are the same as starting materials (I) for forming the first layer region (G) as mentioned above excluding a starting material for supplying Ge, (starting materials (II)for forming the second layer region (S)), are used under the same conditions and following the same method as those for producing the first layer region (G).

That is, in order to form the second layer region (S) composed of a-Si(H,X), for example, there may be used a vacuum deposition method utilizing discharging such as glow discharging method, sputtering method, ion plating method and the like.

For example, when a glow discharging method is used for producing the second layer region (S) composed of a-Si(H,X), the basic procedure comprises introducing a starting gas for supplying silicon atoms (Si), if desired, together with a starting gas for introducing hydrogen atoms (H) and/or a starting gas for introducing halogen atoms (X), into a deposition chamber capable of being internally brought to a reduced pressure, exciting glow discharge in the deposition chamber and thereby forming a layer of a-Si(H,X) on the surface of a predetermined support placed at a predetermined position. Alternatively, when sputtering method is used, for example, sputtering is carried out using a target composed of Si in an atmosphere of an inert gas such as Ar, He and the like or a gas mixture based on said gas and upon the sputtering, a gas for introducing hydrogen atoms (H) and/or halogen atoms (X) is introduced into the deposition chamber.

In the present invention, a layer region (C) containing carbon atoms may be formed in the light receiving layer or the first layer by using a starting material for introducing carbon atoms together with a starting material for forming the light receiving layer or the first layer upon forming the light receiving layer or the first layer and incorporating carbon atoms in the layer formed while controlling the amount of carbon.

When a glow discharging method is employed for forming the layer region (C), a starting material for introducing carbon is added to starting materials optionally selected, as desired, from the abovementioned starting materials for forming the light receiving layer or the first layer.

As such a starting material for introducing carbon atoms, there may be used most of gaseous or gasified gasifiable material containing at least carbon atom as a constituent atom.

For example, a starting gas containing silicon atom (Si) as a constituent atom, a starting gas containing carbon atom (C) as a constituent atom, and if desired, a starting gas containing hydrogen atom (H) and/or halogen atom (X) as constituent atoms are mixed at a desired ratio and used, or a starting gas containing silicon atom (Si) as a constituent atom and a starting gas containing carbon atom (C), hydrogen atom (H) and silicon atom (Si) as constituent atoms are mixed at a desired ratio and used.

Alternatively, a starting gas containing silicon atom (Si) and hydrogen atom (H) as constituent atoms and a starting gas containing carbon atom (C) as a constituent atom may be mixed and used.

As a material containing C and H as a constituent atom, there may be mentioned saturated hydrocarbons having 1 to 5 carbon atoms, ethylenic hydrocarbon having 2 to 5 carbon atoms, acetylene hydrocarbons having 2 to 4 carbon atoms and the like.

More specifically, there may be mentioned, as saturated hydrocarbons, methane ($CH_4$), ethane ($C_2H_6$), propane ($C_3H_8$), n-butane (n-$C_4H_{10}$) pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$) and the like.

Otherwise, as the starting gas containing Si, C and H as the constituent atoms, there may be alkyl silanes such as $Si(CH_3)_4$, $Si(C_2H_5)_4$ and the like.

According to the present invention, oxygen atoms and/or nitrogen atoms may be incorporated in the layer region (C) in addition to carbon atoms for the purpose of enhancing the effect of carbon atoms.

As a starting gas for introducing oxygen atoms into the layer region (C), there may be mentioned, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane ($H_3SiOSiH_3$), trisiloxane ($H_3SiOSiH_2OSiH_3$), and the like.

As an effective starting material which is used as a starting gas for introducing nitrogen atoms (N) to form the layer region (C), there may be mentioned gaseous or gasifiable nitrogen compounds such as nitrogen, nitrides, azides and the like, for example, nitrogen ($N_2$), ammonia ($NH_3$), hydrazine ($H_2NNH_2$), hydrogen azide ($HN_3$), ammonium azide ($NH_4N_3$) and the like which contain N as a constituent atom or N and H as constituent atoms. Other than those, there may be mentioned nitrogen halides which serve to introduce halogen atoms (X) as well as nitrogen atoms (N), for example, nitrogen trifluoride ($F_3N$), nitrogen tetrafluoride ($F_4N_2$) and the like.

Formation of the light receiving layer or the first layer containing carbon atoms by sputtering may be effected by using single crystal or polycrystal Si wafer, or C wafer, or a wafer comprising Si and C as a target and conducting sputtering is an atmosphere of various gases.

For example, when Si wafer is used as a target, starting gases for introducing carbon atoms and, if desired, hydrogen atoms and/or halogen atoms which are diluted with a diluting gas, are introduced into a deposition chamber for sputtering to form gas plasma of these gases for effecting sputtering with the above-mentioned Si wafer.

Alternatively, Si and C are used as separate targets, or Si and C are made into one sheet of target, and sputtering is effected in an atmosphere of a diluting gas or in a gaseous atmosphere containing hydrogen atoms (H) and/or halogen atoms (X). As a starting gas for introducing oxygen atoms, the starting gas for intorducing carbon atoms in the starting gases as mentioned above in the example of glow discharging can be used as an effective sputtering gas.

In the present invention, when the layer region (C) containing carbon atoms is formed upon producing the light receiving layer or the first layer, the layer region (C) having a desired distribution in the layer thickness direction (depth profile), that is, the change in the distribution concentration C (C) of carbon atoms in the layer thickness direction in the layer region (C), can be formed by, in the case of glow discharging, appropriately introducing a gas of a starting material for introducing carbon atoms to change the distribution concentration C (C) into a deposition chamber in such a way that the gas flow rate is properly changed in accordance with the desired change rate curve.

For example, the above-mentioned operation can be carried out by gradually changing the opening of a predetermined needle valve provided in the gas flow path system. The changing may be effected by a conventional means such as manual operation, an externally driven motor and the like. It is not necessary that the change of flow rate is linear, but the flow rate may be controlled following a preliminarily designed change rate curve by means of a microcomputer to obtain a desired content rate curve.

When the layer region (C) is formed by sputtering, the distribution concentration C (C) of carbon atoms in the layer thickness direction is changed to form a desired depth profile of carbon atoms by firstly using the starting material for introducing carbon atoms in a gaseous state in the same way as in the glow discharging method and appropriately changing the gas flow rate, as desired, upon introducing the gas into the deposition chamber, and secondly, for example, in the case of using a target composed of a mixture of Si and C for sputtering, preliminarily changing the ratio of Si to C in the layer thickness direction of the target.

In the present invention, the amount of hydrogen atoms (H), or halogen atoms (X), or the sum of hydrogen atoms and halogen atoms (H+X), in the second layer region (S) constituting the light receiving layer or the first layer is preferably 1–40 atomic %, more preferably 5–30 atomic %, most preferably 5–25 atomic %.

According to the present invention, by incorporating a substance (C) capable of controlling conductivity characteristics in at least one of the first layer region (G) and the second layer region (S) in the photoconductive member, the conductivity characteristics of a layer region containing the substance (C) can be optionally controlled as desired.

In the present invention, the substance (C) for controlling conductivity characteristics contained in the first layer region (G) may be uniformly contained over the whole layer region of the first layer region (G) or may be locally present only at a part of the first layer region (G).

In the present invention, when the substance (C) is incorporated in the first layer region (G) such that the substance (C) is locally present only at a part of the first layer region (G), a layer region (PN) where the substance (C) is contained is preferably provided as an end portion layer region of the first layer region (G). In particular, in case that the layer region is provided as an end portion layer region at the support side of the first layer region (G), injection of charge of a particular polarity into the light receiving layer from the support can be effectively prevented by selecting optionally the type of the substance (C) and the amount thereof to be contained in the layer region (PN).

In the photoconductive layer of the present invention, the substance (C) may be incorporated in the first layer region (G) constituting a part of the light receiving layer or the first layer in such a manner as mentioned above, that is, distributing the substance (C) over the whole region of the first layer region (G) or distributing locally in the direction of layer thickness, and further, the substance (C) may be incorporated in the second layer region (S) provided on the first layer region (G).

When the substance (C) is incorporated in the second layer region (S), the type of the substance (C) to be contained in the second layer region (S), an amount thereof and a manner of containing thereof are optionally determined depending upon the type of the substance (C) contained in the first layer region (G), an amount thereof and a manner of containing thereof.

In the present invention, when the substance (C) is incorporated in the second layer region (S), it is preferable to incorporate the substance in at least a layer region including a contact interface with the first layer region (G).

In the present invention the substance (C) may be incorporated in the whole layer region of the second layer region (S) or in a part of the layer region uniformly.

When the substance (C) is incorporated in both the first layer region (G) and the second layer region (S), it is preferable that the layer region containing the substance (C) in the first layer region (G) is contacted with that containing the substance (C) in the second layer region (S). The substance (C) contained in both layer regions (G) and (S) may be the same or different in both layer regions, and further, the content of the substance (C) may be the same or different in both layer regions.

However, in the present invention, when the substance (C) contained in each layer region is the same, it is preferable that the content in the first layer region (G) is sufficiently high, or the substance (C) in each layer region is different from each other as to the electric characteristics.

In the present invention, when the substance (C) is incorporated in only the second layer region, the content of the substance for controlling conductivity contained in the layer region (S) may be optionally selected depending on the conductivity required for the layer region (S) or the characteristics of the other layer regions provided in direct contact with the layer region (S) or the characteristics at the contacted interface with the other layer regions and the organic relationship therewith.

In this case, the content of the substance for controlling conductivity contained in the second layer region(S) should preferably be 0.001–1000 atomic ppm, more preferably 0.05–500 atomic ppm, most preferably 0.1–200 atomic ppm.

In the present invention, when the substance (C) is incorporated in at least one of the first layer region (C) and the second layer region (S) constituting the light receiving layer or the first layer, the conductivity characteristics of the layer region where the substance (C) is contained can be optionally controlled. The substance (C) may be so-called impurities as used in the art of semiconductor. In the present invention, p-type impurities imparting p-type conductivity to a-SiGe(H,X) and a-Si(H,X) constituting the light receiving layer or the first layer or n-type impurities imparting n-type conductivity thereto may be mentioned.

More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

As n-type impurities, there may be included the atoms belonging to the group V of the periodic table (Group V atoms), such as P (phosphorus), As (arsenic), Sb (antimony), Bi (bismuth), etc., particularly preferably P and As.

In the present invention, the content of the substance (C) for controlling conductivity in the layer region (PN) may be suitably selected depending on the conductivity required for said layer region (PN), or the characteristics at the interface contacting with the support (when the layer region (PN) is directly contacted with the support) and the organic relationship therewith.

Also, the content of the substance (C) for controlling conductivity is determined suitably with due considerations of the relationships with characteristics of other layer regions provided in direct contact with said layer region or the characteristics at the contacted interface with said other layer regions.

In the present invention, the content of the substance (C) for controlling conductivity contained in the layer region (PN) should preferably be 0.01 to $5\times10^4$ atomic ppm, more preferably 0.5 to $1\times10^4$ atomic ppm, most preferably $1-5\times10^3$ atomic ppm.

In the present invention, by making the content of the substance (C) in the layer region (PN) preferably 30 atomic ppm or more, more preferably 50 atomic ppm or more, most preferably 100 atomic ppm or more, for example, in the case when said substance (C) to be incorporated is a p-type impurity as mentioned above, migration of electrons injected from the support side into the light receiving layer can be effectively inhibited when the free surface of the light receiving layer is subjected to the charging treatment to ⊕ polarity. On the other hand, when the substance to be incorporated is a n-type impurity, migration of positive holes injected from the support side into the light receiving layer can be effectively inhibited when the free surface of the light receiving layer is subjected to the charging treatment to ⊖ polarity.

In the case as mentioned above, the layer region (Z) at the portion excluding the above layer region (PN) may contain a substance (C) for controlling conductivity of a polarity different from that of a substance (C) for controlling conductivity contained in layer region (PN), or a substance (C) for controlling conductivity characteristics of the same polarity may be contained therein in an amount by far smaller than that practically contained in the layer region (PN).

In such a case, the content of the substance (C) for controlling conductivity contained in the above layer region (Z) can be determined adequately as desired depending on the polarity or the content of the substance contained in the layer region (PN), but it is preferably 0.001 to 1000 atomic ppm, more preferably 0.05 to 500 atomic ppm, most preferably 0.1 to 200 atomic ppm.

In the present invention, when the same kind of a substance (C) for controlling conductivity is contained in the layer region (PN) and the layer region (Z), the content in the layer region (Z) should preferably be 30 atomic ppm or less.

In the present invention, it is also possible to provide a layer region containing a substance for controlling conductivity having one polarity and a layer region containing a substance for controlling conductivity having the other polarity in direct contact with each other in the light receiving layer or the first layer, thus providing a so called depletion layer at said contact region. In short, for example, a layer region containing the aforesaid p-type impurity and a layer region containing the aforesaid n-type impurity are provided in the light receiving layer in direct contact with each other to form the so called p-n junction, whereby a depletion layer can be provided.

For formation of the layer region (PN) containing the aforesaid substance (C) by incorporating a substance (C) for controlling conductivity such as the group III atoms or the group V atoms structurally into the light receiving layer or the first layer, a starting material for introduction of the group III atoms or a starting material for introduction of the group V atoms may be introducted under gaseous state into a deposition chamber together with the starting materials for formation of the layer region during layer formation. As the starting material which can be used for introduction of the group III atoms, it is desirable to use those which are gaseous at room temperature under atmospheric pressure or can readily be gasified at least under layer forming conditions. Typical examples of such starting materials for introduction of the group III atoms, there may be included as the compounds for introduction of boron atoms boron hydrides such as $B_2H_6$, $B_4H_{10}$, $B_3H_9$, $B_5H_{11}$, $B_6H_{10}$, $B_6H_{12}$, $B_6H_{14}$, etc. and boron halides such as BF3, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydride such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is also possible to utilize $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$ and the like effectively as the starting material for introduction of the group V atoms.

According to the present invention, when the light receiving layer formed on the support of the photoconductive member comprises a first layer as explained above and constituted of a first layer region (G) composed of a-SiGe(H,X) and a second layer region (S) composed of a-Si(H,X) and a second layer laminated with the first layer, the second layer has a free surface and is provided for the purpose of improving mainly humidity resistance, continuous repeated use characteristics, dielectric strength, use environmental characteristics, and durability to achieve the objects of the present invention. The second layer is constituted of an amorphous material composed of silicon atoms as a matrix and at least one of nitrogen atoms and oxygen atoms.

As a material constituting the second layer, for example, there may be mentioned preferably an amorphous material comprising silicon atoms (Si), nitrogen atoms (N), and, if desired, hydrogen atoms (H) and/or halogen atoms (hereinafter referred to as "a-$(Si_xN_{1-x})_y(H,X)_{1-y}$" where $O<x$, $y<1$).

When the second layer is constituted of a-$(Si_xN_{1-x})_y(H,X)_{1-y}$, the second layer (II) may be produced by glow discharge, sputtering, or electron beam method. These production methods are optionally selected depending on manufacturing conditions, load of capital investment, production scale, characteristics required for the photoconductive members to be produced, and the like, and according to these methods, the manufacturing conditions under which photoconductive members of desired characteristics are produced can be easily controlled. Glow discharging methods or sputtering methods are preferably employed since nitrogen atoms and halogen atoms together with silicon atoms can be easily introduced into the second layer.

Further, according to the present invention, the second layer may be formed by using a glow discharging method and a sputtering method in combination in one and the same apparatus system.

Formation of the second layer according to glow discharging may be carried out by introducing a starting gas for forming a-$(Si_xN_{1-x})_y(H,X)_{1-y}$, if desired, mixed with a diluting gas at a desired ratio into a deposition chamber for vacuum deposition in which a support is placed, forming a gas plasma of the introduced gas by glow discharging, and depositing a-$(Si_xN_{1-x})_y(H,X)_{1-y}$ on the first layer already formed on a support.

In the present invention, as a starting gas for forming a-$(Si_xN_{1-x})_y(H,X)_{1-y}$, there may be used most of the gaseous or gasifiable materials containing at least one of silicon atom (Si), nitrogen atom (N), hydrogen atom (H) and halogen atom (X) as the constituent atom.

When a starting gas containing Si as a constituent atom is used as one of Si, N, H and X, there may be used, for example, a starting gas containing Si as a constituent atom, a starting gas containing N as a constituent atom, and if desired, a starting gas containing H as a constituent atom and/or a starting gas containing X as a constituent atom at a desired mixing ratio; a starting gas containing Si as a constituent atom, a starting gas containing N and H as constituent atoms, and/or a starting gas containing N and X as constituent atoms at a desired mixing ratio; or a starting gas containing Si as a constituent atom and a starting gas containing Si, N and H as constituent atoms or a starting gas containing Si, N and X as constituent atoms in a form of mixture.

Alternatively, there may be used a mixture of a starting gas containing Si and H as constituent atoms and a starting gas containing N as a constituent atom, or a mixture of a starting gas containing Si and X as constituent atoms and a starting gas containing N as a constituent atom.

As the halogen atom contained in the second layer according to the present invention, there may be preferably F, Cl, Br and I, more preferably F and Cl.

In the present invention, the starting gas which can be effectively used for formation of the second layer may include those which are gaseous under conditions of room temperature and atmospheric pressure or can be readily gasified.

When the second layer is constituted of the amorphous materials, as the layer production methods, there may be mentioned glow discharge, sputtering, ion plantation, ion plating, or electron beam method. These production methods are optionally selected depending on manufacturing conditions, load of capital investment, production scale, characteristics required for the photoconductive members to be produced, and the like, and according to these methods, the manufacturing conditions under which photoconductive members of desired characteristics are produced can be easily controlled. Glow discharging methods or sputtering methods are preferably employed since nitrogen atoms together with silicon atoms, and optionally hydrogen atoms and halogen atoms can be easily introduced into the second layer.

Further, according to the present invention, the second layer may be formed by using a glow discharging method and a sputtering method in combination in one and the same apparatus system.

For formation of the second layer constituted of a-SiN(H,X) according to the glow discharge method, the basic procedure comprises introducing a starting gas for introduction of nitrogen atoms (N) together with a starting gas for Si supply capable of supplying silicon atoms, and optionally a starting gas for introduction of hydrogen atoms (H) and/or a starting gas for introduction of halogen atoms (X) into a deposition chamber which can be internally brought to a reduced pressure, and exciting glow discharge in the deposition chamber, thereby the second layer consisting of a-SiN(H,X) may be formed on the first layer (I) placed at a predetermined position.

Formation of the second layer (II) according to the sputtering method may be practiced as follows.

In the first place, when a target constituted of Si is subjected to sputtering in an atmosphere of an inert gas such as Ar, He, etc. or a gas mixture based on these gases, a starting gas for introduction of nitrogen atoms (N) may be introduced, optionally together with starting gases for introduction of hydrogen atoms (H) and/or halogen atoms (X), into a vacuum deposition chamber for carrying out sputtering.

In the second place, nitrogen atoms (N) can be introduced into the second layer (II) formed by the use of a target constituted of $Si_3N_4$, or two sheets of a target constituted of Si and a target constituted of $Si_3N_4$, or a target constituted of Si and $Si_3N_4$. In this case, if the starting gas for introduction of nitrogen atoms (N) as mentioned above is used in combination, the amount of nitrogen atoms (N) to be incorporated in the second layer (II) can easily be controlled as desired by controlling the flow rate thereof.

The amount of nitrogen atoms (N) to be incorporated into the second layer (II) can be controlled as desired by controlling the flow rate of the starting gas for introduction of nitrogen atoms (N), adjusting the ratio of nitrogen atoms (N) in the target for introduction of nitrogen atoms during preparation of the target, or performing both of these.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to each handling during layer formation and efficiency for supplying Si.

By the use of these starting materials, H can also be incorporated together with Si in the second layer formed by adequate choice of the layer forming conditions.

As the starting materials effectively used for supplying Si, in addition to the hydrogenated silicons as mentioned above, there may be included silicon compounds containing halogen atoms (X), namely the so called silane derivatives substituted with halogen atoms, including silicon halogenide such as SiF4, $Si_2F_6$, $SiCl_4$, $SiBr_4$, etc., as preferable ones.

Further, halides containing hydrogen atoms as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_2Br_2$, $SiHBr_3$, etc. may also be mentioned as the effective starting materials for supplying Si for formation of the second layer.

Also, in the case of employing a silicon compound containing halogen atoms (X), X can be introduced together with Si in the second layer formed by suitable choice of the layer forming conditions as mentioned above.

Among the starting materials described above, silicon halogenide compounds containing hydrogen atoms are used as preferable starting material for introduction of halogen atoms (X) in the present invention since, during the formation of the second layer (II), hydrogen atoms (H), which are extremely effective for controlling electrical or photoelectric characteristics, can be incorporated together with halogen atoms (X) into the layer.

Effective starting materials to be used as the starting gases for introduction of halogen atoms (X) in formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc. and hydrogen halides such as HF, HCl, HBr, HI, etc.

The starging material effectively used as the starting gas for introduction of nitrogen atoms (N) to be used during formation of the second layer, it is possible to use compounds containing N as constituent atom or compounds containing N and H as constituent atoms, for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), dinitrogen tetrafluoride ($F_4N_2$) and the like.

In the present invention, as the diluting gas to be used in formation of the second layer (II) by the glow discharge method or the sputtering method, there may be included the so-called rare gases such as He, Ne and Ar as preferable ones.

The second layer in the present invention should be carefully formed so that the required characteristics may be given exactly as desired.

That is, the above material containing Si and N, optionally together with H and/or X as constituent atoms can take various forms from crystalline to amorphous and show electrical properties from conductive through semiconductive to insulating and photoconductive properties from photoconductive to non-photoconductive depending on the preparation conditions. Therefore, in the present invention, the preparation conditions are strictly selected as desired so that there may be formed a-$(Si_xN_{1-x})_y(H,X)_{1-y}$ having desired characteristics depending on the purpose. For example, when the second layer (II) is to be provided primarily for the purpose of improvement of dielectric strength, a-$(Si_xN_{1-x})_{1-y}(H,X)_{1-y}$ is prepared as an amorphous material having marked electric insulating behaviors under the use environment.

Alternatively, when the primary purpose for provision of the second layer is improvement of continuous repeated use characteristics or environmental use characteristics, the degree of the above electric insulating property may be alleviated to some extent and the aforesaid amorphous material may be prepared a-$(Si_xN_{1-x})_y(H,X)_{1-y}$ as an amorphous material having sensitivity to some extent to the light irradiated.

In forming the second layer constituted of a-$(Si_xN_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that a-$(Si_xN_{1-x})_{1-y}(H,X)_{1-y}$ having intended characteristics may be prepared as desired.

As the substrate temperature in forming the second layer (II) for accomplishing effectively the objects in the present invention, there may be selected suitably the optimum temperature range in conformity with the method for forming the second layer (II) in carrying out formation of the second layer (II), preferably 20° to 400° C., more preferably 50° to 350° C., most preferably 100° to 300° C. For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to these layer forming methods, the discharging power during layer formation is one of important factors influencing the characteristics of a-$(Si_xN_{1-x})_y(H,X)_{1-y}$ to be prepared, similarly as the aforesaid substrate temperature.

The discharging power condition for preparing effectively a-$(Si_xN_{1-x})_y(H,X)_{1-y}$ having characteristics for accomplishing the objects of the present invention with good productivity may preferably be 1.0 to 300 W, more preferably 2.0 to 250 W, most preferably 5.0 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second layer (II). However, these factors for layer formation should not be determined separately independently of each other, but it is desirable that the optimum values of respective layer forming factors should be determined based on mutual organic relationships so that the second layer constituted of a-$(Si_xN_{1-x})_y(H,X)_{1-y}$ having desired characteristics may be formed.

The respective contents of nitrogen atoms in the second layer in the photoconductive member of the present invention are important factors for obtaining the desired characteristics to accomplish the objects of the present invention, similarly as the conditions for preparation of the second layer. The respective contents of nitrogen atoms contained in the second layer in the present invention are determined optionally as desired depending on the kind of the amorphous material constituting the second layer and its characteristics.

That is, the amorphous material represented by the above formula a-$(Si_xN_{1-x})_y(H,X)_{1-y}$ may be broadly classified into an amorphous material constituted of silicon atoms and nitrogen atoms (hereinafter written as "a-$Si_aN_{1-a}$", where $0<a<1$), an amorphous material constituted of silicon atoms, nitrogen atoms and hydrogen atoms (hereinafter written as a-$(Si_bN_{1-b})_c H_{1-c}$, where $0<b, c<1$) and an amorphous material constituted of silicon atoms, nitrogen atoms, halogen atoms and optionally hydrogen atoms (hereinafter written as "a-$(Si_dN_{1-d})_e(H,X)_{1-e}$", where $0<d, e<1$).

In the present invention, when the second layer is to be constituted of a-$Si_aN_{1-a}$, the content of nitrogen atoms in the second layer may preferably be $1\times10^{-3}$ to 60 atomic %, more preferably 1 to 50 atomic %, most preferably 10 to 45 atomic %, namely in terms of representation by a in the above a-$Si_aN_{1-a}$, a being preferably 0.4 to 0.99999, more preferably 0.5 to 0.99, most preferably 0.55 to 0.9.

In the present invention, when the second layer (II) is to be constituted of a-$(Si_bN_{1-b})_cH_{1-c}$, the content of nitrogen atoms in the second layer (II) may preferably be $1\times10^{-3}$ to 55 atomic %, more preferably 1 to 55 atomic %, most preferably 10 to 55 atomic %, the content of hydrogen atoms preferably 1 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bN_{1-b})_cH_{1-c}$, b should preferably be 0.45 to 0.99999, more preferably 0.45 to 0.99, most preferably 0.45 to 0.9, and c preferably 0.6 to 0.99, more preferably 0.65 to 0.98, most preferably 0.7 to 0.95.

When the second layer (II) to be constituted of a-$(Si_dN_{1-d})_e(H,X)_{1-e}$, the content of nitrogen atoms in the second layer (II) may preferably be $1\times10^{-3}$ to 60 atomic %, more preferably 1 to 60 atomic %, most preferably 10 to 55 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical aspect. The content of hydrogen atoms optionally contained may preferably be 19 atomic % or less, more preferably 13 atomic % or less.

That is, in terms of representation by d and e in the above a- $Si_dN_{1-d})_e(H,X)_{1-e}$, should preferably be 0.4 to 0.99999, more preferably 0.4 to 0.99, most preferably 0.45 to 0.9, and e preferably 0.8 to 0.99, more preferably 0.82 - 0.99, most preferably 0.85 to 0.98.

The range of the numerical value of layer thickness of the second layer is an important factor to effectively accomplish the objects of the present invention and should desirably be determined depending on the intended purpose so as to effectively accomplish the objects of the present invention.

The layer thickness of the second layer is also required to be determined as desired suitably with due considerations about the relationships with the contents of nitrogen atoms, the relationship with the layer thickness of the first layer, as well as other organic relationships with the characteristics required for respective layer regions.

In addition, it is also desirable to have considerations from economical point of view such as productivity or capability of bulk production.

The second layer in the present invention is desired to have a layer thickness preferably of 0.003 to 30 μ, more preferably 0.004 to 20 μ, most preferably 0.005 to 10 μ.

As another preferable example of a material constituting the second layer, there may be mentioned an amorphous material containing silicon atoms (Si) and oxygen atoms (0), if desired together with hydrogen atoms (H) and/or halogen atoms (X) (hereinafter referred to as "a-$(Si_xO_{1-x})_y(H,X)_{1-y}$", where $0<x, y<1$).

When the second layer is constituted of a-$(Si_xO_{1-x})_y(H,X)_{1-y}$, the second layer may be produced by glow discharge, sputtering, electron beam, ion plantation or ion plating method. These production methods are optionally selected depending on manufacturing conditions, load of capital investment, production scale, characteristics required for the photoconductive members to be produced, and the like, and according to these methods, the manufacturing conditions under which photoconductive members of desired characteristics are produced can be easily controlled. Glow discharging methods or sputtering methods are preferably employed since oxygen atoms and halogen atoms together with silicon atoms can be easily introduced into the second layer.

Further, according to the present invention, the second layer may be formed by using a glow discharging method and a sputtering method in combination in one and the same apparatus system.

Formation of the second layer according to glow discharging may be carried out by introducing a starting gas for forming a-$(Si_xO_{1-x})_y(H,X)_{1-y}$, if desired, mixed with a diluting gas at a desired ratio into a vacuum deposition chamber in which a support is placed, forming a gas plasma of the introduced gas by glow discahrging, and depositing a-$(Si_xO_{1-x})_y(H,X)_{1-y}$ on the first layer already formed on a support.

In the present invention, as a starting gas for forming a-$(Si_xO_{1-x})_y(H,X)_{1-y}$, there may be used most of the gaseous or gasifiable materials containing at least one of silicon atom (Si), oxygen atom (O), hydrogen atom (H) and halogen atom (X) as the constituent atom.

When a starting gas containing Si as a constituent atom is used as one of Si, O, H and X, there may be used, for example, a starting gas containing Si as a constituent atom, a starting gas containing O as a constituent atom, and if desired, a starting gas containing H as a constituent atom and/or a starting gas containing X as a constituent gas at a desired mixing ratio; a starting gas containing Si as a constituent atom, a starting gas containing O and H as constituent atoms, and/or a starting gas containing O and X as a constituent atoms at a desired mixing ratio; or a starting gas containing Si as a constituent atom and a starting gas containing Si, O, and H as constituent atoms or a starting gas containing Si, O, and X as constituent atoms in a form of mixture.

Alternatively, there may be used a mixture of a starting gas containing Si and H as constituent atoms and a starting gas containing O as a constituent atom, or a mixture of starting gas containing Si and X as constituent atoms and a starting gas containing O as a constituent atom.

As the halogen atom contained in the second layer according to the present invention, there may be preferably F, Cl, Br and I, more preferably F and Cl.

In the present invention, the starting gas which can be effectively used for formation of the second layer may include those which are gaseous under conditions of room temperature and atmospheric pressure or can be readily gasified.

In the present invention, as a starting gas used effectively for forming the second layer, there may be mentioned a material which is in a gaseous form at room temperature and normal pressure or is easily gasifiable.

Formation of the second layer (II) according to the sputtering method may be practiced as follows.

In the first place, when a target constituted of Si is subjected to sputtering in an atmosphere of an inert gas such as Ar, He, etc. or a gas mixture based on these gases, a starting gas for introduction of oxygen atoms (O) may be introduced, optionally together with starting gases for introduction of hydrogen atoms (H) and/or halogen atoms (X), into a vacuum deposition chamber for carrying out sputtering.

In the second place, oxygen atoms (N) can be introduced into the second layer (II) formed by the use of a target constituted of $SiO_2$, or two sheets of a target constituted of Si and a target constituted of $SiO_2$, or a target constituted of Si and $SiO_2$. In this case, if the starting gas for introduction of oxygen atoms (0) as mentioned above is used in combination, the amount of oxygen atoms (O) to be incorporated in the second layer (II) can easily be controlled as desired by controlling the flow rate thereof.

The amount of oxygen atoms (O) to be incorporated into the second layer (II) can be controlled as desired by controlling the flow rate of the starting gas for introduction of oxygen atoms (O), adjusting the ratio of oxygen atoms (O) in the target for introduction of oxygen atoms during preparation of the target, or performing both of these.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to each handling during layer formation and efficiency for supplying Si.

By the use of these starting materials, H can also be incorporated together with Si in the second layer formed by adequate choice of the layer forming conditions.

As the starting materials effectively used for supplying Si, in addition to the hydrogenated silicons as mentioned above, there may be included silicon compounds containing halogen atoms (X), namely the so called silane derivatives substituted with halogen atoms, including silicon halogenide such as $SiF_4$, $Si_2F_6$, $SiCl_4$, $SiBr_4$, etc., as preferable ones.

Further, halides containing hydrogen atoms as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_2Br_2$, $SiHBr_3$, etc. may also be mentioned as the effective starting materials for supplying Si for formation of the second layer.

Also, in the case of employing a silicon compound containing halogen atoms (X), X can be introduced together with Si in the second layer formed by suitable choice of the layer forming conditions as mentioned above.

Among the starting materials described above, silicon halogenide compounds containing hydrogen atoms are used as preferable starting material for introduction of halogen atoms (X) in the present invention since, during the formation of the second layer (II), hydrogen atoms (H), which are extremely effective for controlling electrical or photoelectric characteristics, can be incorporated together with halogen atoms (X) into the layer.

Effective starting materials to be used as the starting gases for introduction of halogen atoms (X) in formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc. and hydrogen halides such as HF, HCl, HBr, HI, etc.

The starting material effectively used as the starting gas for introduction of oxygen atoms (O) to be used during formation of the second layer, it is possible to use compounds containing O as constituent atom or compounds containing N and O as constituent atoms, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H)

as constituent atoms such as disiloxane ($H_3SiOSiH_3$), trisiloxane ($H_3SiOSiH_2OSiH_3$), and the like.

In the present invention, as the diluting gas to be used in formation of the second layer (II) by the glow discharge method or the sputtering method, there may be included the so called rare gases such as He, Ne and Ar as preferable ones.

The second layer in the present invention should be carefully formed so that the required characteristics may be given exactly as desired.

That is, the above material containing Si, O, and optionally together with H and/or X as constituent atoms can take various forms from crystalline to amorphous and show electrical properties from conductive through semi-conductive to insulating and photoconductive properties from photoconductive to non-photoconductive depending on the preparation conditions. Therefore, in the present invention, the preparation conditions are strictly selected as desired so that there may be formed a-$(Si_xO_{1-x})_y(H,X)_{1-y}$ having desired characteristics depending on the purpose. For example, when the second layer (II) is to be provided primarily for the purpose of improvement of dielectric strength, a-$(Si_xO_{1-x})_y(H,X)_{1-y}$ is prepared as an amorphous material having marked electric insulating behaviours under the use environment.

Alternatively, when the primary purpose for provision of the second layer is improvement of continuous repeated use characteristics or environmental use characteristics, the degree of the above electric insulating property may be alleviated to some extent and the aforesaid amorphous material may be prepared a-$(Si_xO_{1-x})_y(H,X)_{1-y}$ as an amorphous material having sensitivity to some extent to the light irradiated.

In forming the second layer constituted of a-$(Si_xO_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that a-$(Si_xO_{1-x})_y(H,X)_{1-y}$ having intended characteristics may be prepared as desired.

As the substrate temperature in forming the second layer (II) for accomplishing effectively the objects in the present invention, there may be selected suitably the optimum temperature range in conformity with the method for forming the second layer (II) in carrying out formation of the second layer (II), preferably 20° to 400° C., more preferably 50° to 350° C., most preferably 100° to 300° C. For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to these layer forming methods, the discharging power during layer formation is one of important factors influencing the characteristics of a-$(Si_xO_{1-x})_y(H,X)_{1-y}$ to be prepared, similarly as the aforesaid substrate temperature.

The discharging power condition for preparing effectively a-$(Si_xO_{1-x})_y(H,X)_{1-y}$ having characteristics for accomplishing the objects of the present invention with good productivity may preferably be 1.0 to 300 W, more preferably 2.0 to 250 W, most preferably 5.0 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second layer (II). However, these factors for layer formation should not be determined separately independently of each other, but it is desirable that the optimum values of respective layer forming factors should be determined based on mutual organic relationships so that the second layer constituted of a$-(Si_xO_{1-x})_y(H,X)_{1-y}$ having desired characteristics may be formed.

The respective contents of oxygen atoms in the second layer in the photoconductive member of the present invention are important factors for obtaining the desired characteristics to accomplish the objects of the present invention, similarly as the conditions for preparation of the second layer. The respective contents of oxygen atoms contained in the second layer in the present invention are determined optionally as desired depending on the kind of the amorphous material constituting the second layer and its characteristics.

The amorphous material represented by the above formula a-$(Si_xO_{1-x})_y(H,X)_{1-y}$ may be broadly classified into an amorphous material constituted of silicon atoms and oxygen atoms (hereinafter written as "a$-Si_aO_{1-a}$" where $0<a<1$), an amorphous material constituted of silicon atoms, oxygen atoms and hydrogen atoms (hereinafter written as a$-(Si_bO_{1-b})_c H_{1-c}$, where $0<b$, $c<1$), and an amorphous material constituted of silicon atoms, oxygen atoms, halogen atoms and optionally hydrogen atoms (hereinafter written as "a$-(Si_dO_{1-d})_e(H,X)_{1-e}$", where $0<d$, $e<1$).

In the present invention, when the second layer (II) is to be constituted of a$-Si_aO_{1-a}$, the content of oxygen atoms in the second layer (II) may be in terms of representation by a in the above a$-Si_aO_{1-a}$, a being preferably 0.33 to 0.99999, more preferably 0.5 to 0.99, most preferably 0.6 to 0.9.

In the present invention, when the second layer (II) is to be constituted of a$-(Si_bO_{1-b})_cH_{1-c}$, the content of oxygen atoms may be in terms of the representation by the above a$-(Si_bO_{1-b})_cH_{1-c}$, b should preferably be 0.33 to 0.99999, more preferably 0.5 to 0.99, most preferably 0.6 to 0.9, and c preferably 0.6 to 0.99, more preferably 0.65 to 0.98, most preferably 0.7 to 0.95.

When the second layer (II) is to be constituted of a$-(Si_dO_{1-d})_e(H,X)_{1-e}$, the content of oxygen atoms may be in terms of representation by d and e in the above a$-(Si_dO_{1-d})_e(H,X)_{1-e}$, d should preferably be 0.33 to 0.99999, more preferably 0.5 to 0.99, most preferably 0.6 to 0.9, and e preferably 0.8 to 0.99, more preferably 0.82–0.99, most preferably 0.85 to 0.98.

The range of the numerical value of layer thickness of the second layer (II) is an important factor to effectively accomplish the objects of the present invention, and should desirably be determined depending on the intended purpose.

The layer thickness of the second layer (II) is also required to be determined as desired suitably with due considerations about the relationships with the contents of oxygen atoms, the relationship with the layer thickness of the first layer (I), as well as other organic relationships with the characteristics required for respective layer regions. In addition, it is also desirable to have considerations from economical point of view such as productivity or capability of mass production.

The second layer (II) in the present invention is desired to have a layer thickness preferably of 0.003 to 30μ, more preferably 0.004 to 20μ, most preferably 0.005 to 10μ.

The support to be used in the present invention may be either electroconductive material or insulating material. As the electroconductive material, there may be mentioned metals such as NiCr, stainless steel, Al, Cr, Mo, Au, Nb, Ta, V, Ti, Pt, Pd etc. or alloys thereof.

As the insulating material, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and the like. These insulating supports should preferably have at least one surface subjected to electroconductivizing treatment, and it is desirable to provide other layers on the electroconductivized surface.

For example, electroconductivizing treatment of a glass can be effected by providing a thin film of NiCr, Al, Cr, Mo, Au, Ir, Nb, Ta, V, Ti, Pt, Pd, $In_2O_3$, $SnO_2$, ITO($In_2O_3$-$SnO_2$) thereon. Alternatively, a synthetic resin film such as polyester film can be subjected to the electroconductivizing treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have flexibility, the support is made as thin as possible, so far as the function of a support can be sufficiently exhibited. However, in such a case, the thickness is preferably 10 microns or more from viewpoints of fabrication and handling of the support as well as its mechanical strength.

Next, an example of the process for producing the photoconductive member of this invention is to be briefly described.

Figure 12:
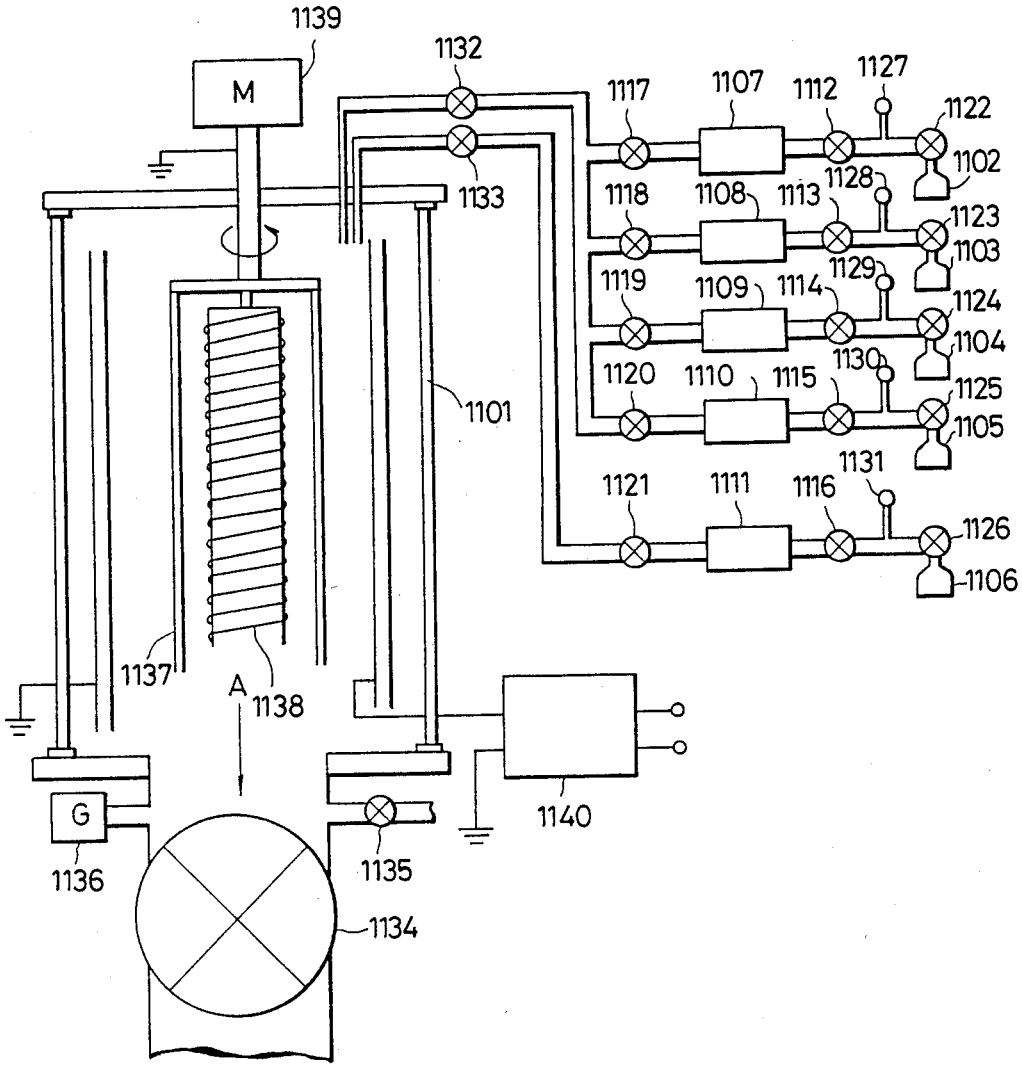
FIG. 12 schematically shows an apparatus which may be used for fabricating the photoconductive member according to the present invention.

FIG. 12 shows one example of a device for producing a photoconductive member.

In the gas bombs 1102 to 1106, there are hermetically contained starting gases for formation of the photosensitive member of the present invention. For example, 1102 is a bomb containing $SiH_4$ gas diluted with He (purity: 99.999% , hereinafter abbreviated as $SiH_4$/He), 1103 is a bomb containing $GeH_4$ gas diluted with He (purity: 99.999%, hereinafter abbreviated as $GeH_4$/He), 1104 is a bomb containing $B_2H_6$ gas diluted with He (purity 99.99%, hereinafter abbreviated as $B_2H_6$/He), 1105 is a bomb containing $C_2H_4$ gas (purity: 99.999%) and 1106 is a bomb containing $H_2$ gas (purity: 99.999%).

For allowing these gases to flow into the reaction chamber 1101, on confirmation of the valves 1122–1126 of the gas bombs 1102–1106 and the leak valve 1135 to be closed, and the inflIow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes about $5\times10^{-6}$ Torr, the auxiliary valves 1132, 1133 and the outflow valves 1117–1121 are closed.

Referring now to an example of forming the light receiving layer on a cylindrical substrate 1137, $SiH_4$/He gas from gas bomb 1102, $GeH_4$/He gas from gas bomb 1103, and if desired, $B_2H_6$ gas from gas bomb 1104 $C_2H_4$ gas from gas bomb 1105 are permitted to flow into the mass-flow controllers 1107–1110 respectively, by opening valves 1122–1125 to adjust the pressures at outlet pressure gauges 1127–1130 to 1 kg/cm$^2$, and opening gradually inflow valves 1112–1115. Then, outflow valves 1117–1120 and auxiliary valve 1132 are gradually opened to permit respective gases to flow into reaction chamber 1101. Outflow valves 1117–1120 are adjusted so as to render the flow rate ratio of $SiH_4$/He gas : $GeH_4$/He gas : $C_2H_4$ gas to be a desired value, or, when boron (B) is incorporated in the layer formed, the flow-rate ratio of $B_2H_6$/He gas to the above mentioned gases to be a desired value, and further, the pressure in reaction chamber 1101 is adjusted to a desired value by controlling the opening of main valve 1134 while observing the reading of vacuum meter 1136. Then, after confirming that the temperature of substrate 1137 is set to about 50°–400° C. by heater 1138, power source 1140 is set to a predetermined power to exite a glow discharge in reaction chamber 1101, and simultaneously the flow rate of $GeH_4$/He gas is controlled following a preliminarily designed change rate curve by gradually changing the opening of valve 1118 by manual operation or an externally driven motor and thereby the distribution concentration of germanium atoms to be contained in the resulting layer.

In this way, on substrate 1137 there was formed a layer region (C) or layer region (B, C) in a desired thickness. The layer region (C) contains carbon atoms (C) and the layer region (B, C) are composed of a-SiGe(H,X) where the distribution of germanium atoms follows the above-mentioned change rate curve.

At the stage where the layer region (C) or the layer region (B, C) is formed in a desired thickness, outflow valve 1118 is completely closed, and outflow valves 1119 and 1120 are if desired, closed or opened, and thereby a layer region (S) composed of a-Si(H,X) is formed which does not contain Ge and contains or does not contain boron atoms (B) and carbon atoms (C). Thus, the formation of the light receiving layer is completed.

Upon forming the light receiving layer, after a desired time has elapsed after beginning the layer formation, inflow of $B_2H_6$/He gas or $C_2H_4$ gas into the deposition chamber is stopped and thereby, the layer thickness of a layer region (B) containing boron atoms and that of a layer region (C) containing carbon atoms can be optionally controlled.

In addition, following a desired change rate curve, the gas flow rate of $C_2H_4$ into deposition chamber 1101 is controlled and thereby, the distribution of carbon atoms in the layer region (C) can be formed as desired.

For incorporating halogen atoms in the light receiving layer, for example, $SiF_4$ gas is added to the above-mentioned gas and glow discharge is effected.

When hydrogen atoms are not incorporated in the light receiving layer, but halogen atoms are incorporated therein, there may be used $SiF_4$/He gas and $GeF_4$/He gas in place of $SiF_4$/He gas and $GeH_4$/He gas.

When the layer formed as above is used as a first layer and a second layer is formed on the first layer, and these two layers are made a light receiving layer, the second layer can be formed by a valve operation similar to the formation of the first layer. In this case, an $NH_3$ gas bomb or an NO gas bomb is newly provided, or substituted for a gas bomb which is not used, and glow discharge is optionally carried out in $SiH_4$ gas and $NH_3$ gas, or in $SiH_4$ gas and NO gas, if desired, these gases are diluted with a diluting gas such as He, resulting in formation of the second layer.

For incorporating halogen atoms in the second layer, the preparation of the second layer is effected, for example, by using $SiF_4$ gas and $C_2H_4$ gas, or $SiF_4$ gas and NO gas, or adding SiH4 gas to the said gases.

It is a matter of course that all outflow valves other than the outflow valves necessary for forming a layer are closed. Upon forming each layer, in order to avoid that the gases used for preparing the previous layer remain in reaction chamber 1101 and gas pipelines from outflow valves 1117–1121 to reaction chamber 1101, outflow valves 1117–1121 are closed, auxiliary valves 1132 and 1133 are opened, and main valve 1134 is fully opened to evacuate the system up to a high vacuum, if desired.

The content of nitrogen atoms or oxygen atoms in the second layer may be controlled as desired as follows. When glow discharge is employed, the flow rate ratio of $SiH_4$ gas to $NH_4$ gas, or $SiH_4$ gas to NO gas, introduced into reaction chamber 1101 is changed as desired, or when sputtering is employed, the sputtering area ratio of silicon wafer to silicon nitride plate, or that of silicon wafer to $SiO_2$ plate, or the mixing ratio of silicon powder to silicon nitride powder, or that of silicon powder to $SiO_2$ powder is changed upon forming the target.

The amount of halogen atoms (X) contained in the second layer can be controlled by adjusting the flow rate of halogen atom introducing starting gas, for example, $SiF_4$ gas, when intorudced into reaction 1101.

It is preferable to rotate substrate 1137 by motor 1139 during the formation of a layer so as to form the layer uniformly.

The following examples are for illustrating the present invention.

EXAMPLE 1

Figure 13:
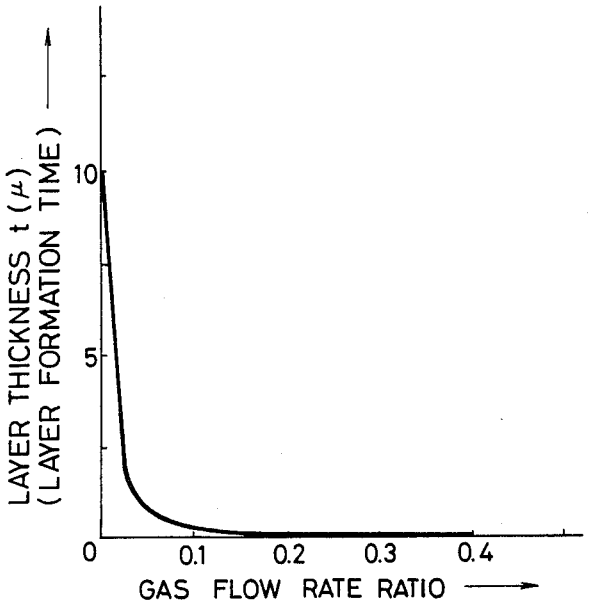
FIG. 13–FIG. 60 show changing rate curves of gas flow rate ratio in the examples of the present invention.

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table A-1 following the changing curve of the gas flow rate ratio as shown in FIG. 13, and thereby, an electrophotographic image forming member was produced.

The resulting image forming member was set in an experimental device for charging and exposure, and corona charging was effected at ⊖5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖5.0 KV, there was obtained a clear image of high density excellent in resolution with good gradation reproducibility.

EXAMPLE 2

Figure 14:
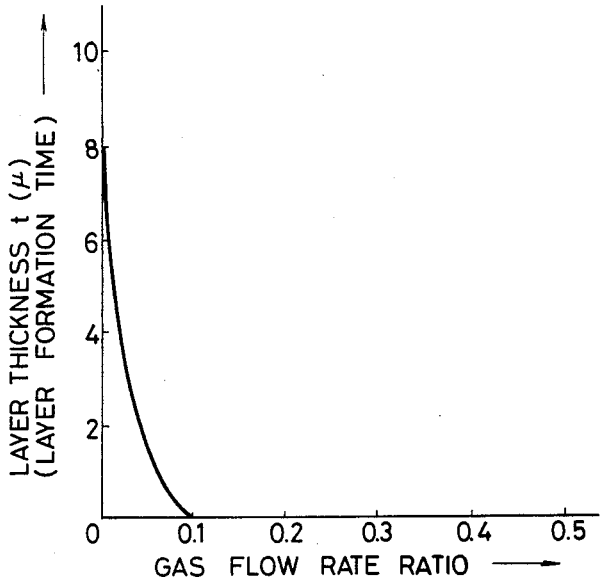

By the preparation device as shown in FIG. 12, layers were formed by changing the gas flow rate ratio of $GeH_4$/He gas to $SiH_4$/He gas along with the lapse of time for forming the layer under the condition of Table A-2 following the changing curve of the gas flow rate ratio as shown in FIG. 14 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 3

Figure 15:
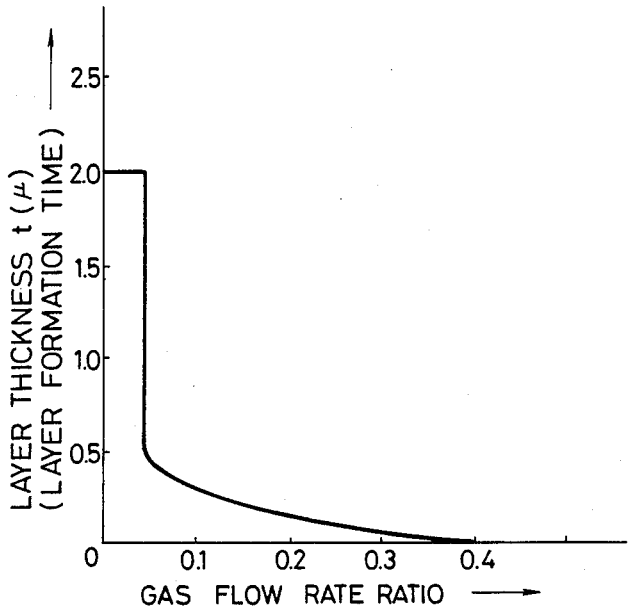

By the preparation device as shown in FIG. 12, layers were formed by changing the gas flow rate ratio of $GeH_4$/He gas to $SiH_4$/He gas along with the lapse of time for forming the layer under the condition of Table A-3 following the changing curve of the gas flow rate ratio as shown in FIG. 15 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 4

Figure 16:
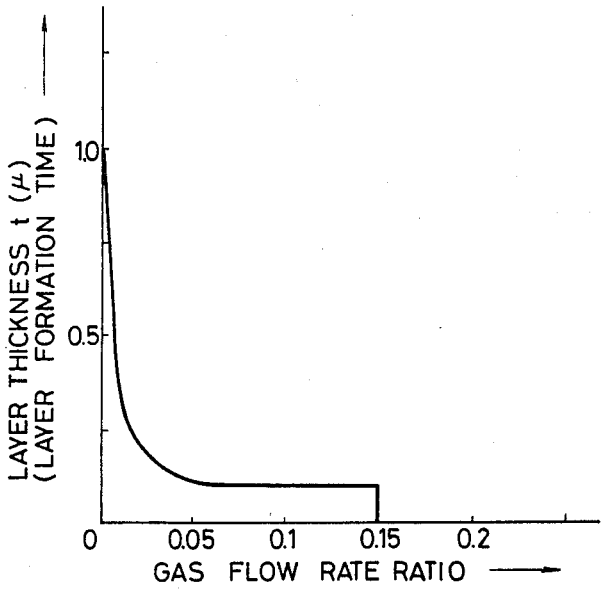

By the preparation device as shown in FIG. 12, layers were formed by changing the gas flow rate ratio of $GeH_4$/He gas to $SiH_4$/He gas along with the lapse of time for forming the layer under the condition of Table A-4 following the changing curve of the gas flow rate ratio as shown in FIG. 16 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 5

Figure 17:
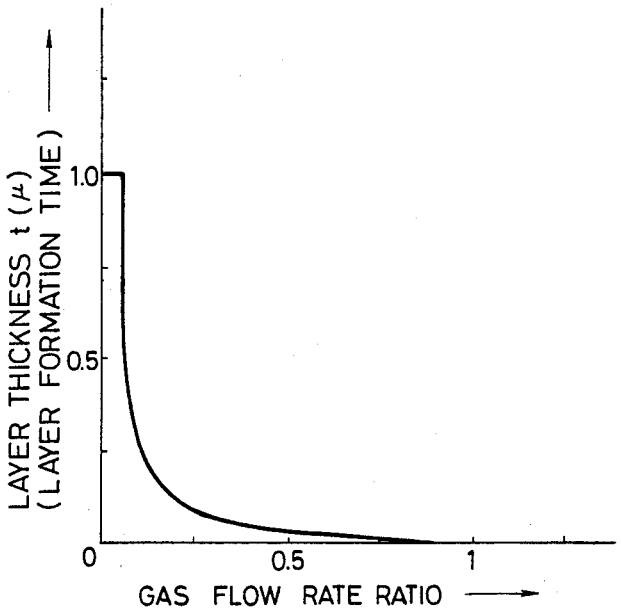

By the preparation device as shown in FIG. 12, layers were formed by changing the gas flow rate ratio of $GeH_4$/He gas to $SiH_4$/He gas along with the lapse of time for forming the layer under the condition of Table A-5 following the changing curve of the gas flow rate ratio as shown in FIG. 17 and other conditions were the same as in Example 1. Thereby, an electrophotographic image forming member was proudced.

Using the resulting image forming member, image formation was effected on a transfer paper according to the same procedure and under the same conditions as in Example 1, whereby a very clear image quality was obtained.

EXAMPLE 6

Figure 18:
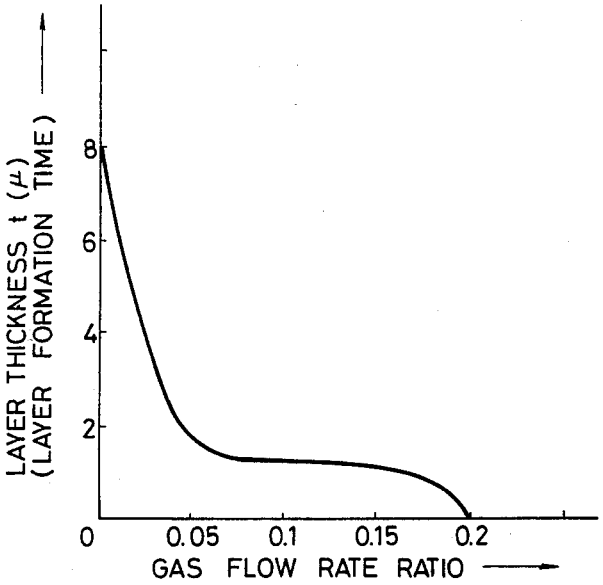

By the preparation device as shown in FIG. 12, layers were formed by changing the gas flow rate ratio of $GeH_4$/He gas to $SiH_4$/He gas along with the lapse of time for forming the layer under the condition of Table A-6 following the changing curve of the gas flow rate ratio as shown in FIG. 18 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 7

Figure 19:
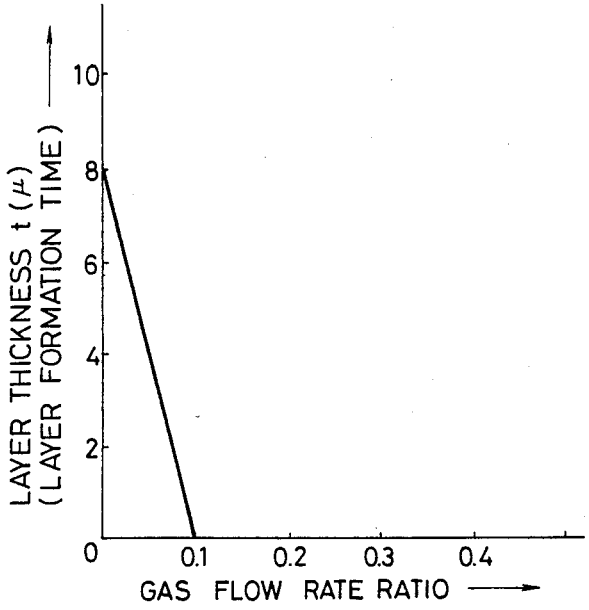

By the preparation device as shown in FIG. 12, layers were formed by changing the gas flow rate ratio of $GeH_4$/He gas to $SiH_4$/He gas along with the lapse of time for forming the layer under the condition of Table A-7 following the changing curve of the gas flow rate ratio as shown in FIG. 19 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 8

Layers were formed under the same conditions as Example 1 except that $Si_2H_6$/He gas was used in place of $SiH_4$/He gas used in Example 1 and that the operating condition was changed to that as shown in Table A-8. Thereby, an electrophotographic image forming member was produced.

Using the resulting image forming member, image formation was effected on the transfer paper according to the same procedure and under the same conditions as in Example 1, whereby a very clear image quality was obtained.

EXAMPLE 9

Layers were formed under the same conditions as Example 1 except that $SiF_4$/He gas was used in place of $SiH_4$/He gas used in Example 1 and that the operating condition was changed to that as shown in Table A-9. Thereby, an electrophotographic image forming member was produced.

Using the resulting image forming member, image formation was effected on the transfer paper according to the same procedure and under the same conditions as in Example 1, whereby a very clear image quality was obtained.

EXAMPLE 10

Layers were formed under the same conditions as Example 1 except that ($SiH_4$/He+$SiF_4$/He gas was used in place of $SiH_4$/He gas used in Example 1 and that the operating condition was changed to that as shown in Table A-10. Thereby, an electrophotographic image forming member was produced.

Using the resulting image forming member, image formation was effected on the transfer paper according to the same procedure and under the same conditions as in Example 1, whereby a very clear image quality was obtained.

EXAMPLE 11

Electrophotographic image forming members were produced under the same conditions as in Examples 1–10 except that preparation condition of the second layer in Examples 1–10 were changed as shown in Table A-11.

Using the resulting image forming members, image formation was effected on the transfer paper according to the same procedure and under the same conditions as in Example 1, whereby the results as shown in Table A-11A were obtained.

EXAMPLE 12

Electrophotographic image forming members were produced under the same conditions as in Examples 1–10 except that preparation condition of the second layer in Examples 1–10 were changed as shown in Table A-12.

Using the resulting image forming members, image formation was effected on the transfer paper according to the same procedure and under the same conditions as in Example 1, whereby the results as shown in Table A-12A were obtained.

EXAMPLE 13

Figure 20:
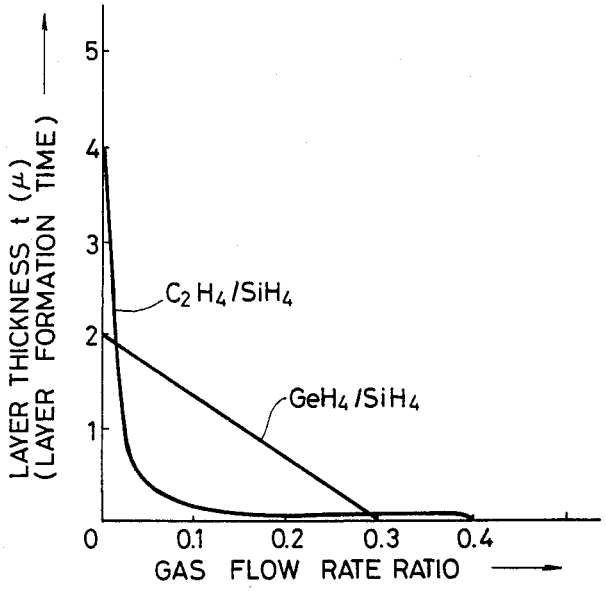

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table A-13 following the changing curve of the gas flow rate ratio as shown in FIG. 20 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 14

Figure 21:
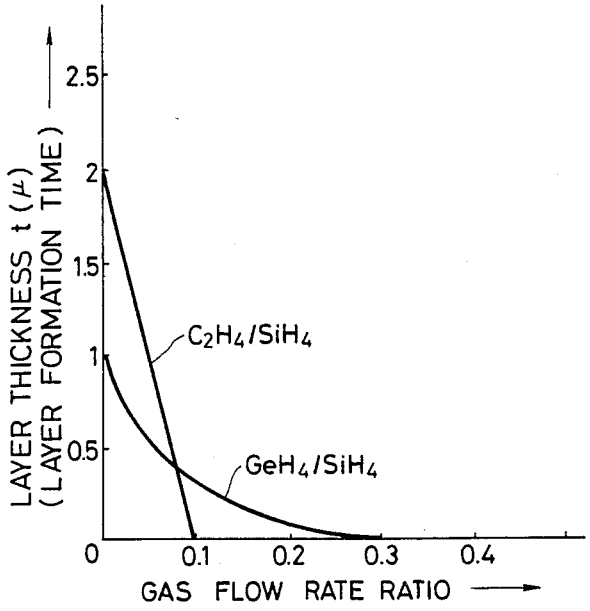

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table A-14 following the changing curve of the gas flow rate ratio as shown in FIG. 21 and other conditions were the same as in Example 1. Thereby, an electrophotographic image forming member was produced.

Using the resulting image forming member, image formation was effected on a transfer paper according to the same procedure and under the same conditions as in Example 1, whereby a very clear image quality was obtained.

EXAMPLE 15

Toner images were formed under the same conditions for a toner image formation as in Example 1 except that electrostatic images were formed by using GaAs type semiconductor laser (10 mW) of 810 nm in place of a tungsten lamp used in Examples 1–10. The electrophotographic image forming members produced under the same conditions as in Examples 1–10 were evaluated as to quality of the transferred toner images. The images were clear images of high quality excellent in resolution with good gradation reproducibility.

The common layer forming conditions in Examples 1–15 are as follows.

Substrate temperature:

Layer containing germanium atom (Ge) . . . about 200° C.

Layer not containing germanium atom (Ge) . . . about 250° C.

Discharge frequency: 13.56 MHz

Inner pressure in reaction chamber upon reaction: 0.3 Torr

EXAMPLE 16

Figure 22:
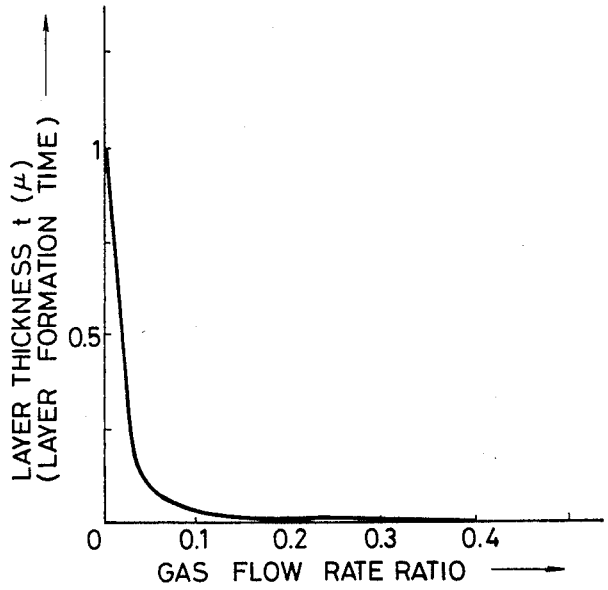

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table B-1 following the changing curve of the gas flow rate ratio as shown in FIG. 22, and thereby, an electrophotographic image forming member was produced.

The resulting image forming member was set in an experimental device for charging and exposure, and corona charging was effected at ⊖5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖5.0 KV, there was obtained a clear image of high density excellent in resolution with good gradation reproducibility.

EXAMPLE 17

Figure 23:
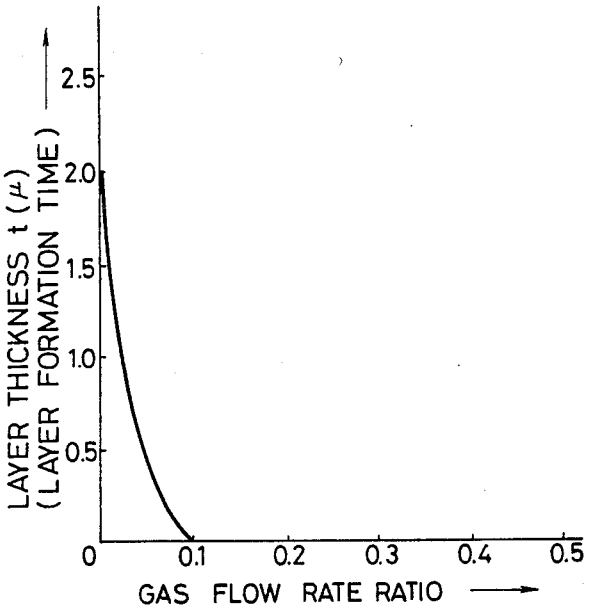

By the preparation device as shown in FIG. 12, layers were formed by changing the gas flow rate ratio of $GeH_4$/He gas to $SiH_4$/He gas along with the lapse of time for forming the layer under the condition of Table B-2 following the changing curve of the gas flow rate ratio as shown in FIG. 23 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtained.

EXAMPLE 18

Figure 24:
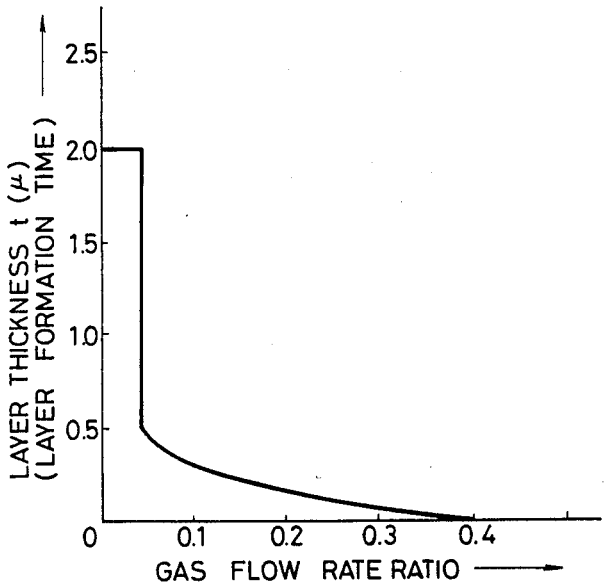

By the preparation device as shown in FIG. 12, layers were formed by changing the gas flow rate ratio of $GeH_4$/He gas to $SiH_4$/He gas along with the lapse of time for forming the layer under the condition of Table B-3 following the changing curve of the gas flow rate ratio as shown in FIG. 24 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtained.

EXAMPLE 19

Figure 25:
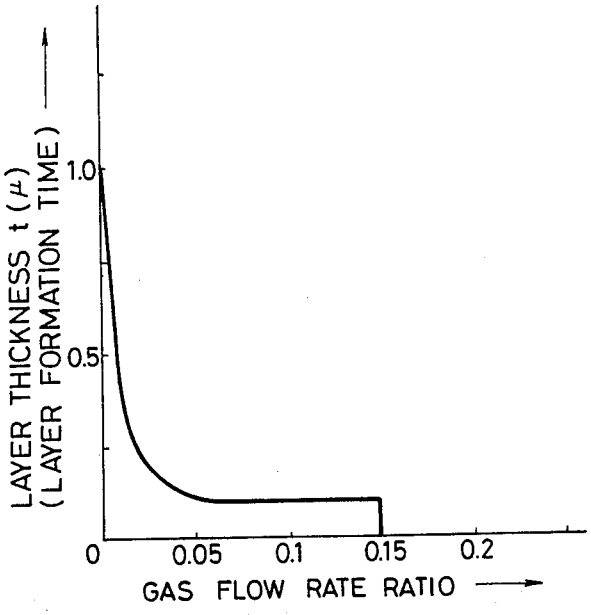

By the preparation device as shown in FIG. 12, layers were formed by changing the gas flow rate ratio of $GeH_4$/He gas to $SiH_4$/He gas along with the lapse or time for forming the layer under the condition of Table B-4 following the changing curve of the gas flow rate ratio as shown in FIG. 25 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtained.

EXAMPLE 20

Figure 26:
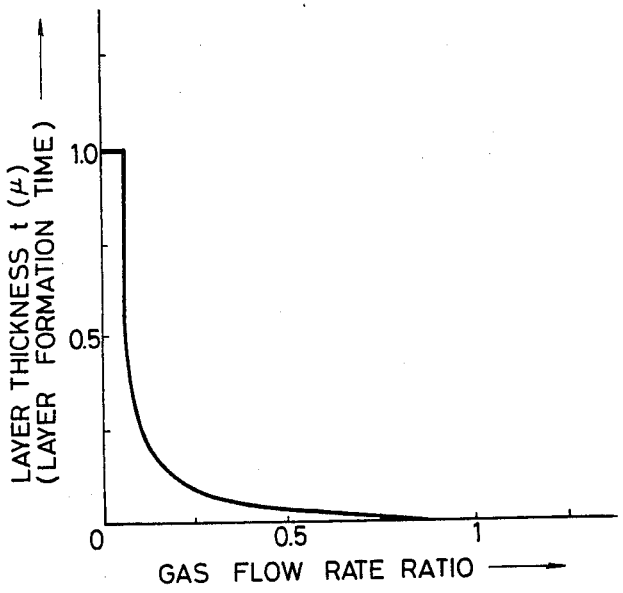

By the preparation device as shown in FIG. 12, layers were formed by changing the gas flow rate ratio of $GeH_4$/He gas to $SiH_4$/He gas along with the lapse of time for forming the layer under the condition of Table B-5 following the changing curve of the gas flow rate ratio as shown in FIG. 26 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtianed.

EXAMPLE 21

Figure 27:
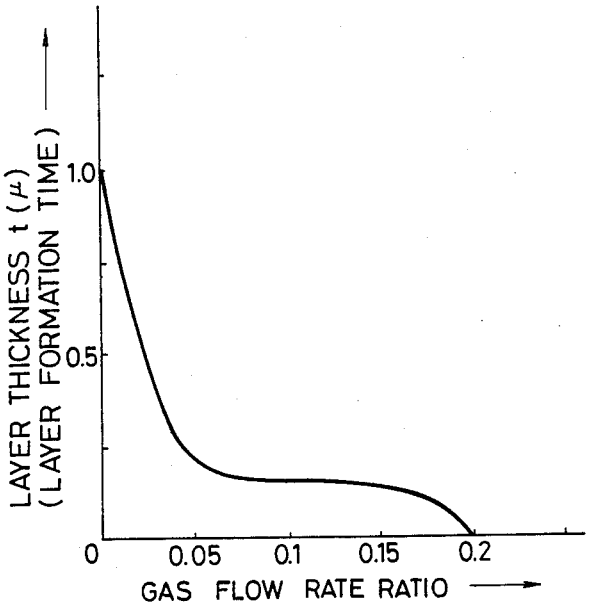

By the preparation device as shown in FIG. 12, layers were formed by changing the gas flow rate ratio of $GeH_4$/He gas to $SiH_4$/He gas along with the lapse of time for forming the layer under the condition of Table B-6 following the changing curve of the gas flow rate ratio as shown in FIG. 27 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtained.

EXAMPLE 22

Figure 28:
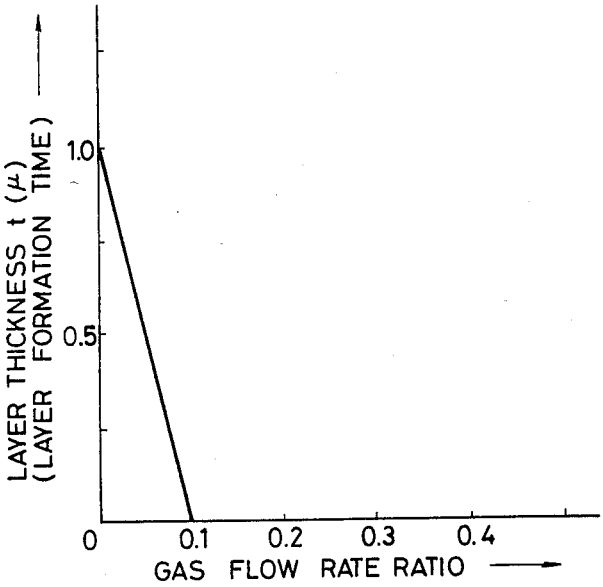

By the preparation device as shown in FIG. 12, layers were formed by changing the gas flow rate ratio of $GeH_4$/He gas to $SiH_4$/He gas along with the lapse of time for forming the layer under the condition of Table B-7 following the changing curve of the gas flow rate ratio as shown in FIG. 28 and other conditions were the same as in Example 16. Thereby, an electrophotographic image forming member was produced.

Using the resulting image forming member, image formation was effected on a transfer paper according to the same procedure and under the same conditions as in Example 16, whereby a very clear image quality was obtained.

EXAMPLE 23

Layers were formed under the same conditions as Example 16 except that $Si_2H_6$/He gas was used in place of $SiH_4$/He gas used in Example 16 and that the operating condition was changed to that as shown in Table B-8. Thereby, an electrophotographic image forming member was produced.

Using the resulting image forming member, image formation was effected on the transfer paper according to the same procedure and under the same conditions as in Example 16, whereby a very clear image quality was obtained.

EXAMPLE 24

Layers were formed under the same conditions as Example 16 except that $SiF_4$/He gas was used in place of $SiH_4$/He gas used in Example 16 and that the operating condition was changed to that as shown in Table B-9. Thereby, an electrophotographic image forming member was produced.

Using the resulting image forming member, image formation was effected on the transfer paper according to the same procedure and under the same conditions as in Example 16, whereby a very clear image quality was obtained.

EXAMPLE 25

Layers were formed under the same conditions as Example 16 except that ($SiH_4$/He+$SiF_4$/He gas was used in place of $SiH_4$/He gas used in Example 16 and that the operating condition was changed to that as shown in Table B-10. Thereby, an electrophotographic image forming member was produced.

Using the resulting image forming member, image formation was effected on the transfer paper according to the same procedure and under the same conditions as in Example 16, whereby a very clear image quality was obtained.

EXAMPLE 26

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table B-11 following the changing curve of the gas flow rate ratio as shown in FIG. 22, and thereby, an electrophotographic image forming member was produced.

The resulting image forming member was set in an experimental device for charging and exposure, and corona charging was effected at ⊖5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖ 5.0 KV, there was obtained a clear image of high density excellent in resolution with good gradation reproducibility.

EXAMPLE 27

Electrophotographic image forming members (Sample Nos. 1201–1208) were produced under the same conditions as in Example 26 except that the flow rate ratio of $B_2H_6$ to ($SiH_4$+$GeH_4$) upon formation of the first layer in Example 26 and the flow rate ratio of $B_2H_6$ to $SiH_4$ upon formation of the second layer in Example 26 were changed as shown in Table B-12.

Using the resulting image forming members, image formation was effected on the transfer paper according to the same procedure and under the same conditions as in Example 26, whereby the results as shown in Table B-12 were obtained.

EXAMPLE 28

Electrophotographic image forming members (Sample Nos. 1301–1310, 1401–1410) were produced under the same conditions as in Examples 16–25 except that preparation conditions of second layer in Examples 16–25 were changed as shown in Table B-13 and B-14.

Using the resulting image forming members, image formation was effected on the transfer paper according to the same procedure and under the same conditions as in Example 16, whereby the results as shown in Table B-13A and B-14A were obtained.

EXAMPLE 29

Toner images were formed under the same conditions for a toner image formation as in Example 16 except that electrostatic images were formed by using GaAs type semiconductor laser (10 mW) of 810 nm in place of a tungsten lamp used in Example 16. The electrophotographic image forming members produced under the same conditions as in Example 16 were evaluated as to quality of the transferred toner images. The images were clear images of high quality excellent in resolution with good gradation reproducibility.

The common layer forming conditions in Examples 16–29 are as follows.

Substrate temperature:

Layer containing germanium atom (Ge) . . . about 200° C.

Layer not containing germanium atom (Ge) . . . about 250° C.

Discharge frequency: 13.56 MHz

Inner pressure in reaction chamber upon reaction: 0.3 Torr

EXAMPLE 30

Figure 29:
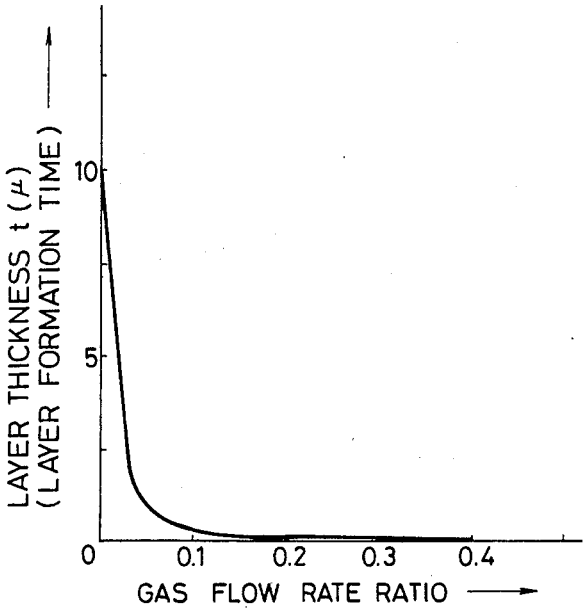

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table C-1 following the changing curve of the gas flow rate ratio as shown in FIG. 29, and thereby, an electrophotographic image forming member was produced.

The resulting image forming member was set in an experimental device for charging and exposure, and corona charging was effected at ⊖ 5.0 KV for 0.3 second, followed immediately by irradiation of a light image from a tungsten lamp source at a dose of 2 lux. sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖ 5.0 KV, there was obtained a clear image of high density excellent in resolution with good gradation reproducibility.

EXAMPLE 31

Figure 30:
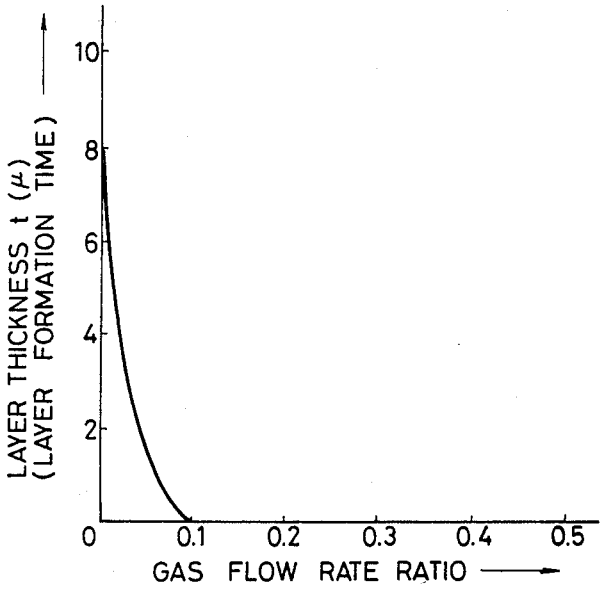

By the preparation device as shown in FIG. 12, layers were formed by changing the gas flow rate ratio of $GeH_4$/He gas to $SiH_4$/He gas along with the lapse of time for forming the layer under the condition of Table C-2 following the changing curve of the gas flow rate ratio as shown in FIG. 30 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 32

Figure 31:
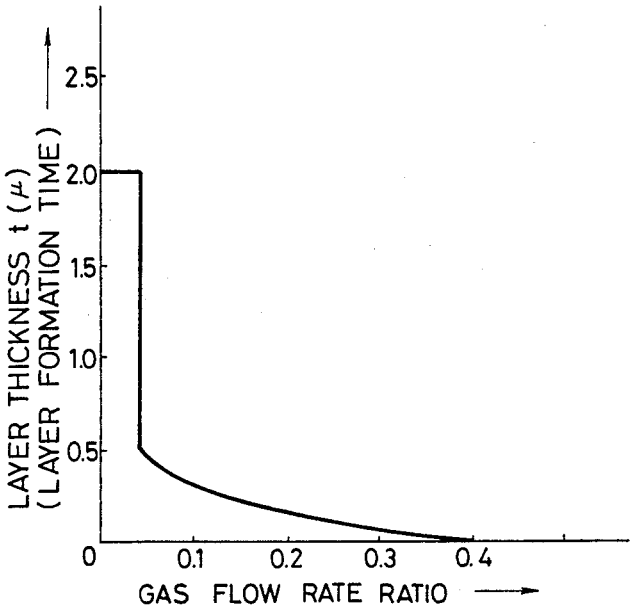

By the preparation device as shown in FIG. 12, layers were formed by changing the gas flow rate ratio of $GeH_4$/He gas to $SiH_4$/He gas along with the lapse of time for forming the layer under the condition of Table C-3 following the changing curve of the gas flow rate ratio as shown in FIG. 31 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 33

Figure 32:
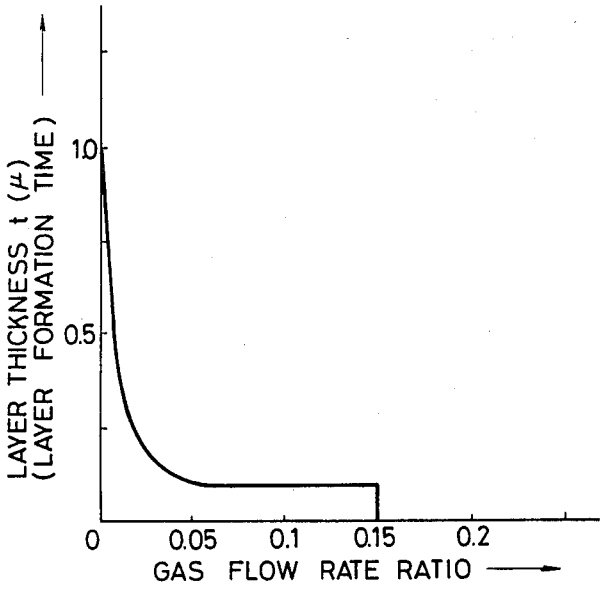

By the preparation device as shown in FIG. 12, layers were formed by changing the gas flow rate ratio of $GeH_4$/He gas to $SiH_4$/He gas along with the lapse of time for forming the layer under the condition of Table C-4 following the changing curve of the gas flow rate ratio as shown in FIG. 32 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 34

Figure 33:
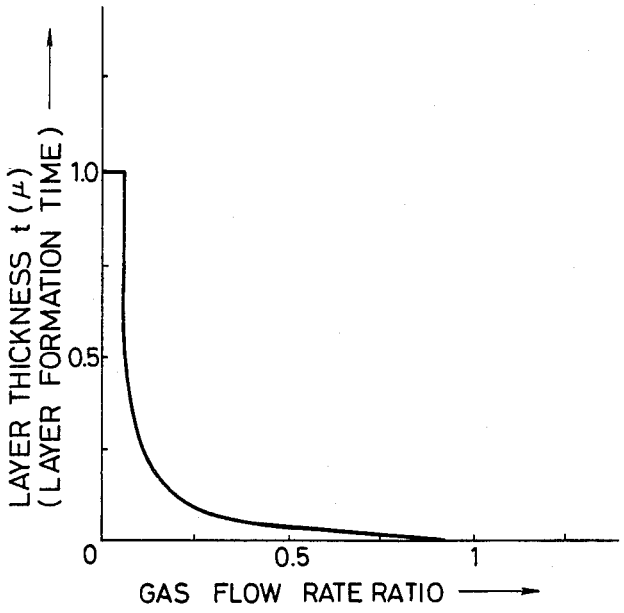

By the preparation device as shown in FIG. 12, layers were formed by changing the gas flow rate ratio of $GeH_4$/He gas to $SiH_4$/He gas along with the lapse of time for forming the layer under the condition of Table C-5 following the changing curve of the gas flow rate ratio as shown in FIG. 33 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 35

Figure 34:
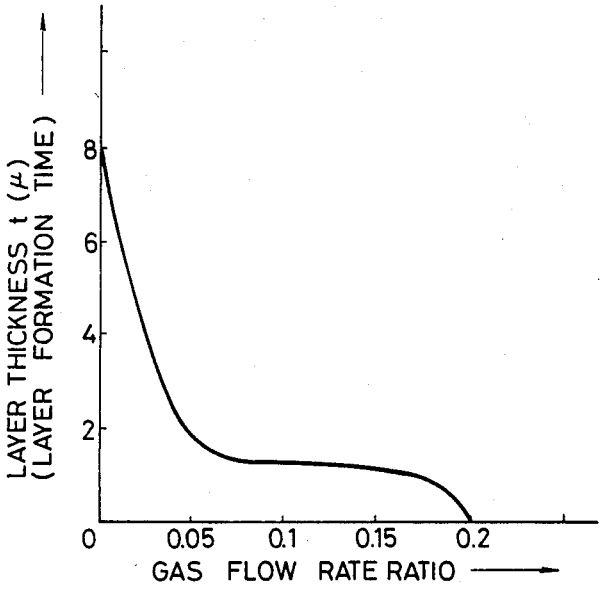

By the preparation device as shown in FIG. 12, layers were formed by changing the gas flow rate ratio of $GeH_4$/He gas to $SiH_4$/He gas along with the lapse of time for forming the layer under the condition of Table C-6 following the changing curve of the gas flow rate ratio as shown in FIG. 34 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 36

Figure 35:
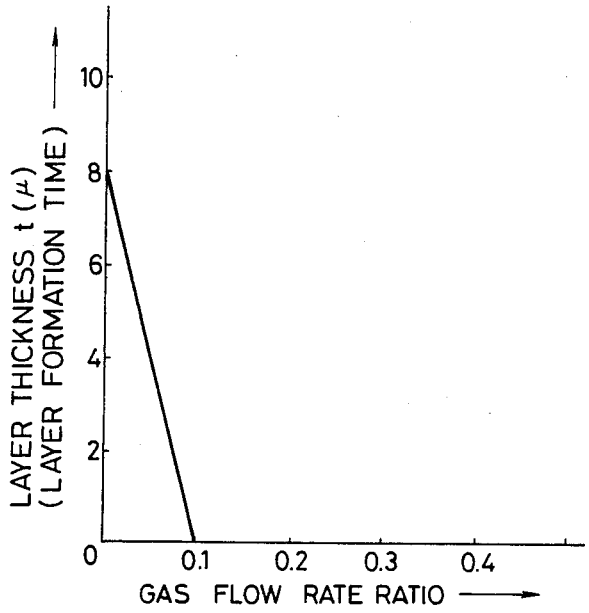

By the preparation device as shown in FIG. 12, layers were formed by changing the gas flow rate ratio of $GeH_4$/He gas to $SiH_4$/He gas along with the lapse of time for forming the layer under the condition of Table C-7 following the changing curve of the gas flow rate ratio as shown in FIG. 35 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 37

Layers were formed under the same conditions as Example 30 except that $SiF_4$/He gas was used in place of $SiH_4$/He gas used in Example 30 and that the operating condition was changed to that as shown in Table C-8. Thereby, an electrophotographic image forming member was produced.

Using the resulting image forming member, image formation was effected on the transfer paper according to the same procedure and under the same conditions as in Example 30, whereby a very clear image quality was obtained.

EXAMPLE 38

Layers were formed under the same conditions as Example 30 except that ($SiF_4$/He gas was used in place of $SiH_4$/He gas used in Example 30 and that the operating condition was changed to that as shown in Table C-9. Thereby, an electrophotographic image forming member was produced.

Using the resulting image forming member, image formation was effected on the transfer paper according to the same procedure and under the same conditions as in Example 30, whereby a very clear image quality was obtained.

EXAMPLE 39

Layers were formed under the same conditions as Example 30 except that ($SiH_4$/He+$SiF_4$/He) gas was used in place of $SiH_4$/He gas used in Example 30 and that the operating condition was changed to that as shown in Table C-10. Thereby, an electrophotographic image forming member was produced.

Using the resulting image forming member, image formation was effected on the transfer paper according to the same procedure and under the same conditions as in Example 30, whereby a very clear image quality was obtained.

EXAMPLE 40

Electrophotographic image forming members were produced under the same conditions as in Examples 30–39 except that preparation condition of the third layer in Examples 30–39 were changed as shown in Table C-11.

Using the resulting image forming members, image formation was effected on the transfer paper according to the same procedure and under the same conditions as in Example 30, whereby the results as shown in Table C-11A were obtained.

EXAMPLE 41

Electrophotographic image forming members were produced under the same conditions as in Examples 30–39 except that preparation condition of the third layer in Examples 30–39 were changed as shown in Table C-12.

Using the resulting image forming members, image formation was effected on the transfer paper according to the same procedure and under the same conditions as in Example 30, whereby the results as shown in Table C-12A were obtained.

EXAMPLE 42

Figure 36:
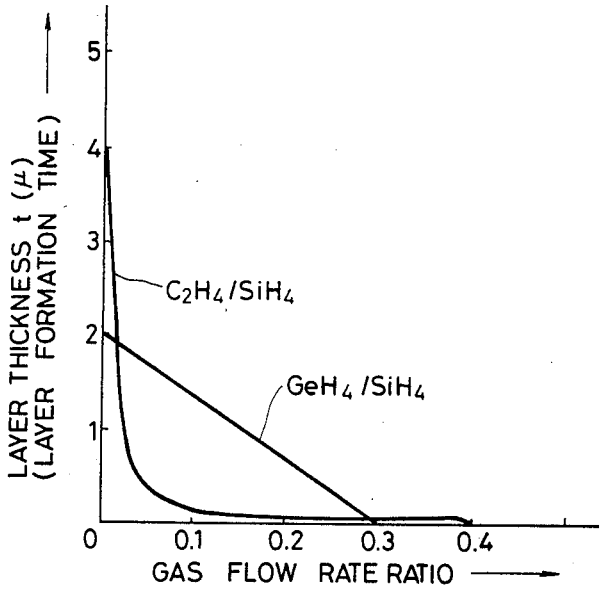

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table C-13 following the changing curve of the gas flow rate ratio as shown in FIG. 36 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 43

Figure 37:
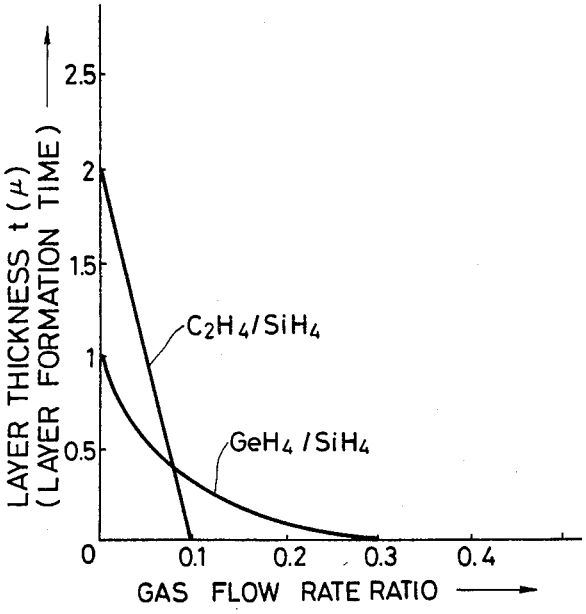

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table C-14 following the changing curve of the gas flow rate ratio as shown in FIG. 37 and other conditions were the same as in Example 30. Thereby, an electrophotographic image forming member was produced.

Using the resulting image forming member, image formation was effected on a transfer paper according to the same procedure and under the same conditions as in Example 30, whereby a very clear image quality was obtained.

EXAMPLE 44

Toner images were formed under the same conditions for a toner image formation as in Example 30 except that electrostatic images were formed by using GaAs type semiconductor layer (10 mW) of 810 nm in place of a tungsten lamp used in Examples 30–39. The electrophotographic image forming members produced under the same conditions as in Examples 30–39 were evaluated as to quality of the transferred toner images. The images were clear images of high quality excellent in resolution with good gradation reproducibility.

EXAMPLE 45

Electrophotographic image forming members (Sample Nos. 12-201-12-208, 12-301-12-308, . . . , 12-1001-12-1008; 72 Samples) were produced under the same conditions and according to the same procedure as in Examples 31–39 except that the conditions for formation of layer (II) were changed to those as shown in Table C-15.

The resulting electrophotographic image forming members were set individually in a reproduction device and then corona charging was effected at ⊖5 KV for 0.2 second, followed immediately by irradiation of a light image from a tungsten lamp source at a dose of 1.0 lux. sec. A latent image was developed with ⊕ charged developer (containing toner and carrier) and transferred to a plain paper. The transferred image was very good. The toner remaining on the electrophotographic image forming member without being transferred was scraped by an elastic blade. The above-described series of process steps were repeated 100,000 times or more. No deterioration in the image quality could be observed of any stage of the process steps. Evaluation for the overall image quality and durability for repetition of copying of the samples were shown in Table C-15A.

EXAMPLE 46

Each of image forming members was produced according to the same procedure as in Example 30 except that, upon formation of layer (II), the mixing ratio of Ar to $NH_3$, the target area ratio of silicon wafer to silicon nitride were changed, and the content ratio of silicon atom to nitrogen atom in the layer (II) was changed. The resulting image forming members were evaluated for the image quality after about 50,000 repetitions of image formation, development and cleaning as described in Example 30. Whereby the results as shown in Table C-16 were obtained.

EXAMPLE 47

Each of image forming members was produced according to the same procedure as in Example 30 except that, upon formation of layer (II), the flow rate ratio of $SiH_4$ gas to $NH_3$ gas was changed and the content ratio of silicon atom to nitrogen atom in the layer (II) was changed. The resulting image forming members were evaluated for the image quality after about 50,000 repetitions of process up to a transfer as described in Example 30. Whereby the results as shown in Table C-17 were obtained.

EXAMPLE 48

Each of image forming members was produced according to the same procedure as in Example 30 except that, upon formation of layer (II), the flow rate ratio of $SiH_4$ gas: $SiF_4$ gas: $NH_3$ gas was changed and the content ratio of silicon atom to nitrogen atom in the layer (II) was changed. The resulting image forming members were evaluated for the image quality after about 50,000 repetitions of image formation, development and cleaning as described in Example 30. Whereby the results as shown in Table C-18 were obtained.

EXAMPLE 49

Each of image forming members was produced according to the same procedure as in Example 30 except that the layer thickness of layer (II) was changed. Image formation, development and cleaning as described in Example 30 were repeated. Whereby the results as shown in Table C-19 were obtained.

The common layer forming conditions in Examples 30–49 are as follows.

Substrate temperature:

Layer containing germanium atom (Ge) . . . about 200° C.

Layer not containing germanium atom (Ge) . . . about 250° C.

Discharge frequency: 13.56MHz

Inner pressure in reaction chamber upon reaction: 0.3 Torr

EXAMPLE 50

Figure 38:
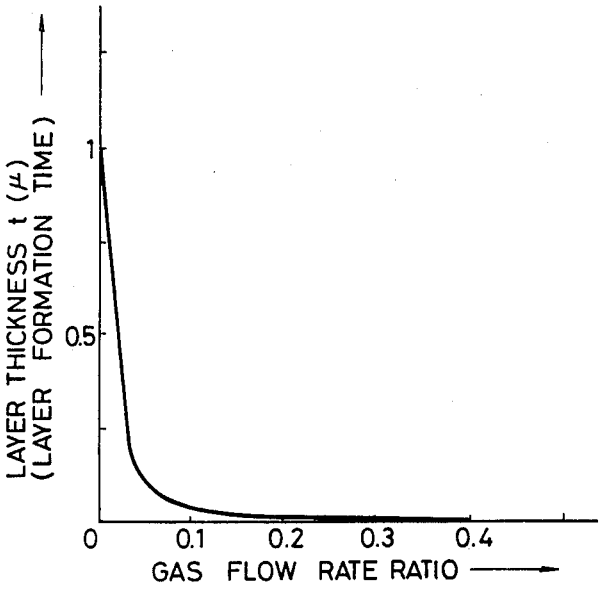

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table D-1 following the changing curve of the gas flow rate ratio as shown in FIG. 38, and thereby, an electrophotographic image forming member was produced.

The resulting image forming member was set in an experimental device for charging and exposure, and corona charging was effected at ⊖ 5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖ 5.0 KV, there was obtained a clear image of high density excellent in resolution with good gradation reproducibility.

EXAMPLE 51

Figure 39:
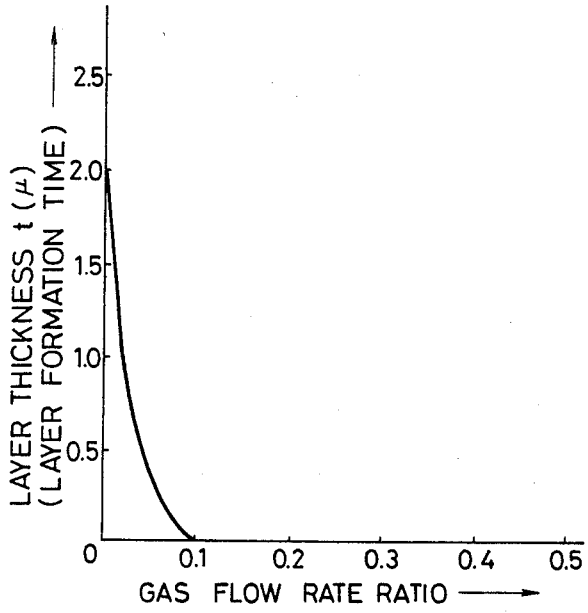

By the preparation device as shown in FIG. 12, layers were formed by changing the gas flow rate ratio of $GeH_4$/He gas to $SiH_4$/He gas along with the lapse of time for forming the layer under the condition of Table D-2 following the changing curve of the gas flow rate ratio as shown in FIG. 39 and other conditions were the same as in Example 50. Thereby, an electrophotographic image forming member was produced.

Using the resulting image forming member, image formation was effected on a transfer paper according to the same procedure and under the same conditions as in Example 50, whereby a very claer image quality was obtained.

EXAMPLE 52

Figure 40:
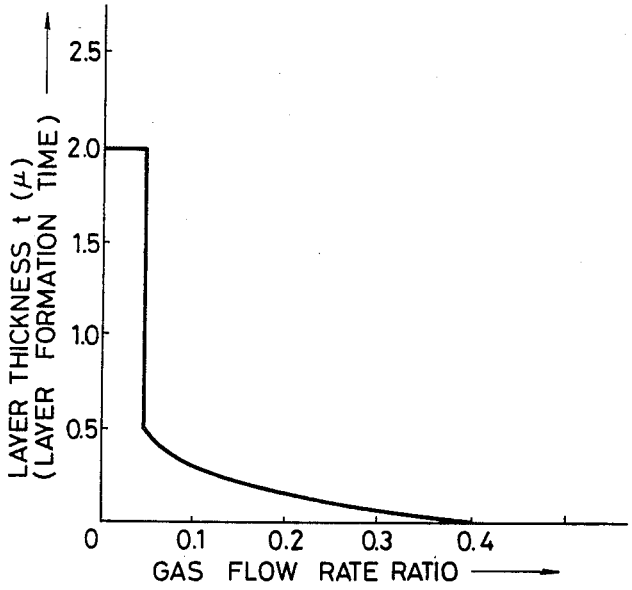

By the preparation device as shown in FIG. 12, layers were formed by changing the gas flow rate ratio of $GeH_4$/He gas to $SiH_4$/He gas along with the lapse of time for forming the layer under the condition of Table D-3 following the changing curve of the gas flow rate ratio as shown in FIG. 40 and other conditions were the same as in Example 50. Thereby, an electrophotographic image forming member was produced.

Using the resulting image forming member, image formation was effected on a transfer paper according to the same procedure and under the same conditions as in Example 50, whereby a very clear image quality was obtained.

EXAMPLE 53

Figure 41:
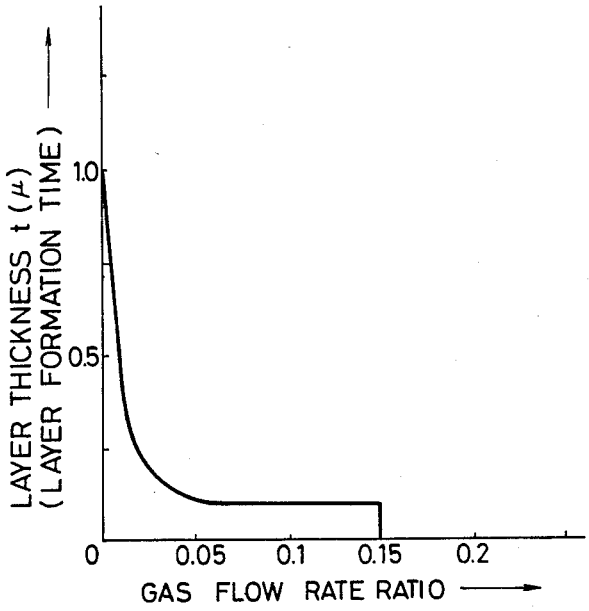

By the preparation device as shown in FIG. 12, layers were formed by changing the gas flow rate ratio of $GeH_4$/He gas to $SiH_4$/He gas along with the lapse of time for forming the layer under the condition of Table D-4 following the changing curve of the gas flow rate ratio as shown in FIG. 41 and other conditions were the same as in Example 50. Thereby, an electrophotographic image forming member was produced.

Using the resulting image forming member, image formation was effected on a transfer paper according to the same procedure and under the same conditions as in Example 50, whereby a very clear image quality was obtained.

EXAMPLE 54

Figure 42:
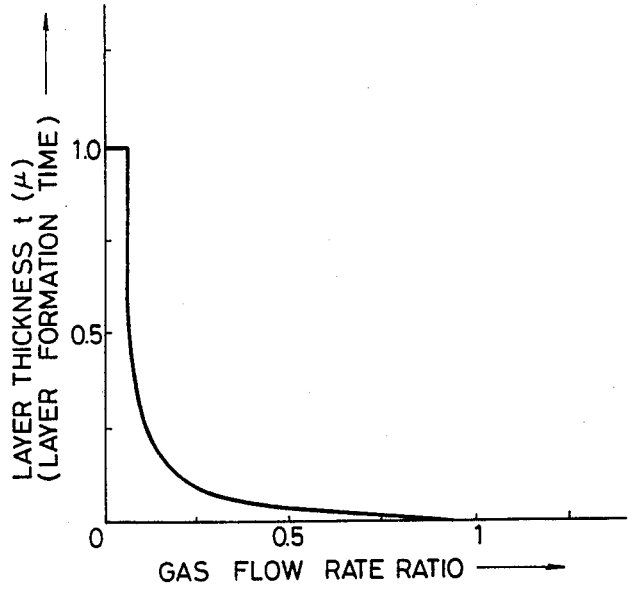

By the preparation device as shown in FIG. 12, layers were formed by changing the gas flow rate ratio of $GeH_4$/He gas to $SiH_4$/He gas along with the lapse of time for forming the layer under the condition of Table D-5 following the changing curve of the gas flow rate ratio as shown in FIG. 42 and other conditions were the same as in Example 50. Thereby, an electrophotographic image forming member was produced.

Using the resulting image forming member, image formation was effected on a transfer paper according to the same procedure and under the same conditions as in Example 50, whereby a very clear image quality was obtained.

EXAMPLE 55

Figure 43:
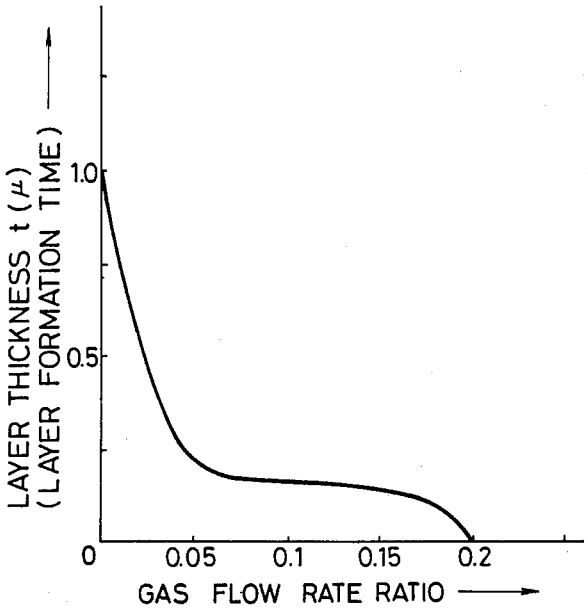

By the preparation device as shown in FIG. 12, layers were formed by changing the gas flow rate ratio of $GeH_4$/He gas to $SiH_4$/He gas along with the lapse of time for forming the layer under the condition of Table D-6 following the changing curve of the gas flow rate ratio as shown in FIG. 43 and other conditions were the same as in Example 50. Thereby, an electrophotographic image forming member was produced.

Using the resulting image forming member, image formation was effected on a transfer paper according to the same procedure and under the same conditions as in Example 50, whereby a very clear image quality was obtained.

EXAMPLE 56

Figure 44:
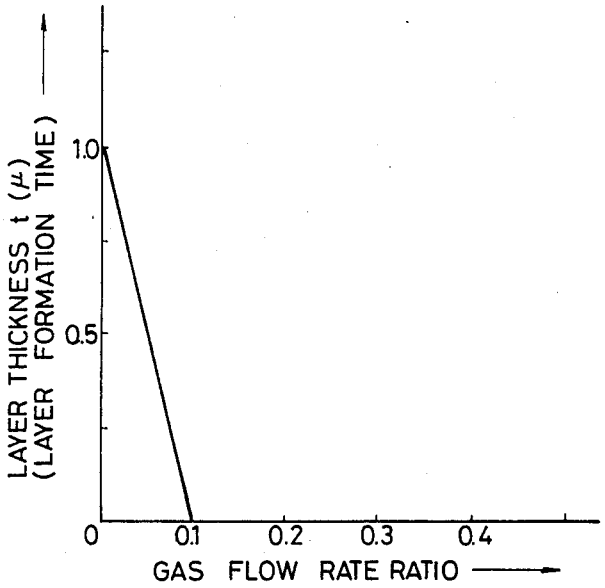

By the preparation device as shown in FIG. 12, layers were formed by changing the gas flow rate ratio of $GeH_4$/He gas to $SiH_4$/He gas along with the lapse of time for forming the layer under the condition of Table D-7 following the changing curve of the gas flow rate ratio as shown in FIG. 44 and other conditions were the same as in Example 50. Thereby, an electrophotographic image forming member was produced.

Using the resulting image forming member, image formation was effected on a transfer paper according to the same procedure and under the same conditions as in Example 50, whereby a very clear image quality was obtained.

EXAMPLE 57

Layers were formed under the same conditions as Example 50 except that $Si_2H_6$/He gas was used in place of $SiH_4$/He gas used in Example 50 and that the operating condition was changed to that as shown in Table D-8. Thereby, an electrophotographic image forming member was produced.

Using the resulting image forming member, image formation was effected on the transfer paper according to the same procedure and under the same conditions as in Example 50, whereby a very clear image quality was obtained.

EXAMPLE 58

Layers were formed under the same conditions as Example 50 except that $SiF_4$/He gas was used in place of $SiH_4$/He gas used in Example 50 and that the operating condition was changed to that as shown in Table D-9. Thereby, an electrophotographic image forming member was produced.

Using the resulting image forming member, image formation was effected on the transfer paper according to the same procedure and under the same conditions as in Example 50, whereby a very clear image quality was obtained.

EXAMPLE 59

Layers were formed under the same conditions as Example 50 except that ($SiH_4$/He+$SiF_4$/He) gas was used in place of $SiH_4$/He gas used in Example 50 and that the operating condition was changed to that as shown in Table D-10. Thereby, an electrophotographic image forming member was produced.

Using the resulting image forming member, image formation was effected on the transfer paper according to the same procedure and under the same conditions as in Example 50, whereby a very clear image quality was obtained.

EXAMPLE 60

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table D-11 following the changing curve of the gas flow rate ratio as shown in FIG. 38, and thereby, an electrophotographic image forming member was produced.

The resulting image forming member was set in an experimental device for charging and exposure, and corona charging was effected at ⊖ 5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖ 5.0 KV, there was obtained a clear image of high density excellent in resolution with good gradation reproducibility.

EXAMPLE 61

Electrophotographic image forming members were produced under the same conditions as in Example 60 except that the flow rate ratio of $B_2H_6$ to ($SiH_4$+$GeH_4$) upon formation of the first layer in Example 60 and the flow rate ratio of $B_2H_6$ to $SiH_4$ upon formation of the second layer in Example 60 were changed as shown in Table D-12.

Using the resulting image forming members, image formation was effected on the transfer paper according to the same procedure and under the same conditions as in Example 60, whereby the results as shown in Table D-12 were obtained.

EXAMPLE 62

Electrophotographic image forming members (Sample Nos. 1301–1310, 1401–1410) were produced under the same conditions as in Examples 50–59 except that preparation conditions of second layer in Examples 50–59 were changed as shown in Table D-13 and D-14.

Using the resulting image forming members, image formation was effected on the transfer paper according to the same procedure and under the same conditions as in Example 50, whereby the results as shown in Table D-13A and D-14A were obtained.

EXAMPLE 63

Toner images were formed under the same conditions for a toner image formation as in Example 50 except that electrostatic images were formed by using GaAs type semiconductor laser (10 mW) of 810 nm in place of a tungsten lamp used in Example 50. The electrophotographic image forming members produced under the same conditions as in Example 50 were evaluated as to quality of the transferred toner images. The images were clear images of high quality excellent in resolution with good gradation reproducibility.

EXAMPLE 64

Electrophotographic image forming members (Sample Nos. 12-201–12-208, 12-301–12-308, . . . , 12-1001–12-1008; 72 Samples) were produced under the same conditions and according to the same procedure as in Examples 51–59 except that the conditions for formation of layer (II) were changed to those as shown in Table D-15.

The resulting electrophotographic image forming members were set individually in a reproduction device and then corona charging was effected at ⊖ 5 KV for 0.2 second, followed immediately by irradiation of a light image from a tungsten lamp source at a dose of 1.0 lux.sec. A latent image was developed with ⊕ charged developer (containing toner and carrier) and transferred to a plain paper. The transferred image was very good. The toner remaining on the electrophotographic image forming member without being transferred was scraped by an elastic blade. The above-described series of process steps were repeated 100,000 times or more. No deterioration in the image quality could be observed of any stage of the process steps. Evaluation for the overall image quality and durability for repetition of copying of the samples were shown in Table D-15 A.

EXAMPLE 65

Each of image forming members was produced according to the same procedure as in Example 50 except that, upon formation of layer (II), the mixing ratio of Ar to $NH_3$, the target area ratio of silicon wafer to silicon nitride were changed, and the content ratio of silicon atom to nitrogen atom in the layer (II) was changed. The resulting image forming members were evaluated for the image quality after about 50,000 repetitions of image formation, development and cleaning as described in Example 50. Whereby the results as shown in Table D-16 were obtained.

EXAMPLE 66

Each of image forming members was produced according to the same procedure as in Example 50 except that, upon formation of layer (II), the flow rate ratio of $SiH_4$ gas to $NH_3$ gas was changed and the content ratio of silicon atom to nitrogen atom in the layer (II) was changed. The resulting image forming members were evaluated for the image quality after about 50,000 repetitions of process up to a transfer as described in Example 50. Whereby the results as shown in Table D-17 were obtained.

EXAMPLE 67

Each of image forming members was produced according to the same procedure as in Example 50 except that, upon formation of layer (II), the flow rate ratio of $SiH_4$ gas: $SiF_4$ gas: $NH_3$ gas was changed and the content ratio of silicon atom to nitrogen atom in the layer (II) was changed. The resulting image forming members were evaluated for the image quality after about 50,000 repetitions of image formation, development and cleaning as described in Example 50. Whereby the results as shown in Table D-18 were obtained.

EXAMPLE 68

Each of image forming members was produced according to the same procedure as in Example 50 except that the layer thickness of layer (II) was changed. Image formation, development and cleaning as described in Example 50 were repeated. Whereby the results as shown in Table D-19 were obtained.

The common layer forming conditions in Examples 50–68 are as follows:

Substrate temperature:

Layer containing germanium atom (Ge) . . . about 200° C.

Layer not containing germanium atom (Ge) . . . about 250° C.

Discharge frequency: 13.56 MHz

Inner pressure in reaction chamber upon reaction: 0.3 Torr

EXAMPLE 69

Figure 45:
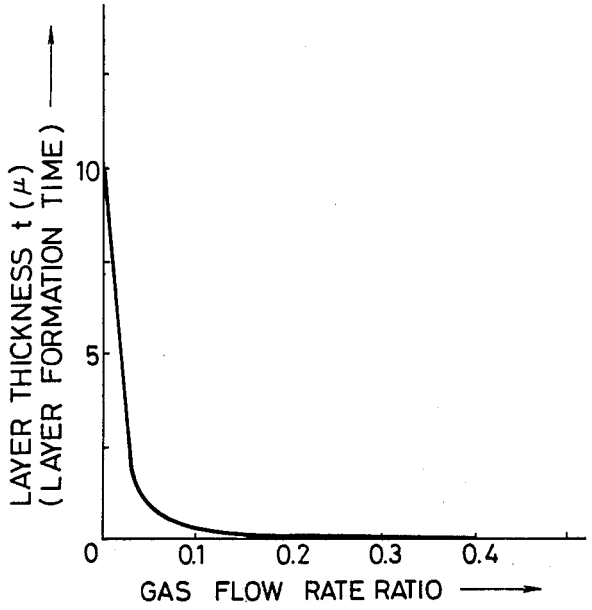

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table E-1 following the changing curve of the gas flow rate ratio as shown in FIG. 45, and thereby, an electrophotographic image forming member was produced.

The resulting image forming member was set in an experimental device for charging and exposure, and corona charging was effected at ⊖ 5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖ 5.0 KV, there was obtained a clear image of high density excellent in resolution with good gradation reproducibility.

EXAMPLE 70

Figure 46:
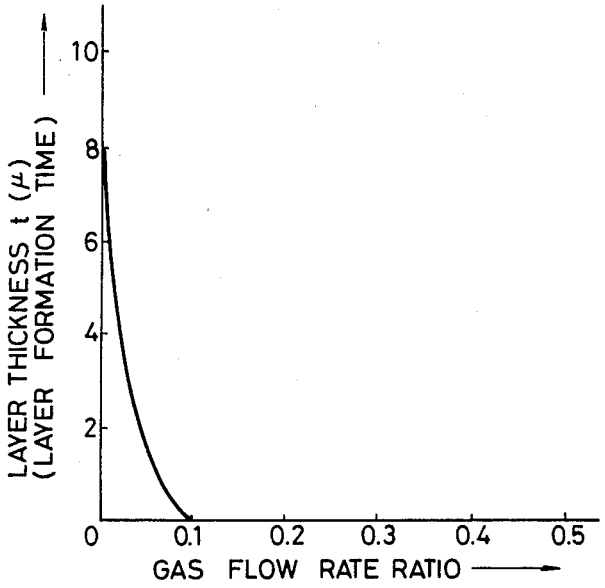

By the preparation device as shown in FIG. 12, layers were formed by changing the gas flow rate ratio of $GeH_4$/He gas to $SiH_4$/He gas along with the lapse of time for forming the layer under the condition of Table E-2 following the changing curve of the gas flow rate ratio as shown in FIG. 46 and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 71

Figure 47:
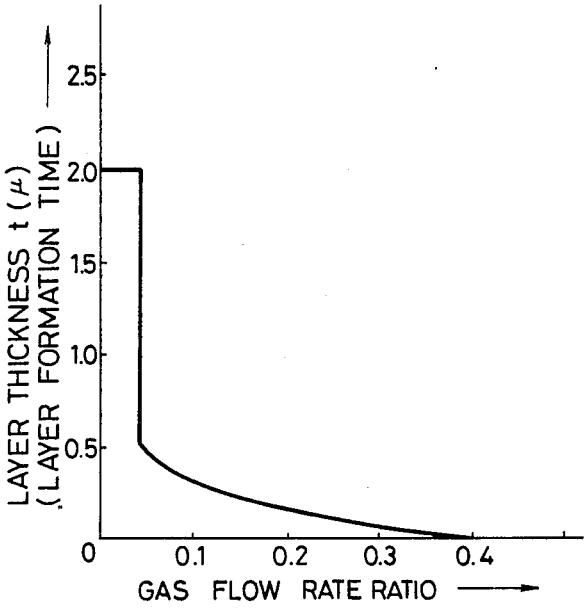

By the preparation device as shown in FIG. 12, layers were formed by changing the gas flow rate ratio of $GeH_4$/He gas to $SiH_4$/He gas along with the lapse of time for forming the layer under the condition of Table E-3 following the changing curve of the gas flow rate ratio as shown in FIG. 47, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 72

Figure 48:
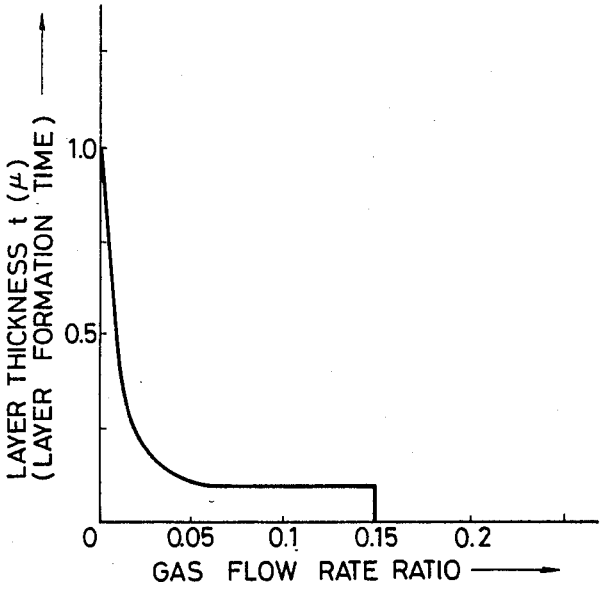

By the preparation device as shown in FIG. 12, layers were formed by changing the gas flow rate ratio of $GeH_4$/He gas to $SiH_4$/He gas along with the lapse of time for forming the layer under the condition of Table E-4 following the changing curve of the gas flow rate ratio as shown in FIG. 48, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 73

Figure 49:
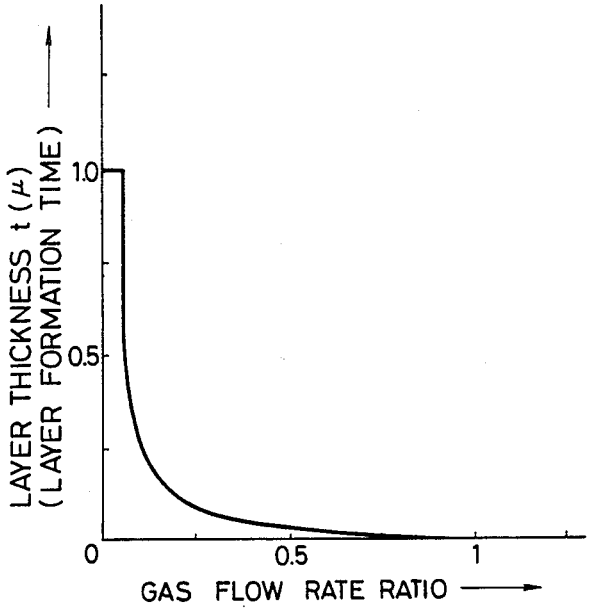

By the preparation device as shown in FIG. 12, layers were formed by changing the gas flow rate ratio of $GeH_4$/He gas to $SiH_4$/He gas along with the lapse of time for forming the layer under the condition of Table E-5 following the changing curve of the gas flow rate ratio as shown in FIG. 49, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 74

Figure 50:
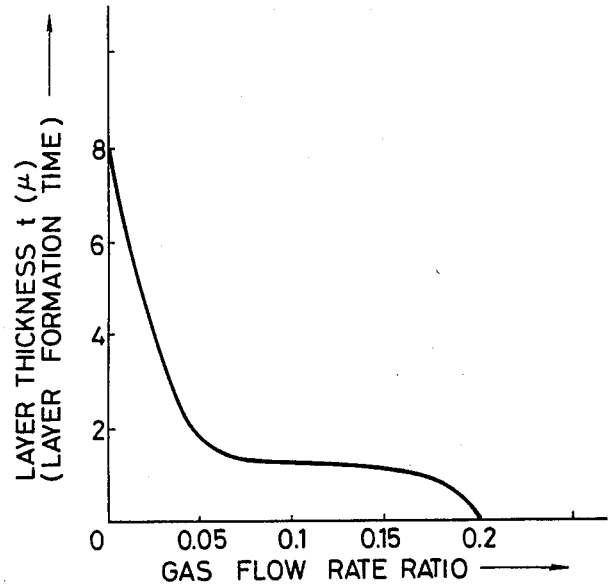

By the preparation device as shown in FIG. 12, layers were formed by changing the gas flow rate ratio of $GeH_4$/He gas to $SiH_4$/He gas along with the lapse of time for forming the layer under the condition of Table E-6 following the changing curve of the gas flow rate ratio as shown in FIG. 50, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 75

Figure 51:
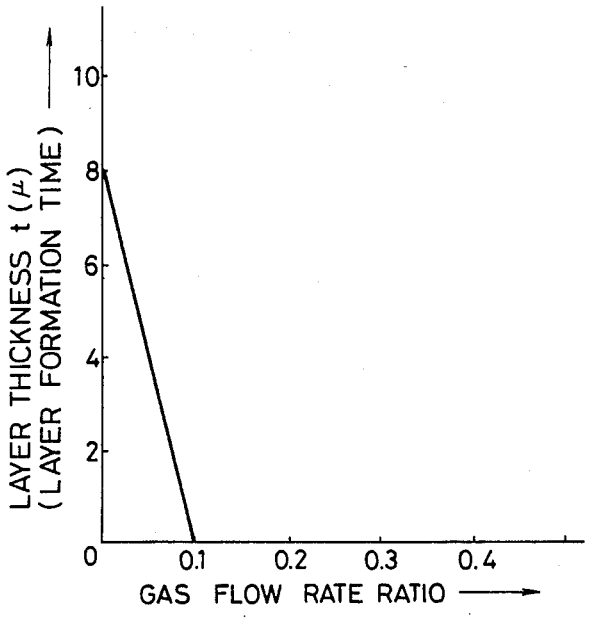

By the preparation device as shown in FIG. 12, layers were formed by changing the gas flow rate ratio of $GeH_4$/He gas to $SiH_4$/He gas along with the lapse of time for forming the layer under the condition of Table E-7 following the changing curve of the gas flow rate ratio as shown in FIG. 51, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 76

Layers were formed under the same conditions as Example 69 except that $Si_2H_6$/He gas was used in place of $SiH_4$/He gas used in Example 69 and that the operating condition was changed to that as shown in Table E-8. Thereby, an electrophotographic image forming member was produced.

Using the resulting image forming member, image formation was effected on the transfer paper according to the same procedure and under the same conditions as in Example 69, whereby a very clear image quality was obtained.

EXAMPLE 77

Layers were formed under the same conditions as Example 69 except that $SiF_4$/He gas was used in place of $SiH_4$/He gas used in Example 69 and that the operating condition was changed to that as shown in Table E-9. Thereby, an electrophotographic image forming member was produced.

Using the resulting image forming member, image formation was effected on the transfer paper according to the same procedure and under the same conditions as in Example 69, whereby a very clear image quality was obtained.

EXAMPLE 78

Layers were formed under the same conditions as Example 69 except that ($SiH_4$/He+$SiF_4$/He) gas was used in place of $SiH_4$/He gas used in Example 69 and that the operating condition was changed to that as shown in Table E-10. Thereby, an electrophotographic image forming member was produced.

Using the resulting image forming member, image formation was effected on the transfer paper according to the same procedure and under the same conditions as in Example 69, whereby a very clear image quality was obtained.

EXAMPLE 79

Electrophotographic image forming members were produced under the same conditions as in Examples 69–78 except that preparation condition of the second layer in Examples 69–78 were changed as shown in Table E-11.

Using the resulting image forming members, image formation was effected on the transfer paper according to the same procedure and under the same conditions as in Example 69, whereby the results as shown in Table E-11A were obtained.

EXAMPLE 80

Electrophotographic image forming members were produced under the same conditions as in Examples 69–78 except that preparation condition of the second layer in Examples 69–78 were changed as shown in Table E-12.

Using the resulting image forming members, image formation was effected on the transfer paper according to the same procedure and under the same conditions as in Example 69, whereby the results as shown in Table E-12A were obtained.

EXAMPLE 81

Figure 52:
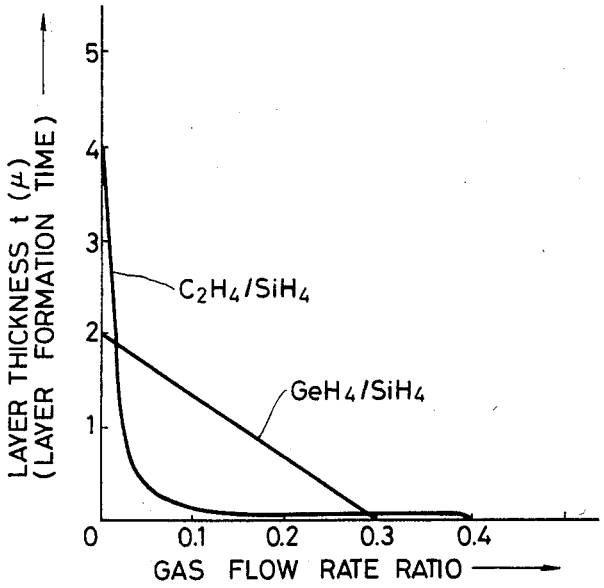

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table E-13 following the changing curve of the gas flow rate ratio as shown in FIG. 52, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 82

Figure 53:
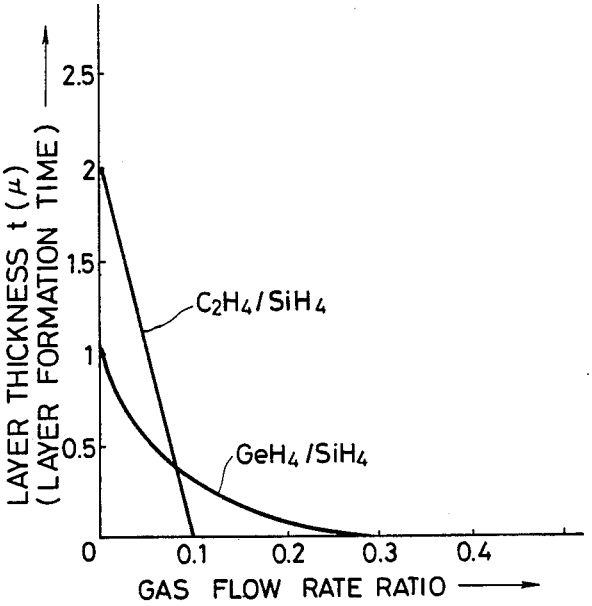

By the preparation device as shown in FIG. 12, layers were formed by changing the gas flow rate ratio of $GeH_4$/He gas to $SiH_4$/He gas and that of $C_2H_4$ gas to $SiH_4$/He gas along with the lapse of time for forming the layer under the condition of Table E-14 following the changing curve of the gas flow rate ratio as shown in FIG. 53, and other conditions were the same as in Example 69. Thereby, an electrophotographic image forming member was produced.

Using the resulting image forming member, image formation was effected on a transfer paper according to the same procedure and under the same conditions as in Example 69, whereby a very clear image quality was obtained.

EXAMPLE 83

Toner images were formed under the same conditions for a toner image formation as in Example 69 except that electrostatic images were formed by using GaAs type semiconductor laser (10 mW) of 810 nm in place of a tungsten lamp used in Examples 69–78. The electrophotographic image forming members produced under the same conditions as in Examples 69–78 were evaluated as to quality of the transferred toner images. The images were clear images of high quality excellent in resolution with good gradation reproducibility.

EXAMPLE 84

Electrophotographic image forming members (Sample Nos. 15-201–15-208, 15-301–15-308, . . . , 15-1001–15-1008; 72 Samples) were produced under the same conditions and according to the same procedure as in Examples 70–78 except that the conditions for formation of layer (II) were changed to those as shown in Table E-15.

The resulting electrophotographic image forming members were set individually in a reproduction device and then corona charging was effected at ⊖5 KV for 0.2 second, followed immediately by irradiation of a light image from a tungsten lamp source at a dose of 1.0 lux.sec. A latent image was developed with ⊕ charged developer (containing toner and carrier) and transferred to a plain paper. The transferred image was very good. The toner remaining on the electrophotographic image forming member without being transferred was scraped by an elastic blade. The above-described series of process steps were repeated 100,000 times or more. No deterioration in the image quality could be observed of any stage of the process steps. Evaluation for the overall image quality and durability for repetition of copying of the samples were shown in Table E-15A.

EXAMPLE 85

Each of image forming members was produced according to the same procedure as in Example 69 except that, upon formation of layer (II), the mixing ratio of Ar to NO, the target area ratio of silicon wafer to $SiO_2$ were changed, and the content ratio of silicon atom to oxygen atom in the layer (II) was changed. The resulting image forming members were evaluated for the image quality after about 50,000 repetitions of image formation, development and cleaning as described in Example 69. Whereby the results as shown in Table E-16 were obtained.

EXAMPLE 86

Each of image forming members was produced according to the same procedure as in Example 69 except that, upon formation of layer (II), the flow rate ratio of $SiH_4$ gas to NO gas was changed and the content ratio of silicon atom to oxygen atom in the layer (II) was changed. The resulting image forming members were evaluated for the image quality after about 50,000 repetitions of process up to a transfer as described in Example 69. Whereby the results as shown in Table E-17 were obtained.

EXAMPLE 87

Each of image forming members was produced according to the same procedure as in Example 69 except that, upon formation of layer (II), the flow rate ratio of $SiH_4$ gas: $SiF_4$ gas: NO gas was changed and the content ratio of silicon atom to oxygen atom in the layer (II) was changed. The resulting image forming members were evaluated for the image quality after about 50,000 repetitions of image formation, development and cleaning as described in Example 69. Whereby the results as shown in Table E-18 were obtained.

EXAMPLE 88

Each of image forming members was produced according to the same procedure as in Example 69 except that the layer thickness of layer (II) was changed. Image formation, development and cleaning as described in Example 69 were repeated. Whereby the results as shown in Table E-19 were obtained.

The common layer forming conditions in Examples 69–88 are as follows:

Substrate temperature:

Layer containing germanium atom (Ge) . . . about 200° C.

Layer not containing germanium atom (Ge) . . . about 250° C.

Discharge frequency: 13.56 MHz

Inner pressure in reaction chamber upon reaction: 0.3 Torr

EXAMPLE 89

Figure 54:
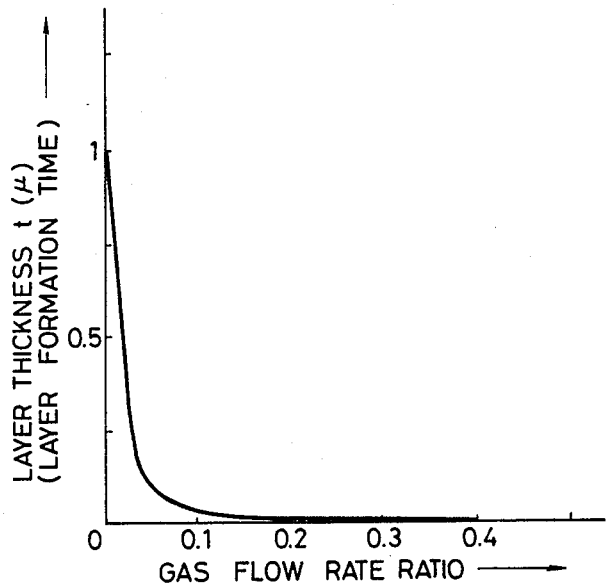

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table F-1 following the changing curve of the gas flow rate ratio as shown in FIG. 54, and thereby, an electrophotographic image forming member was produced.

The resulting image forming member was set in an experimental device for charging and exposure, and corona charging was effected at ⊖5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖5.0 KV, there was obtained a clear image of high density excellent in resolution with good gradation reproducibility.

EXAMPLE 90

Figure 55:
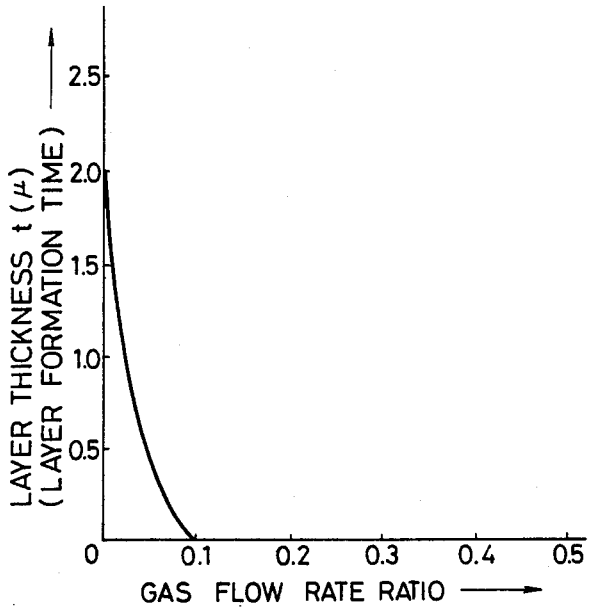

By the preparation device as shown in FIG. 12, layers were formed by changing the gas flow rate ratio of $GeH_4$/He gas to $SiH_4$/He gas along with the lapse of time for forming the layer under the condition of Table F-2 following the changing curve of the gas flow rate ratio as shown in FIG. 55, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 91

Figure 56:
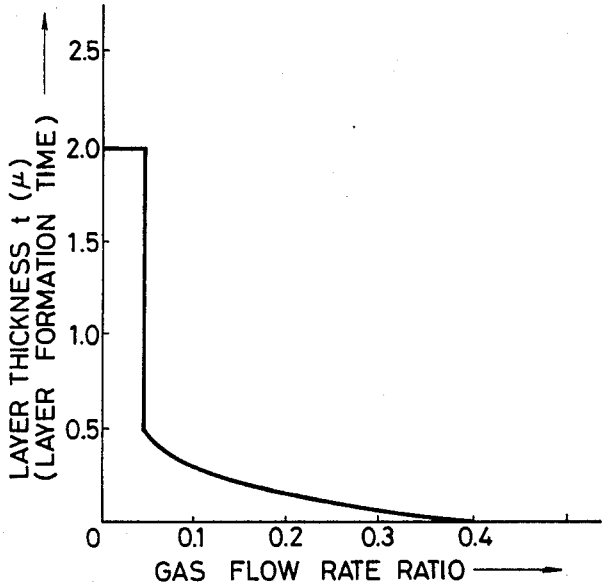

By the preparation device as shown in FIG. 12, layers were formed by changing the gas flow rate ratio of $GeH_4$/He gas to $SiH_4$/He gas along with the lapse of time for forming the layer under the condition of Table F-3 following the changing curve of the gas flow rate ratio as shown in FIG. 56, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 92

Figure 57:
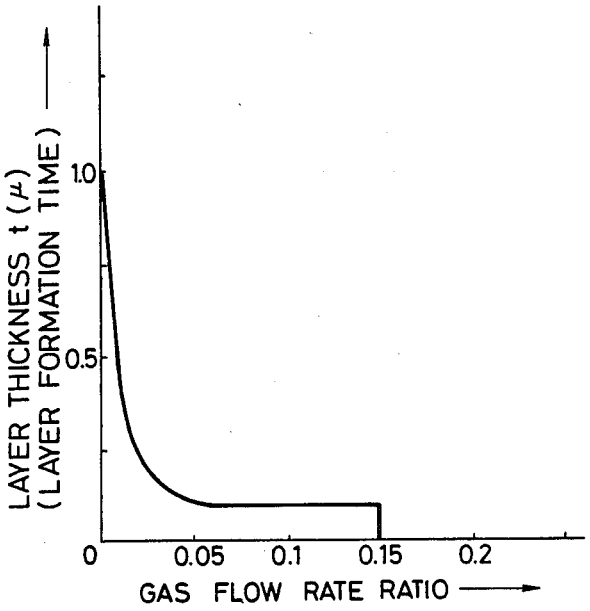

By the preparation device as shown in FIG. 12, layers were formed by changing the gas flow rate ratio of $GeH_4$/He gas to $SiH_4$/He gas along with the lapse of time for forming the layer under the condition of Table F-4 following the changing curve of the gas flow rate ratio as shown in FIG. 57, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 93

Figure 58:
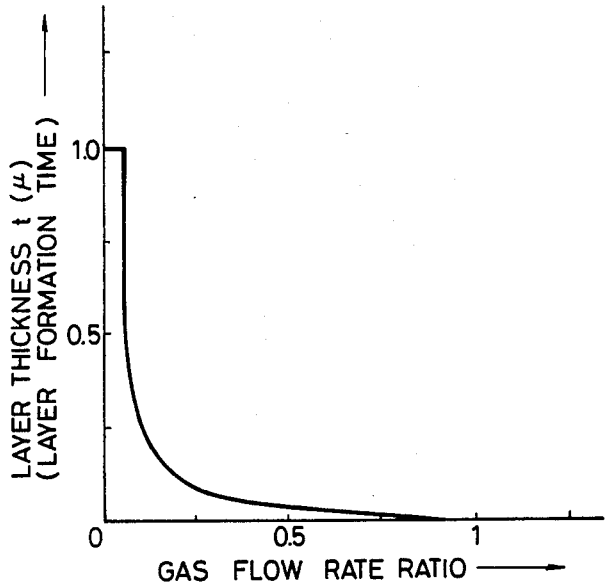

By the preparation device as shown in FIG. 12, layers were formed by changing the gas flow rate ratio of $GeH_4$/He gas to $SiH_4$/He gas along with the lapse of time for forming the layer under the condition of Table F-5 following the changing curve of the gas flow rate ratio as shown in FIG. 58, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 94

Figure 59:
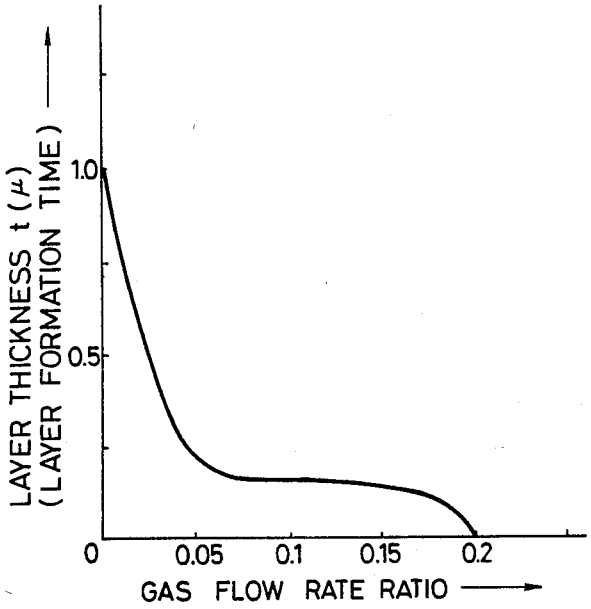

By the preparation device as shown in FIG. 12, layers were formed by changing the gas flow rate ratio of $GeH_4$/He gas to $SiH_4$/He gas along with the lapse of time for forming the layer under the condition of Table F-6 following the changing curve of the gas flow rate ratio as shown in FIG. 59, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 95

Figure 60:
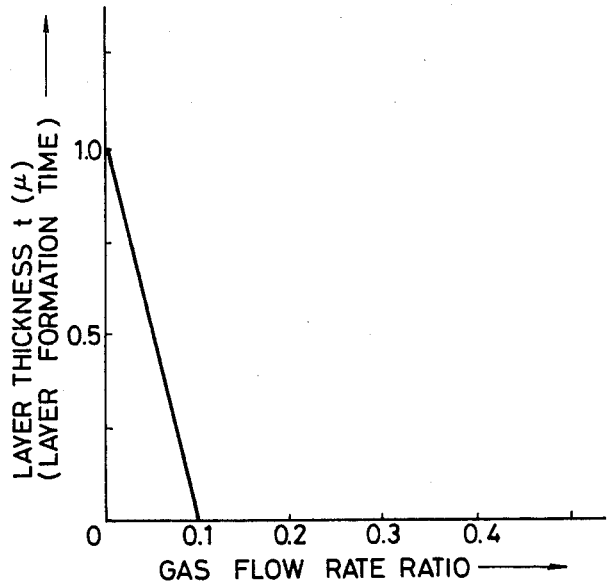

By the preparation device as shown in FIG. 12, layers were formed by changing the gas flow rate ratio of $GeH_4$/He gas to $SiH_4$/He gas along with the lapse of time for forming the layer under the condition of Table F-7 following the changing curve of the gas flow rate ratio as shown in FIG. 60, and other conditions were the same as in Example 89. Thereby, an electrophotographic image forming member was produced.

Using the resulting image forming member, image formation was effected on a transfer paper according to the same procedure and under the same conditions as in Example 89, whereby a very clear image quality was obtained.

EXAMPLE 96

Layers were formed under the same conditions as Example 89 except that $Si_2H_6$/He gas was used in place of $SiH_4$/He gas used in Example 89 and that the operating condition was changed to that as shown in Table F-8. Thereby, an electrophotographic image forming member was produced.

Using the resulting image forming member, image formation was effected on the transfer paper according to the same procedure and under the same conditions as in Example 89, whereby a very clear image quality was obtained.

EXAMPLE 97

Layers were formed under the same conditions as Example 89 except that $SiF_4$/He gas was used in place of $SiH_4$/He gas used in Example 89 and that the operating condition was changed to that as shown in Table F-9 . Thereby, an electrophotograhic image forming member was produced.

Using the resulting image forming member, image formation was effected on the transfer paper according to the same procedure and under the same conditions as in Example 89, whereby a very clear image quality was obtained.

EXAMPLE 98

Layers were formed under the same conditions as Example 89 except that ($SiH_4$/He+$SiF_4$/He) gas was used in place of $SiH_4$/He gas used in Example 89 and that the operating condition was changed to that as shown in Table F-10. Thereby, an electrophotographic image forming member was produced.

Using the resulting image forming member, image formation was effected on the transfer paper according to the same procedure and under the same conditions as in Example 89, whereby a very clear image quality was obtained.

EXAMPLE 99

By the preparation device as shown in FIG. 12, layers were formed on an Al cylinder substrate by changing the gas flow rate ratio of $GeH_4$/He gas to $SiH_4$/He gas along with the lapse of time for forming the layer under the condition of Table F-11 following the changing curve of the gas flow rate ratio as shown in FIG. 54, and thereby, an electrophotographic image forming member was produced.

The resulting image forming member was set in an experimental device for charging and exposure, and corona charging was effected at ⊖5.0 KV for 0.3 second, followed immediately by irradiation of a light image from a tungsten lamp source at a dose of 2 lux.sec through a transmissive type test chart.

Immediately thereafter, by cascading on the image forming member surface with ⊕ charged developer (containing toner and carrier), a good toner image was obtained on the image forming member surface. When the toner image on the image forming member was transferred to a transfer paper by corona charging at ⊖5.0 KV, there was obtained a clear image of high density excellent in resolution with good gradation reproducibility.

EXAMPLE 100

Electrophotographic image forming members (Sample Nos. 1201–1208) were produced under the same conditions as in Example 99 except that the flow rate ratio of $B_2H_6$ to ($SiH_4$+$GeH_4$) upon formation of the first layer in Example 99 and the flow rate ratio of $B_2H_6$ to $SiH_4$ upon formation of the second layer in Example 99 were changed as shown in Table F-12.

Using the resulting image forming members, image formation was effected on the transfer paper according to the same procedure and under the same conditions as in Example 99, whereby the results as shown in Table F-12 were obtained.

EXAMPLE 101

Electrophotographic image forming members (Sample Nos. 1301–1310, 1401–1410) were produced under the same conditions as in Examples 89–98 except that preparation conditions of second layer in Examples 89–98 were changed as shown in Table F-13 and F-14.

Using the resulting image forming members, image formation was effected on the transfer paper according to the same procedure and under the same conditions as in Example 89, whereby the results as shown in Table F-13A and F-14A were obtained.

EXAMPLE 102

Toner images were formed under the same conditions for a toner image formation as in Example 89 except that electrostatic images were formed by using GaAs type semiconductor laser (10 mW) of 810 nm in place of a tungsten lamp used in Example 89. The electrophotographic image forming members produced under the same conditions as in Example 89 were evaluated as to quality of the transferred toner images. The images were clear images of high quality excellent in resolution with good gradation reproducibility.

EXAMPLE 103

Electrophotographic image forming members (Sample Nos. 15-201-15-208, 15-301-15-308, . . . , 15-1001-15-1008; 72 Samples) were produced under the same conditions and according to the same procedure as in Examples 89–98 except that the conditions for formation of layer (II) were changed to those as shown in Table F-15.

The resulting electrophotographic image forming members were set individually in a reproduction device and then corona charging was effected at ⊖5.0 KV for 0.2 second, followed immediately by irradiation of a light image from a tungsten lamp source at a dose of 1.0 lux.sec. A latent image was developed with ⊕ charged developer (containing toner and carrier) and transferred to a plain paper. The transferred image was very good. The toner remaining on the electrophotographic image forming member without being transferred was scraped by an elastic blade. The above-described series of process steps were repeated 100,000 times or more. No deterioration in the image quality could be observed of any stage of the process steps. Evaluation for the overall image quality and durability for repetition of copying of the samples were shown in Table F-15A.

EXAMPLE 104

Each of image forming members was produced according to the same procedure as in Example 89 except that, upon formation of layer (II), the mixing ratio of Ar to NO, the target area ratio of silicon wafer to $SiO_2$ were changed, and the content ratio of silicon atom to oxygen atom in the layer (II) was changed. The resulting image forming members were evaluated for the image quality after about 50,000 repetitions of image formation, development and cleaning as described in Example 89. Whereby the results as shown in Table F-16 were obtained.

EXAMPLE 105

Each of image forming members was produced according to the same procedure as in Example 89 except that, upon formation of layer (II), the flow rate ratio of $SiH_4$ gas to NO gas was changed and the content ratio of silicon atom to oxygen atom in the layer (II) was changed. The resulting image forming members were evaluated for the image quality after about 50,000 repetitions of process up to a transfer as described in Example 89. Whereby the results as shown in Table F-17 were obtained.

EXAMPLE 106

Each of image forming members was produced according to the same procedure as in Example 89 except that, upon formation of layer (II), the flow rate ratio of $SiH_4$ gas: $SiF_4$ gas: NO gas was changed and the content ratio of silicon atom to oxygen atom in the layer (II) was changed. The resulting image forming members were evaluated for the image quality after about 50,000 repetitions of image formation, development and cleaning as described in Example 89. Whereby the results as shown in Table F-18 were obtained.

EXAMPLE 107

Each of image forming members was produced according to the same procedure as in Example 89 except that the layer thickness of layer (II) was changed. Image formation, development and cleaning as described in Example 89 were repeated. Whereby the results as shown in Table F-19 were obtained.

The common layer forming conditions in Examples 89–107 of the present invention are as follows:

Substrate temperature:

Layer containing germanium atom (Ge) . . . about 200° C.

Layer not containing germanium atom (Ge) . . . about 250° C.

Discharge frequency: 13.56 MHz

Inner pressure in reaction chamber upon reaction: 0.3 Torr

TABLE A

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4$/He = 0.05<br>$GeH_4$/He = 0.05<br>$C_2H_4$ | $SiH_4 + GeH_4 = 50$ | $GeH_4/SiH_4 = 4/10 \sim 3/100$<br>$C_2H_4/(GeH_4 + SiH_4) = 3/100$ | 0.18 | 5 | 2 |
| Second layer | $SiH_4$/He = 0.05<br>$GeH_4$/He = 0.05 | $SiH_4 + GeH_4 = 50$ | $GeH_4/SiH_4 = 3/100 \sim 0$ | 0.18 | 5 | 8 |
| Third layer | $SiH_4$/He = 0.5 | $SiH_4 = 200$ | | 0.18 | 15 | 10 |
| First layer | $SiH_4$/He = 0.05<br>$GeH_4$/He = 0.05<br>$C_2H_4$ | $SiH_4 + GeH_4 = 50$ | $GeH_4/SiH_4 = 1/10 \sim 4/100$<br>$C_2H_4/(GeH_4 + SiH_4) = 3/100$ | 0.18 | 5 | 5 |
| Second layer | $SiH_4$/He = 0.05<br>$GeH_4$/He = 0.05 | $SiH_4 + GeH_4 = 50$ | $GeH_4/SiH_4 = 4/100 \sim 0$ | 0.18 | 5 | 3 |
| Third layer | $SiH_4$/He = 0.5 | $SiH_4 = 200$ | | 0.18 | 15 | 10 |
| First layer | $SiH_4$/He = 0.05<br>$GeH_4$/He = 0.05<br>$C_2H_4$ | $SiH_4 + GeH_4 = 50$ | $GeH_4/SiH_4 = 4/10 \sim 4/100$<br>$C_2H_4/(GeH_4 + SiH_4) = 3/100$ | 0.18 | 5 | 1 |
| Second layer | $SiH_4$/He = 0.05<br>$GeH_4$/He = 0.05 | $SiH_4 + GeH_4 = 50$ | $GeH_4/SiH_4 = 4/100$ | 0.18 | 5 | 1 |
| Third layer | $SiH_4$/He = 0.5 | $SiH_4 = 200$ | | 0.18 | 15 | 15 |
| First layer | $SiH_4$/He = 0.05<br>$GeH_4$/He = 0.05<br>$C_2H_4$ | $SiH_4 + GeH_4 = 50$ | $GeH_4/SiH_4 = 15/100 \sim 1/100$<br>$C_2H_4/(GeH_4 + SiH_4) = 3/100$ | 0.18 | 5 | 0.4 |
| Second | $SiH_4$/He = 0.05 | $SiH_4 + GeH_4 = 50$ | $GeH_4/SiH_4 = 1/100 \sim 0$ | 0.18 | 5 | 0.6 |

TABLE A-continued

| | | | | | | |
|---|---|---|---|---|---|---|
| layer | $GeH_4/He = 0.05$ | | | | | |
| Third layer | $SiH_4/He = 0.5$ | $SiH_4 = 200$ | | 0.18 | 15 | 20 |
| First layer | $SiH_4/He = 0.05$<br>$GeH_4/He = 0.05$<br>$C_2H_4$ | $SiH_4 + GeH_4 = 50$ | $GeH_4/SiH_4 = 1/1 \sim 14/100$<br>$C_2H_4/(GeH_4 + SiH_4) = 3/100$ | 0.18 | 5 | 0.2 |
| Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| Third layer | $SiH_4/He = 0.5$ | $SiH_4 = 200$ | | 0.18 | 15 | 20 |
| First layer | $SiH_4/He = 0.05$<br>$GeH_4/He = 0.05$<br>$C_2H_4$ | $SiH_4 + GeH_4 = 50$ | $GeH_4/SiH_4 = 2/10 \sim 45/1000$<br>$C_2H_4/(GeH_4 + SiH_4) = 1/100$ | 0.18 | 5 | 2 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| Third layer | $SiH_4/He = 0.5$ | $SiH_4 = 200$ | | 0.18 | 15 | 10 |
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| Third layer | $SiH_4/He = 0.5$ | $SiH_4 = 200$ | | 0.18 | 15 | 10 |
| First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| Third layer | $Si_2H_6/He = 0.5$ | $Si_2H_6 = 200$ | | 0.18 | 15 | 10 |
| First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| Third layer | $SiF_4/He = 0.5$ | $GeF_4 = 200$ | | 0.18 | 15 | 10 |
| First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 15 | 8 |
| Third layer | $SiH_4/He = 0.5$<br>$SiF_4/He = 0.5$ | $SiH_4 + SiF_4 = 200$ | | 0.18 | 15 | 10 |
| Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 | |
| Third layer | $SiH_4/He = 0.5$<br>$PH_3/He = 10^{-3}$ | $SiH_4 = 200$ | $PH_3/SiH_4 = 2 \times 10^{-5}$ | 0.18 | 15 | |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 4/10 \sim 2/100$ | 0.18 | 5 | 2 |
| Second layer | $SiH_4/He = 0.5$<br>$C_2H_4$ | $SiH_4 = 200$ | $C_2H_4SiH_4 = 2/100 \sim 0$ | 0.18 | 5 | 2 |
| Third layer | $SiH_4/He = 0.5$ | $SiH_4 = 200$ | | 0.18 | 15 | 15 |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| Second layer | $SiH_4/He = 0.5$<br>$C_2H_4$ | $SiH_4 = 200$ | $C_2H_4/SiH_4 = 5/100 \sim 0$ | 0.18 | 15 | 1 |
| Third layer | $SiH_4/He = 0.5$ | $SiH_4 = 200$ | | 0.18 | 15 | 18 |

| Sample No. | 1101 | 1102 | 1103 | 1104 | 1105 | 1106 | 1107 | 1108 | 1109 | 1110 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | ○ | ○ | ◎ | ◎ | ◎ | ◎ | ○ | ○ | ○ | ○ |

| Sample No. | 1201 | 1202 | 1203 | 1204 | 1205 | 1206 | 1207 | 1208 | 1209 | 1210 |
|---|---|---|---|---|---|---|---|---|---|---|
| First layer | The same as that | The same as that | The same as that | The same as that | The same as that | The same as that | The same as that | The same as that | The same as that | The same as that |

TABLE A-continued

| | in Example 1 | in Example 2 | in Example 3 | in Example 4 | in Example 5 | in Example 6 | in Example 7 | in Example 8 | in Example 9 | in Example 10 |
|---|---|---|---|---|---|---|---|---|---|---|
| Thickness of third layer (μ) | 10 | 10 | 15 | 20 | 20 | 10 | 10 | 10 | 10 | 10 |
| Evaluation | | ○ | ◎ | ◎ | ○ | ◎ | | ○ | ○ | ○ |

◎: Excellent
○ : Good

TABLE B

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |
| Second layer | $SiH_4/He = 0.5$ | $SiH_4 = 200$ | | 0.18 | 15 | 19 |
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 1/100$ | 0.18 | 5 | 2 |
| Second layer | $SiH_4/He = 0.5$ | $SiH_4 = 200$ | | 0.18 | 15 | 15 |
| First layer | $SiH_4/He = 0.05$<br>$GeH_4/He = 0.05$<br>$B_2H_6He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| Second layer | $SiH_4/He = 0.5$ | $SiH_4 = 200$ | | 0.18 | 15 | 15 |
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 15/100 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 2/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |
| First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| Second layer | $Si_2/H_6/He = 0.5$ | $Si_2 H_6 = 200$ | | 0.18 | 15 | 19 |
| First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| Second layer | $SiF_4/He = 0.05$ | $SiF_4 = 200$ | | 0.18 | 15 | 19 |
| First layer | $SiH_4/He = 0.05$<br>$SiF_4/He = 0.05$<br>$GeH_4/He = 0.05$<br>$B_2H_6/He = 10^{-3}$<br>$C_2H4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(GeH_4 + SiH_4 + SiF_4) = 1/100$ | 0.18 | 5 | 1 |
| Second layer | $SiH_4/He = 0.5$<br>$SiF_4/He = 0.5$ | $SiH_4 + SiF_4 = 200$ | | 0.18 | 5 | 19 |
| First layer | $SiH_4/He = 0.05$<br>$GeH_4/He = 0.05$<br>$B_2H_6/He = 10^{-3}$<br>$C_2H4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |

TABLE B-continued

| | | | | | | |
|---|---|---|---|---|---|---|
| Second layer | $SiH_4/He = 0.5$ $B_2H_6/He = 10^{-3}$ | $SiH_4 = 200$ | $B_2H_6/SiH_4 = 3 \times 10^{-3}$ | 0.18 | 15 | 19 |
| Second layer | $SiH_4/He = 0.5$ $B_2H_6/He = 10^{-3}$ | $SiH_4 = 200$ | $B_2H_6/SiH_4 = 8 \times 10^{-5}$ | 0.18 | 15 | |
| Second layer | $SiH_4/He = 0.5$ $PH_3/He = 10^{-3}$ | $SiH_4 = 200$ | $PH_3/SiH_4 = 1 \times 10^{-5}$ | 0.18 | 15 | |

| Sample No. | 1201 | 1202 | 1203 | 1204 | 1205 | 1206 | 1207 | 1208 |
|---|---|---|---|---|---|---|---|---|
| $B_2H_6/SiH_4$ Flow rate ratio | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B Content (atomic/ppm) | $1 \times 10^4$ | $6 \times 10^3$ | $2.5 \times 10^3$ | $1 \times 10^3$ | 800 | 500 | 300 | 100 |
| Evaluation | ○ | ◎ | ◎ | ◎ | ◎ | ○ | ○ | ○ |

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

◎: Excellent
○ : Good

TABLE C

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$ $GeH_4/He = 0.05$ $C_2H_4$ | $SiH_4 + GeH_4 = 50$ | $GeH_4/SiH_4 = 4/10 \sim 3/100$ $C_2H_4/(GeH_4 + SiH_4) = 3/100$ | 0.18 | 5 | 2 |
| | Second layer | $SiH_4/He = 0.05$ $GeH_4/He = 0.05$ | $SiH_4 + GeH_4 = 50$ | $GeH_4/SiH_4 = 3/100 \sim 0$ | 0.18 | 5 | 8 |
| | Third layer | $SiH_4/He = 0.5$ | $SiH_4 = 200$ | | 0.18 | 15 | 10 |
| Layer (II) | | $SiH_4/He = 0.5$ $NH_3$ | $SiH_4 = 100$ | $SiH_4/NH_3 = 1/30$ | 0.18 | 10 | 0.5 |
| Layer (I) | First layer | $SiH_4/He = 0.05$ $GeH_4/He = 0.05$ $C_2H_4$ | $SiH_4 + GeH_4 = 50$ | $GeH_4/SiH_4 = 1/10 \sim 4/100$ $C_2H_4/(GeH_4 + SiH_4) = 3/100$ | 0.18 | 5 | 5 |
| | Second layer | $SiH_4/He = 0.05$ $GeH_4/He = 0.05$ | $SiH_4 + GeH_4 = 50$ | $GeH_4/SiH_4 = 4/100 \sim 0$ | 0.18 | 5 | 3 |
| | Third layer | $SiH_4/He = 0.5$ | $SiH_4 = 200$ | | 0.18 | 15 | 10 |
| | First layer | $SiH_4/He = 0.05$ $GeH_4/He = 0.05$ $C_2H_4$ | $SiH_4 + GeH_4 = 50$ | $GeH_4/SiH_4 = 4/10 \sim 4/100$ $C_2H_4/(GeH_4 + SiH_4) = 3/100$ | 0.18 | 5 | 1 |
| | Second layer | $SiH_4/He = 0.05$ $GeH_4/He = 0.05$ | $SiH_4 + GeH_4 = 50$ | $GeH_4/SiH_4 = 4/100$ | 0.18 | 5 | 1 |
| | Third layer | $SiH_4/He = 0.5$ | $SiH_4 = 200$ | | 0.18 | 15 | 15 |
| | First layer | $SiH_4/He = 0.05$ $GeH_4/He = 0.05$ $C_2H_4$ | $SiH_4 + GeH_4 = 50$ | $GeH_4/SiH_4 = 15/100 \sim 1/100$ $C_2H_4/(GeH_4 + SiH_4) = 3/100$ | 0.18 | 5 | 0.4 |
| | Second layer | $SiH_4/He = 0.05$ $GeH_4/He = 0.05$ | $SiH_4 + GeH_4 = 50$ | $GeH_4/SiH_4 = 1/100 \sim 0$ | 0.18 | 5 | 0.6 |
| | Third | $SiH_4/He = 0.5$ | $SiH_4 = 200$ | | 0.18 | 15 | 20 |

TABLE C-continued

| | | | | | | |
|---|---|---|---|---|---|---|
| layer | | | | | | |
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 14/100$<br>$C_2H_4/(GeH_4 + SiH_4) = 3/100$ | 0.18 | 5 | 0.2 |
| Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| Third layer | $SiH_4/He = 0.5$ | $SiH_4 = 200$ | | 0.18 | 15 | 20 |
| First layer | $SiH_4/He = 0.05$<br>$GeH_4/He = 0.05$<br>$C_2H_4$ | $SiH_4 + GeH_4 = 50$ | $GeH_4/SiH_4 = 2/10 \sim 45/1000$<br>$C_2H_4/(GeH_4 + SiH_4) = 1/100$ | 0.18 | 5 | 2 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| Third layer | $SiH_4/He = 0.5$ | $SiH_4 = 200$ | | 0.18 | 15 | 10 |
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| Third layer | $SiH_4/He = 0.5$ | $SiH_4 = 200$ | | 0.18 | 15 | 10 |
| First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| Third layer | $Si_2H_6/He = 0.5$ | $Si_2H_6 = 200$ | | 0.18 | 15 | 10 |
| First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| Second layer | $SiF_4/He = 0.05$<br>$GeH_4/He = 0.05$ | $SiF_4 + GeH_4 + 50$ | $GeH_4/SiF_4 = 3/100 \sim 0$ | 0.18 | 5 | 8 |
| Third layer | $Sif_4/He = 0.5$ | $SiF_4 = 200$ | | 0.18 | 15 | 10 |
| First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 5 | 8 |
| Third layer | $SiH_4/He = 0.5$<br>$SiF_4/He = 0.5$ | $SiH_4 + SiF_4 = 200$ | | 0.18 | 15 | 10 |
| Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 | |
| Third layer | $SiH_4/He = 0.5$<br>$PH_3/He = 10^{-3}$ | $SiH_4 = 200$ | $PH_3/SiH_4 = 2 \times 10^{-5}$ | 0.18 | 15 | |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 4/10 \sim 2/100$ | 0.18 | 5 | 2 |
| Second layer | $SiH_4/He = 0.5$<br>$C_2H_4$ | $SiH_4 = 200$ | $C_2H_4/SiH_4 = 2/100 \sim 0$ | 0.18 | 15 | 2 |
| Third layer | $SiH_4/He = 0.5$ | $SiH_4 = 200$ | | 0.18 | 15 | 15 |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| Second layer | $SiH_4/He = 0.5$<br>$C_2H_4$ | $SiH_4 = 200$ | $C_2H_4/SiH_4 = 5/100 \sim 0$ | 0.18 | 15 | 1 |
| Third layer | $SiH_4/He = 0.5$ | $SiH_4 = 200$ | | 0.18 | 15 | 18 |

| Sample No. | | 1101 | 1102 | 1103 | 1104 | 1105 | 1106 | 1107 | 1108 | 1109 | 1110 |
|---|---|---|---|---|---|---|---|---|---|---|---|
| Layer (I) | First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| | Thickness of third layer (μ) | 10 | 10 | 15 | 20 | 20 | 10 | 10 | 10 | 10 | 10 |
| Evaluation | | ○ | ○ | ◎ | ◎ | ◎ | ◎ | ○ | ○ | ○ | ○ |

| Sample No. | | 1201 | 1202 | 1203 | 1204 | 1205 | 1206 | 1207 | 1208 | 1209 | 1210 |
|---|---|---|---|---|---|---|---|---|---|---|---|
| Layer (I) | First layer | The same as that in | The same as that in | The same as that in | The same as that in | The same as that in | The same as that in | The same as that in | The same as that in | The same as that in | The same as that in |

TABLE C-continued

| | Example 1 | Example 2 | Example 3 | Example 4 | Example 5 | Example 6 | Example 7 | Example 8 | Example 9 | Example 10 |
|---|---|---|---|---|---|---|---|---|---|---|
| Thickness of third layer (μ) | 10 | 10 | 15 | 20 | 20 | 10 | 10 | 10 | 10 | 10 |
| Evaluation | ○ | ○ | ◎ | ◎ | ◎ | ○ | ○ | ○ | ○ | ○ |

◎: Excellent
○ : Good

| Sample No. | 1401 | 1402 | 1403 | 1404 | 1405 | 1406 | 1407 |
|---|---|---|---|---|---|---|---|
| $Si:Si_3N_4$ | 9:1 | 6.5:3.5 | 4:10 | 2:60 | 1:100 | 1:100 | 1:100 |
| Target (Area ratio) ($NH_3$/Ar) | (0/1) | (1/1) | (1/1) | (1/1) | (2/1) | (3/1) | (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○ : Good
Δ: Sufficiently practically usable
X: Image defect formed

| Sample No. | 1501 | 1502 | 1503 | 1504 | 1505 | 1506 | 1507 | 1508 |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ◎ | ◎ | ◎ | ○ | Δ | Δ | X |

| Sample No. | 1601 | 1602 | 1603 | 1604 | 1605 | 1606 | 1607 | 1608 |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○ : Good
Δ: Practically satisfactory
X: Image defect formed

| Sample No. | Thickness of layer (II) (μ) | Results |
|---|---|---|
| 1601 | 0.001 | Image defect liable to occur |
| 1602 | 0.02 | No image defect during 20,000 repetitions |
| 1603 | 0.05 | Stable for 50,000 repetitions or more |
| 1604 | 1 | Stable for 200,000 repetitions or more |

| Conditions | Gases employed | Flow rate (SCCM) | Flow rate ratio or Area ratio | Discharging power ($W/cm^2$) | Layer thickness (μ) |
|---|---|---|---|---|---|
| 12-1 | Ar($NH_3$/Ar) | 200(1/1) | Si Wafer:Silicon nitride = 1:30 | 0.3 | 0.5 |
| 12-2 | AR($NH_3$/Ar) | 200(1/1) | Si Wafer:Silicon nitride = 1:30 | 0.3 | 0.3 |
| 12-3 | Ar($NH_3$/Ar) | 200(1/1) | Si Wafer:Silicon nitride = 6:4 | 0.3 | 1.0 |
| 12-4 | $SiH_4$/He = 1 $NH_3$ | $SiH_4$ = 15 | $SiH_4:NH_3$ = 1:100 | 0.18 | 0.3 |
| 12-5 | $SiH_4$/He = 0.5 $NH_3$ | $SiH_4$ = 100 | $SiH_4:NH_3$ = 1:30 | 0.18 | 1.5 |
| 12-6 | $SiH_4$/He = 0.5 $SiF_4$/He = 0.5 $NH_3$ | $SiH_4 + SiF_4$ = 150 | $SiH_4:SiF_4:NH_3$ = 1:1:60 | 0.18 | 0.5 |
| 12-7 | $SiH_4$/He = 0.5 $SiF_4$/He = 0.5 $NH_3$ | $SiH_4 + SiF_4$ = 15 | $SiH_4:SiF_4:NH_3$ = 2:1:90 | 0.18 | 0.3 |
| 12-8 | $SiH_4$/He = 0.5 $SiF_4$/He = 0.5 $NH_3$ | $SiH_4 + SiF_4$ = 150 | $SiH_4:SiF_4:NH_3$ = 1:1:20 | 0.18 | 1.5 |

| Preparation conditions for layer (II) | Sample No./Evaluation | | | | | | | | |
|---|---|---|---|---|---|---|---|---|---|
| 12-1 | 12-201 ○○ | 12-301 ○○ | 12-401 ○○ | 12-501 ○○ | 12-601 ○○ | 12-701 ○○ | 12-801 ○○ | 12-901 ○○ | 12-1001 ○○ |
| 12-2 | 12-202 ○○ | 12-302 ○○ | 12-402 ○○ | 12-502 ○○ | 12-602 ○○ | 12-702 ○○ | 12-802 ○○ | 12-902 ○○ | 12-1002 ○○ |
| 12-3 | 12-203 ○○ | 12-303 | 12-403 ○○ | 12-503 ○○ | 12-603 ○○ | 12-703 ○○ | 12-803 ○○ | 12-903 ○○ | 12-1003 ○○ |
| 12-4 | 12-204 ◎◎ | 12-304 ◎◎ | 12-404 ◎◎ | 12-504 ◎◎ | 12-604 ◎◎ | 12-704 ◎◎ | 12-804 ◎◎ | 12-904 ◎◎ | 12-1004 ◎◎ |
| 12-5 | 12-205 ◎◎ | 12-305 ◎◎ | 12-405 ◎◎ | 12-505 ◎◎ | 12-605 ◎◎ | 12-705 ◎◎ | 12-805 ◎◎ | 12-905 ◎◎ | 12-1005 ◎◎ |
| 12-6 | 12-206 ◎◎ | 12-306 ◎◎ | 12-406 ◎◎ | 12-506 ◎◎ | 12-606 ◎◎ | 12-706 ◎◎ | 12-806 ◎◎ | 12-906 ◎◎ | 12-1006 ◎◎ |
| 12-7 | 12-207 ○○ | 12-307 ○○ | 12-407 ○○ | 12-507 ○○ | 12-607 ○○ | 12-707 ○○ | 12-807 ○○ | 12-907 ○○ | 12-1007 ○○ |
| 12-8 | 12-208 ○○ | 12-308 ○○ | 12-408 ○○ | 12-508 ○○ | 12-608 ○○ | 12-708 ○○ | 12-808 ○○ | 12-908 ○○ | 12-1008 ○○ |

Sample No.
Overall image Durability

TABLE C-continued

| | | | | | | | |
|---|---|---|---|---|---|---|---|
| | evaluation | evaluation | | | | | |

Evaluation standard:
◎ . . . Excellent
○ . . . Good

TABLE D

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3/10^{-3}$<br>$C_2H_5/(GeH_4 + SiH_4) = 3/100$ | 0.18 | 5 | 1 |
| | Second layer | $SiH_4/He = 0.5$ | $SiH_4 = 200$ | | 0.18 | 5 | 19 |
| Layer (II) | | $SiH_4/He = 0.5$<br>$NH_3$ | $SiH_4 = 100$ | $SiH_4/NH_3 = 1/30$ | 0.18 | 10 | 0.5 |
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.05$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 15/100 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 2/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6He = 10^{-3}$<br>$C_2H_4$ | $SiH_4 + GeH_4 = 50$ | $GeH_4/SiH_4 = 10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| | Second layer | $Si_2H_6/He = 0.5$ | $Si_2H_6 = 200$ | | 0.18 | 15 | 19 |
| | First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| | Second layer | $SiF_4/He = 0.05$ | $SiF_4 = 200$ | $GeH_4/SiF_4 = 8/100 \sim 0$ | 0.18 | 5 | 19 |
| | First layer | $SiH_4/He = 0.05$<br>$SiF_4/He = 0.05$<br>$GeH_4/He = 0.05$<br>$B_2H_6/He = 10^{-3}$<br>$C_2H_4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(GeH_4 + SiH_4 + SiF_4) = 1/100$ | 0.18 | 5 | 1 |
| | Second layer | $SiH_4/He = 0.5$<br>$SiF_4/He = 0.5$ | $SiH_4 + SiF_4 = 200$ | | 0.18 | 5 | 19 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |
| | Second | $SiH_4/He = 0.5$ | $SiH_4 = 100$ | $B_2H_6/SiH_4 = 3 \times 10^{-3}$ | 0.18 | 15 | 19 |

TABLE D-continued

| | | | | | | | |
|---|---|---|---|---|---|---|---|
| | layer | $B_2H_6/He = 10^{-3}$ | | | | | |
| Layer (II) | | $SiH_4/He = 0.5$ $NH_3$ | $SiH_4 = 100$ | $SiH_4/NH_3 = 1/30$ | 0.18 | 9 | 0.5 |
| Layer (I) | Second layer | $SiH_4/He = 0.5$ $B_2H_6/He = 10^{-3}$ | $SiH_4 = 200$ | $B_2H_6/SiH_4 = 8 \times 10^{-5}$ | 0.18 | 15 | |
| | Second layer | $SiH_4/He = 0.5$ $PH_3/He = 10^{-3}$ | $SiH_4 = 200$ | $PH_3/SiH_4 = 1 \times 10^{-5}$ | 0.18 | 15 | |

| Sample No. | 1201 | 1202 | 1203 | 1204 | 1205 | 1206 | 1207 | 1208 |
|---|---|---|---|---|---|---|---|---|
| $B_2H_6 + SiH_4$ (Flow rate ratio) | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B Content (atomic ppm) | $1 \times 10^4$ | $6 \times 10^3$ | $25 \times 10^3$ | $1 \times 10^3$ | 800 | 500 | 300 | 100 |
| Image quality evaluation | ○ | ◎ | ◎ | ◎ | ◎ | ○ | ○ | ○ |

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of Second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

◎: Excellent
○: Good

| Sample No. | 1401 | 1402 | 1403 | 1404 | 1405 | 1406 | 1407 |
|---|---|---|---|---|---|---|---|
| $Si:Si_3N_4$ Target (Area ratio) ($NH_3$/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○: Good
Δ: Sufficiently practically usable
X: Image defect formed

| Sample No. | 1501 | 1502 | 1503 | 1504 | 1505 | 1506 | 1507 | 1508 |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ◎ | ◎ | ◎ | ○ | Δ | Δ | X |

| Sample No. | 1601 | 1602 | 1603 | 1604 | 1605 | 1606 | 1607 | 1608 |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○: Good
Δ: Practically satisfactory
X: Image defect formed

| Sample No. | Thickness of layer (II) (μ) | Results |
|---|---|---|
| 1601 | 0.001 | Image defect liable to occur |
| 1602 | 0.02 | No image defect during 20,000 repetitions |
| 1603 | 0.05 | Stable for 50,000 repetitions or more |
| 1604 | 1 | Stable for 200,000 repetitions or more |

| Conditions | Gases employed | Flow rate (SCCM) | Flow rate ratio or Area ratio | Discharging power ($W/cm^2$) | Layer thickness (μ) |
|---|---|---|---|---|---|
| 12-1 | Ar($NH_3$/Ar) | 200(1/1) | Si Wafer:Silicon nitride = 1:30 | 0.3 | 0.5 |
| 12-2 | Ar($NH_3$/Ar) | 200(1/1) | Si Wafer:Silicon nitride = 1:30 | 0.3 | 0.3 |
| 12-3 | Ar($NH_3$/Ar) | 200(1/1) | Si Wafer:Silicon nitride = 6:4 | 0.3 | 1.0 |
| 12-4 | $SiH_4/He = 1$ $NH_3$ | $SiH_4 = 15$ | $SiH_4:NH_3 = 1:100$ | 0.18 | 0.3 |
| 12-5 | $SiH_4/He = 0.5$ $NH_3$ | $SiH_4 = 100$ | $SiH_4:NH_3 = 1:30$ | 0.18 | 1.5 |

TABLE D-continued

| | | | | | |
|---|---|---|---|---|---|
| 12-6 | $SiH_4$/He = 0.5<br>$SiF_4$/He = 0.5<br>$NH_3$ | $SiH_4 + SiF_4 = 150$ | $SiH_4$:$SiF_4$:$NH_3$ = 1:1:60 | 0.18 | 0.5 |
| 12-7 | $SiH_4$/He = 0.5<br>$SiF_4$/He = 0.5<br>$NH_3$ | $SiH_4 + SiF_4 = 15$ | $SiH_4$:$SiF_4$:$NH_3$ = 2:1:90 | 0.18 | 0.3 |
| 12-8 | $SiH_4$/He = 0.5<br>$SiF_4$/He = 0.5<br>$NH_3$ | $SiH_4 + SiF_4 = 150$ | $SiH_4$:$SiF_4$:$NH_3$ = 1:1:20 | 0.18 | 1.5 |

| Preparation conditions for layer (II) | Sample No./Evaluation | | | | | | | | |
|---|---|---|---|---|---|---|---|---|---|
| 12-1 | 12-201<br>○○ | 12-301<br>○○ | 12-401<br>○○ | 12-501<br>○○ | 12-601<br>○○ | 12-701<br>○○ | 12-801<br>○○ | 12-901<br>○○ | 12-1001<br>○○ |
| 12-2 | 12-202<br>○○ | 12-302<br>○○ | 12-402<br>○○ | 12-502<br>○○ | 12-602<br>○○ | 12-702<br>○○ | 12-802<br>○○ | 12-902<br>○○ | 12-1002<br>○○ |
| 12-3 | 12-203<br>○○ | 12-303<br>○○ | 12-403<br>○○ | 12-503<br>○○ | 12-603<br>○○ | 12-703<br>○○ | 12-803<br>○○ | 12-903<br>○○ | 12-1003<br>○○ |
| 12-4 | 12-204<br>⊙⊙ | 12-304<br>⊙⊙ | 12-404<br>⊙⊙ | 12-504<br>⊙⊙ | 12-604<br>⊙⊙ | 12-704<br>⊙⊙ | 12-804<br>⊙⊙ | 12-904<br>⊙⊙ | 12-1004<br>⊙⊙ |
| 12-5 | 12-205<br>⊙⊙ | 12-305<br>⊙⊙ | 12-405<br>⊙⊙ | 12-505<br>⊙⊙ | 12-605<br>⊙⊙ | 12-705<br>⊙⊙ | 12-805<br>⊙⊙ | 12-905<br>⊙⊙ | 12-1005<br>⊙⊙ |
| 12-6 | 12-206<br>⊙⊙ | 12-306<br>⊙⊙ | 12-406<br>⊙⊙ | 12-506<br>⊙⊙ | 12-606<br>⊙⊙ | 12-706<br>⊙⊙ | 12-806<br>⊙⊙ | 12-906<br>⊙⊙ | 12-1006<br>⊙⊙ |
| 12-7 | 12-207<br>○○ | 12-307<br>○○ | 12-407<br>○○ | 12-507<br>○○ | 12-607<br>○○ | 12-707<br>○○ | 12-807<br>○○ | 12-907<br>○○ | 12-1007<br>○○ |
| 12-8 | 12-208<br>○○ | 12-308<br>○○ | 12-408<br>○○ | 12-508<br>○○ | 12-608<br>○○ | 12-708<br>○○ | 12-808<br>○○ | 12-908<br>○○ | 12-1008<br>○○ |

Sample No.

Overall image evaluation — Durability evaluation

Evaluation standard:
⊙: Excellent
○ : Good

TABLE E

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4$/He = 0.05<br>$GeH_4$/He = 0.05<br>$C_2H_4$ | $SiH_4 + GeH_4 = 50$ | $GeH_4/SiH_4$ = 4/10~3/100<br>$C_2H_4/(GeH_4 + SiH_4)$ = 3/100 | 0.18 | 5 | 2 |
| | Second layer | $SiH_4$/He = 0.05<br>$GeH_4$/He = 0.05 | $SiH_4 + GeH_4 = 50$ | $GeH_4/SiH_4$ = 3/100~0 | 0.18 | 5 | 8 |
| | Third layer | $SiH_4$/He = 0.5 | $SiH_4 = 200$ | | 0.18 | 15 | 10 |
| Layer (II) | | $SiH_4$/He = 0.5<br>NO | $SiH_4 = 100$ | $SiH_4$/NO = 1 | 0.18 | 10 | 0.5 |
| Layer (I) | First layer | $SiH_4$/He = 0.05<br>$GeH_4$/He = 0.05<br>$C_2H_4$ | $SiH_4 + GeH_4 = 50$ | $GeH_4/SiH_4$ = 1/10~4/100<br>$C_2H_4/(GeH_4 + SiH_4)$ = 3/100 | 0.18 | 5 | 5 |
| | Second layer | $SiH_4$/He = 0.05<br>$GeH_4$/He = 0.05 | $SiH_4 + GeH_4 = 50$ | $GeH_4/SiH_4$ = 4/100~0 | 0.18 | 5 | 3 |
| | Third layer | $SiH_4$/He = 0.5 | $SiH_4 = 200$ | | 0.18 | 15 | 10 |
| | First layer | $SiH_4$/He = 0.05<br>$GeH_4$/He = 0.05<br>$C_2H_4$ | $SiH_4 + GeH_4 = 50$ | $GeH_4/SiH_4$ = 4/10~4/100<br>$C_2H_4/(GeH_4 + SiH_4)$ = 3/100 | 0.18 | 5 | 1 |
| | Second layer | $SiH_4$/He = 0.05<br>$GeH_4$/He = 0.05 | $SiH_4 + GeH_4 = 50$ | $GeH_4/SiH_4$ = 4/100 | 0.18 | 5 | 1 |
| | Third layer | $SiH_4$/He = 0.5 | $SiH_4 = 200$ | | 0.18 | 15 | 15 |
| | First layer | $SiH_4$/He = 0.05<br>$GeH_4$/He = 0.05<br>$C_2H_4$ | $SiH_4 + GeH_4 = 50$ | $GeH_4/SiH_4$ = 15/100~1/100<br>$C_2H_4/(GeH_4 + SiH_4)$ = 3/100 | 0.18 | 5 | 0.4 |
| | Second layer | $SiH_4$/He = 0.05<br>$GeH_4$/He = 0.05 | $SiH_4 + GeH_4 = 50$ | $GeH_4/SiH_4$ = 1/100~0 | 0.18 | 5 | 0.6 |
| | Third layer | $SiH_4$/He = 0.5 | $SiH_4 = 200$ | | 0.18 | 15 | 20 |
| | First layer | $SiH_4$/He = 0.05<br>$GeH_4$/He = 0.05<br>$C_2H_4$ | $SiH_4 + GeH_4 = 50$ | $GeH_4/SiH_4$ = 1/100~14/100<br>$C_2H_4/(GeH_4 + SiH_4)$ = 3/100 | 0.18 | 5 | 0.2 |
| | Second layer | $SiH_4$/He = 0.05<br>$GeH_4$/He = 0.05 | $SiH_4 + GeH_4 = 50$ | $GeH_4/SiH_4$ = 14/100~0 | 0.18 | 5 | 0.8 |
| | Third layer | $SiH_4$/He = 0.5 | $SiH_4 = 200$ | | 0.18 | 15 | 20 |
| | First layer | $SiH_4$/He = 0.05<br>$GeH_4$/He = 0.05<br>$C_2H_4$ | $SiH_4 + GeH_4 = 50$ | $GeH_4/SiH_4$ = 2/10~45/1000<br>$C_2H_4/(GeH_4 + SiH_4)$ = 1/100 | 0.18 | 5 | 2 |
| | Second | $SiH_4$/He = 0.05 | $SiH_4 + GeH_4 = 50$ | $GeH_4/SiH_4$ = 45/1000~0 | 0.18 | 5 | 6 |

TABLE E-continued

| | | | | | | |
|---|---|---|---|---|---|---|
| layer | $GeH_4/He = 0.05$ | | | | | |
| Third layer | $SiH_4/He = 0.5$ | $SiH_4 = 200$ | | 0.18 | 15 | 10 |
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| Third layer | $SiH_4/He = 0.5$ | $SiH_4 = 200$ | | 0.18 | 15 | 10 |
| First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| Third layer | $Si_2H_6/He = 0.5$ | $Si_2H_6 = 200$ | | 0.18 | 15 | 10 |
| First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| Third layer | $SiF_4/He = 0.5$ | $SiF_4 = 200$ | | 0.18 | 15 | 10 |
| First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 5 | 8 |
| Third layer | $SiH_4/He = 0.5$<br>$SiF_4/He = 0.5$ | $SiH_4 + SiF_4 = 200$ | | 0.18 | 15 | 10 |
| Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 | |
| Third layer | $SiH_4/He = 0.5$<br>$PH_3/He = 10^{-3}$ | $SiH_4 = 200$ | $PH_3/SiH_4 = 2 \times 10^{-5}$ | 0.18 | 15 | |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 4/10 \sim 2/100$ | 0.18 | 5 | 2 |
| Second layer | $SiH_4/He = 0.5$<br>$C_2H_4$ | $SiH_4 = 200$ | $C_2H_4/SiH_4 = 2/100 \sim 0$ | 0.18 | 15 | 2 |
| Third layer | $SiH_4/He = 0.5$ | $SiH_4 = 200$ | | 0.18 | 15 | 15 |
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| Second layer | $SiH_4/He = 0.5$<br>$C_2H_4$ | $SiH_4 = 200$ | $C_2H_4/SiH_4 = 5/100 \sim 0$ | 0.18 | 15 | 1 |
| Third layer | $SiH_4/He = 0.5$ | $SiH_4 = 200$ | | 0.18 | 15 | 18 |

| Sample No. | 1101 | 1102 | 1103 | 1104 | 1105 | 1106 | 1107 | 1108 | 1109 | 1110 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | ○ | ○ | ◎ | ◎ | ◎ | ○ | ○ | ○ | ○ | ○ |

| Sample No. | 1201 | 1202 | 1203 | 1204 | 1205 | 1206 | 1207 | 1208 | 1209 | 1210 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | ○ | ◎ | ◎ | ◎ | ◎ | ○ | ○ | ○ | ○ | ○ |

◎: Excellent
○ : Good

| Sample No. | 1601 | 1602 | 1603 | 1604 | 1605 | 1606 | 1607 |
|---|---|---|---|---|---|---|---|
| $Si:SiO_2$ Target (Area ratio) (NO/Ar) | 9:1 | 6.5:3.5 | 4:10 | 2:60 | 1:100 | 1:100 | 1:100 |

TABLE E-continued

| | (0/1) | (1/1) | (1/1) | (1/1) | (2/1) | (3/1) | (4/1) |
|---|---|---|---|---|---|---|---|
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | ○ | ◎ | ◎ | ○ | Δ | X |

◎: Very good
○ : Good
Δ: Sufficiently practically usable
X: Image defect formed

| Sample No. | 1701 | 1702 | 1703 | 1704 | 1705 | 1706 | 1707 |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999:0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

| Sample No. | 1801 | 1802 | 1803 | 1804 | 1805 | 1806 | 1807 |
|---|---|---|---|---|---|---|---|
| $SiH_4$:$SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:0.0002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○ : Good
Δ: Practically satisfactory
X: Image defect formed

| Sample No. | Thickness of layer (II) (μ) | Results |
|---|---|---|
| 1901 | 0.001 | Image defect liable to occur |
| 1902 | 0.02 | No image defect during 20,000 repetitions |
| 1903 | 0.05 | Stable for 50,000 repetitions |
| 1904 | 1 | Stable for 200,000 repetitions |

| Conditions | Gases employed | Flow rate (SCCM) | Flow rate ratio or Area ratio | Discharging power ($W/cm^2$) | Layer thickness (μ) |
|---|---|---|---|---|---|
| 15-1 | Ar(NO/Ar) | 200(1/1) | Si Wafer:$SiO_2$ = 1:30 | 0.3 | 0.5 |
| 15-2 | Ar(NO/Ar) | 200(1/1) | Si Wafer:$SiO_2$ = 1:60 | 0.3 | 0.3 |
| 15-3 | Ar(NO/Ar) | 200(1/1) | Si Wafer:$SiO_2$ = 6:4 | 0.3 | 1.0 |
| 15-4 | $SiH_4$/He = 1<br>NO | $SiH_4$ = 15 | $SiH_4$:NO = 5:1 | 0.18 | 0.3 |
| 15-5 | $SiH_4$/He = 0.5<br>NO | $SiH_4$ = 100 | $SiH_4$:NO = 1:1 | 0.18 | 1.5 |
| 15-6 | $SiH_4$/He = 0.5<br>$SiF_4$/He = 0.5<br>NO | $SiH_4$ + $SiF_4$ = 150 | $SiH_4$:$SiF_4$:NO = 1:1:1 | 0.18 | 0.5 |
| 15-7 | $SiH_4$/He =0 0.5<br>$SiF_4$/He = 0.5<br>NO | $SiH_4$ + $SiF_4$ = 15 | $SiH_4$:$SiF_4$:NO = 2:1:4 | 0.18 | 0.3 |
| 15-8 | $SiH_4$/He = 0.5<br>$SiF_4$/He = 0.5<br>NO | $SiH_4$ + $SiF_4$ = 150 | $SiH_4$:$SiF_4$:NO = 1:1:3 | 0.18 | 1.5 |

| Preparation conditions for layer (II) | Sample No./Evaluation | | | | | | | | |
|---|---|---|---|---|---|---|---|---|---|
| 15-1 | 15-201<br>○○ | 15-301<br>○○ | 15-401<br>○○ | 15-501<br>○○ | 15-601<br>○○ | 15-701<br>○○ | 15-801<br>○○ | 15-901<br>○○ | 15-1001<br>○○ |
| 15-2 | 15-202<br>○○ | 15-302<br>○○ | 15-402<br>○○ | 15-502<br>○○ | 15-602<br>○○ | 15-702<br>○○ | 15-802<br>○○ | 15-902<br>○○ | 15-1002<br>○○ |
| 15-3 | 15-203<br>○○ | 15-303<br>○○ | 15-403<br>○○ | 15-503<br>○○ | 15-603<br>○○ | 15-703<br>○○ | 15-803<br>○○ | 15-903<br>○○ | 15-1003<br>○○ |
| 15-4 | 15-204<br>◎◎ | 15-304<br>◎◎ | 15-404<br>◎◎ | 15-504<br>◎◎ | 15-604<br>◎◎ | 15-704<br>◎◎ | 15-804<br>◎◎ | 15-904<br>◎◎ | 15-1004<br>◎◎ |
| 15-5 | 15-205<br>◎◎ | 15-305<br>◎◎ | 15-405<br>◎◎ | 15-505<br>◎◎ | 15-605<br>◎◎ | 15-705<br>◎◎ | 15-805<br>◎◎ | 15-905<br>◎◎ | 15-1005<br>◎◎ |
| 15-6 | 15-206<br>◎◎ | 15-306<br>◎◎ | 15-406<br>◎◎ | 15-506<br>◎◎ | 15-606<br>◎◎ | 15-706<br>◎◎ | 15-806<br>◎◎ | 15-906<br>◎◎ | 15-1006<br>◎◎ |
| 15-7 | 15-207<br>○○ | 15-307<br>○○ | 15-407<br>○○ | 15-507<br>○○ | 15-607<br>○○ | 15-707<br>○○ | 15-807<br>○○ | 15-907<br>○○ | 15-1007<br>○○ |
| 15-8 | 15-208<br>○○ | 15-308<br>○○ | 15-408<br>○○ | 15-508<br>○○ | 15-608<br>○○ | 15-708<br>○○ | 15-808<br>○○ | 15-908<br>○○ | 15-1008<br>○○ |

| No. | |
|---|---|
| Overall image evaluation | Durability evaluation |

Evaluation standard:
◎. . . Excellent
○ . . . Good

TABLE F-1

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4$/He = 0.05<br>$GeH_4$/He = 0.05 | $SiH_4$ + $GeH_4$ = 50 | $GeH_4$/$SiH_4$ = 4/10~0<br>$B_2H_6$/($GeH_4$ + $SiH_4$) = | 0.18 | 5 | 1 |

TABLE F-1-continued

| | | | | | | | |
|---|---|---|---|---|---|---|---|
| | | $B_2H_6/He = 10^{-3}$<br>$C_2H_4$ | | $3/10^{-3}$<br>$C_2H_4/(GeH_4 + SiH_4) = 3/100$ | | | |
| | Second layer | $SiH_4/He = 0.5$ | $SiH_4 = 200$ | | 0.18 | 15 | 19 |
| Layer II | | $SiH_4/He = 0.5$<br>NO | $SiH_4 = 100$ | $SiH_4/NO = 1$ | 0.18 | 10 | 0.5 |
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 15/100 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 2/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |
| | First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| | Second layer | $Si_2H_6/He = 0.5$ | $Si_2H_6 = 200$ | | 0.18 | 15 | 19 |
| | First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| | Second layer | $SiF_4/He = 0.05$ | $SiF_4 = 200$ | | 0.18 | 5 | 19 |
| | First layer | $SiH_4/He = 0.05$<br>$SiF_4/He = 0.05$<br>$GeH_4/He = 0.05$<br>$B_2H_6/He = 10^{-3}$<br>$C_2H_4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(GeH_4 + SiH_4 + SiF_4)$<br>1/100 | 0.18 | 5 | 1 |
| | Second layer | $SiH_4/He = 0.5$<br>$SiF_4/He = 0.5$ | $SiH_4 + SiF_4 = 200$ | | 0.18 | 5 | 19 |
| | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |
| | Second layer | $SiH_4/He = 0.5$<br>$B_2H_6/He = 10^{-3}$ | $SiH_4 = 200$ | $B_2H_6/SiH_4 = 3 \times 10^{-3}$ | 0.18 | 15 | 19 |
| Layer II | | $SiH_4/He = 0.5$<br>NO | $SiH_4 = 100$ | $SiH_4/NO = 1$ | 0.18 | 10 | 0.5 |
| Second layer | | $SiH_4/He = 0.5$<br>$B_2H_6/He = 10^{-3}$ | $SiH_4 = 200$ | $B_2H_6/SiH_4 = 8 \times 10^{-5}$ | 0.18 | 15 | |
| Second layer | | $SiH_4/He = 0.5$<br>$PH_3/He = 10^{-3}$ | $SiH_4 = 200$ | $PH_3/SiH_4 = 1 \times 10^{-5}$ | 0.18 | 15 | |

| Sample No. | 1201 | 1202 | 1203 | 1204 | 1205 | 1206 | 1207 | 1208 |
|---|---|---|---|---|---|---|---|---|
| $B_2H_6/SiH_4$ (Flow rate ratio) | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B Content (atomic ppm) | $1 \times 10^4$ | $6 \times 10^3$ | $2.5 \times 10^3$ | $1 \times 10^3$ | 800 | 500 | 300 | 100 |

TABLE F-1-continued

Image quality evaluation

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | ○ | ○ | ◎ | ◎ | ◎ | ◎ | ○ | ○ | ○ | ○ |

◎: Excellent
○ : Good

| Sample No. | 1601 | 1602 | 1603 | 1604 | 1605 | 1606 | 1607 |
|---|---|---|---|---|---|---|---|
| $Si:SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○ : Good
Δ: Sufficiently practically usable
X: Image defect formed

| Sample No. | 1701 | 1702 | 1703 | 1704 | 1705 | 1706 | 1707 |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999:0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

| Sample No. | 1801 | 1802 | 1803 | 1804 | 1805 | 1806 | 1807 |
|---|---|---|---|---|---|---|---|
| $SiH_4$:$SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:0.0002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○ : Good
Δ: Practically satisfactory
X: Image defect formed

| Sample No. | Thickness of layer (II) (μ) | Results |
|---|---|---|
| 1901 | 0.001 | Image defect liable to occur |
| 1902 | 0.02 | No image defect during 20,000 repetitions |
| 1903 | 0.05 | Stable for 50,000 repetitions |
| 1904 | 1 | Stable for 200,000 repetitions |

| Conditions | Gases employed | Flow rate (SCCM) | Flow rate ratio or Area ratio | Discharging power ($W/cm^2$) | Layer thickness (μ) |
|---|---|---|---|---|---|
| 15-1 | Ar(NO/Ar) | 200(1/1) | Si Wafer:$SiO_2$ = 1:30 | 0.3 | 0.5 |
| 15-2 | Ar(NO/Ar) | 200(1/1) | Si Wafer:$SiO_2$ = 1:60 | 0.3 | 0.3 |
| 15-3 | Ar(NO/Ar) | 200(1/1) | Si Wafer:$SiO_2$ = 6:4 | 0.3 | 1.0 |
| 15-4 | $SiH_4$/He = 1<br>NO | $SiH_4$ = 15 | $SiH_4$:NO = 5:1 | 0.18 | 0.3 |
| 15-5 | $SiH_4$/He = 0.5<br>NO | $SiH_4$ = 100 | $SiH_4$:NO = 1:1 | 0.18 | 1.5 |
| 15-6 | $SiH_4$/He = 0.5<br>$SiF_4$/He = 0.5<br>NO | $SiH_4$ = $SiF_4$ = 150 | $SiH_4$:$SiF_4$:NO = 1:1:1 | 0.18 | 0.5 |
| 15-7 | $SiH_4$/He = 0.5<br>$SiF_4$/He = 0.5<br>NO | $SiH_4$ + $SiF_4$ = 15 | $SiH_4$:$SiF_4$:NO = 2:1:4 | 0.18 | 0.3 |
| 15-8 | $SiH_4$/He = 0.5<br>$SiF_4$/He = 0.5<br>NO | $SiH_4$ + $SiF_4$ = 150 | $SiH_4$:$SiF_4$:NO = 1:1:3 | 0.18 | 1.5 |

Preparation conditions for layer (II) — Sample No./Evaluation

TABLE F-1-continued

| | | | | | | | | | |
|---|---|---|---|---|---|---|---|---|---|
| 15-1 | 15-201 | 15-301 | 15-401 | 15-501 | 15-601 | 15-701 | 15-801 | 15-901 | 15-1001 |
| 15-2 | 15-202 | 15-302 | 15-402 | 15-502 | 15-602 | 15-702 | 15-802 | 15-902 | 15-1002 |
| 15-3 | 15-203 | 15-303 | 15-403 | 15-503 | 15-603 | 15-703 | 15-803 | 15-903 | 15-1003 |
| 15-4 | 15-204 | 15-304 | 15-404 | 15-504 | 15-604 | 15-704 | 15-804 | 15-904 | 15-1004 |
| 15-5 | 15-205 | 15-305 | 15-405 | 15-505 | 15-605 | 15-705 | 15-805 | 15-905 | 15-1005 |
| 15-6 | 15-206 | 15-306 | 15-406 | 15-506 | 15-606 | 15-706 | 15-806 | 15-906 | 15-1006 |
| 15-7 | 15-207 | 15-307 | 15-407 | 15-507 | 15-607 | 15-707 | 15-807 | 15-907 | 15-1007 |
| 15-8 | 15-208 | 15-308 | 15-408 | 15-508 | 15-608 | 15-708 | 15-808 | 15-908 | 15-1008 |

Sample No.

Overall image evaluation — Durability evaluation

Evaluation standard:
◎. . . Excellent
○ . . . Good

What is claimed is:

1. A photoconductive member which comprises a support for a photoconductive member and a light receiving layer constituted of a first layer region (G) comprising an amorphous material containing silicon atoms germanium atoms and at least one of hydrogen atoms and halogen atoms and a second layer region (S) comprising an amorphours material containing silicon atoms and at least one of hydrogen atoms and halogen atoms and exhibiting photoconductivity, the first layer region (G) and the second layer region (S) being provided in sequence on the support, germanium atoms being contained in the first layer region (G) in such a nonuniform distribution state that germanium atoms are enriched at the support side, and carbon atoms being contained in the light receiving layer in an amount of 0.001 to 50 atomic %.

2. A photoconductive member according to claim 1 in which hydrogen atoms are contained in at least one of the first layer region (G) and the second layer region (S).

3. A photoconductive member according to claim 1 in which halogen atoms are contained in at least one of the first layer region (G) and the second layer region (S).

4. A photoconductive member according to claim 1 in which the first distribution of germanium atoms in the first layer region (G) is such that germanium atoms are enriched at the substrate side.

5. A photoconductive member according to claim 1 in which hydrogen atoms and halogen atoms are contained in at least one of the first layer region (G) and the second layer region (S).

6. A photoconductive member according to claim 1 in which a substance for controlling conductivity is contained in at least one of the first layer region (G) and the second layer region (S).

7. A photoconductive member according to claim 6 in which hydrogen atoms are contained in at least one of the first layer region (G) and the second layer region (S).

8. A photoconductive member according to claim 6 in which halogen atoms are contained in at least one of the first layer region (G) and the second layer region (S).

9. A photoconductive member according to claim 6 in which hydrogen atoms and halogen atoms are contained in at least one of the first layer region (G) and the second layer region (S).

10. A photoconductive member according to claim 6 in which the distribution of germanium atoms in the first layer region (G) is such that germanium atoms are enriched at the substrate side.

11. A photoconductive member according to claim 6 in which the substance for controlling conductivity is an atom belonging to Group III of the Periodic Table.

12. A photoconductive member according to claim 6 in which the substance for controlling conductivity is an atom belonging to Group V of the Periodic Table.

13. A photoconductive member which comprises a support for a photoconductive member and a light receiving layer comprising a first layer constituted of a first layer region (G) comprising an amorphous material containing silicon atoms, germanium atoms and at least one of hydrogen atoms and halogen atoms and a second layer region (S) comprising an amorphous material containing silicon atoms and at least one of hydrogen atoms and halogen atoms and exhibiting photoconductivity, the first layer region (G) and the second layer region (S) being provided in sequence on the support, and a second layer comprising an amorphous material containing silicon atoms as the matrix and at least one of nitrogen atoms and oxygen atoms, the distribution of germanium atoms in the first layer region (G) being ununiform in the direction of layer thickness, and carbon atoms being contained in the first layer.

14. A photoconductive member according to claim 13 in which hydrogen atoms are contained in at least one of the first layer region (G) and the second layer region (S).

15. A photoconductive member according to claim 13 in which halogen atoms are contained in at least one of the first layer region (G) and the seocnd layer region (S).

16. A photoconductive member according to claim 13 in which hydrogen atoms and halogen atoms are contained in at least one of the first layer region (G) and the second layer region(S).

17. A photoconductive member according to claim 13 in which the distribution of germanium atoms in the first layer region (G) is such that germanium atoms are enriched at the substrate side.

18. A photoconductive member according to claim 13 in which a substance for controlling conductivity is contained in at least one of the first layer region (G) and the second layer region (S).

19. A photoconductive member according to claim 18 in which hydrogen atoms are contained in at least one of the first layer region (G) and the second layer region (S).

20. A photoconductive member according to claim 18 in which halogen atoms are contained in at least one of the first layer region (G) and the second layer region (S).

21. A photoconductive member according to claim 18 in which hydrogen atoms and halogen atoms are contained in at least one of the first layer region (G) and the second layer region (S).

22. A photoconductive member according to claim 18 in which the distribution of germanium atoms in the first layer region (G) is such that germanium atoms are enriched at the substrate side.

23. A photoconductive member according to claim 18 in which the substance for controlling conductivity is an atom of Group III of the Periodic Table.

24. A photoconductive member according to claim 18 in which the substance for controlling conductivity is an atom of Group V of the Periorid Table.

25. A photoconductive member according to claim 1 in which the amount of carbon atoms contained in the light receiving layer is 0.001–50 atomic %.

26. A photoconductive member according to claim 13 in which the amount of carbon atoms contained in the first layer is 0.001–50 atomic %.

27. A photoconductive member according to claim 1 in which the content of germanium atoms in the first layer region (G) is $1–9.5\times10^5$ atomic ppm.

28. A photoconductive member according to claim 1 in which the layer thickness of the first layer region (G) is 30 Å–50μ.

29. A photoconductive member according to claim 1 in which the layer thickness of the second layer region (S) is 0.5–90μ.

30. A photoconductive member according to claim 1 in which the layer thickness of the light receiving layer is 1–100μ.

31. A photoconductive member according to claim 13 in which the layer thickness of the first layer is 1–100μ.

32. A photoconductive member according to claim 2 in which the content of hydrogen atoms in the first layer region (G) is 0.01–40 atomic %.

33. A photoconductive member according to claim 3 in which the content of halogen atoms in the first layer region (G) is 0.01–40 atomic %.

34. A photoconductive member according to claim 5 in which the content of hydrogen atoms and halogen atoms in the first layer region (G) is 0.01–40 atomic %.

35. A photoconductive member according to claim 2 in which the content of hydrogen atoms in the second layer region (S) is 1–40 atomic %.

36. A photoconductive member according to claim 3 in which the content of halogen atoms in the second layer region (S) is 1–40 atomic %.

37. A photoconductive member according to claim 5 in which the content of hydrogen atoms and halogen atoms in the second layer region (S) is 1–40 atomic %

38. A photoconductive member according to claim 6 in which the content of the substance for controlling conductivity is $0.01–5\times10^4$ atomic ppm.

39. A photoconductive member according to claim 1 in which the light receiving layer has a layer region (PN) containing a substance (C) for controlling conductivity.

40. A photoconductive member according to claim 13 in which the first layer has a layer region (PN) containing a substance (C) for controlling conductivity.

41. A photoconductive member according to claim 39 in which the amount of the substance (C) for controlling conductivity contained in the layer region (PN) is $0.01–5\times10^4$ atomic ppm.

42. A photoconductive member according to claim 39 in which there is contained in a layer region (Z) other than the layer region (PN) a substance (C) for controlling conductivity characteristics which has a polarity of conductivity type opposite to that of the substance (C) for controlling conductivity characteristics contained in the layer region (PN).

43. A photoconductive member according to claim 42 in which the amount of the substance (C) contained in the layer region (Z) is less than that of the substance (C) contained in the layer region (PN).

44. A photoconductive member according to claim 42 in which the content of the substance (C) contained in the layer region (Z) us 0.001–1000 atomic ppm.

45. A photoconductive member according to claim 13 in which the layer thickness of the second layer is 0.003–30μ.

46. A photoconductive membre according to claim 13 in which hydrogen atoms are contained in the second layer.

47. A photoconductive member according to claim 13 in which halogen atoms are contained in the second layer.

48. A photoconductive member according to claim 13 in which hydrogen atoms and halogen atoms are contained in the second layer.

49. A photoconductive member according to claim 13 in which the content of germanium atoms in the first layer region (G) is $1–9.5\times10^5$ atomic ppm.

50. A photoconductive member according to claim 13 in which the layer thickness of the first layer region (G) is 30 Å–50μ.

51. A photoconductive member according to claim 13 in which the layer thickness of the second layer region(S) is 0.5–90μ.

52. A photoconductive member according to claim 14 in which the content of hydrogen atoms in the first layer region (G) is 0.01–40 atomic %.

53. A photoconductive member according to claim 15 in which the content of halogen atoms in the first layer region (G) is 0.01–40 atomic %.

54. A photoconductive member according to claim 16 in which the content of hydrogen atoms and halogen atoms in the first layer region (G) is 0.01–40 atomic %.

55. A photoconductive member according to claim 14 in which the content of hydrogen atoms in the second layer region (S) is 1–40 atomic %.

56. A photoconductive member according to claim 15 in which the content of halogen atoms in the second layer region (S) is 1–40 atomic %.

57. A photoconductive member according to claim 16 in which the content of hydrogen atoms and halogen atoms in the second layer region (S) is 1–40 atomic %

58. A photoconductive member according to claim 18 in which the content of the substance for controlling conductivity is $0.01–5\times10^4$ atomic ppm.

59. A photoconductive member according to claim 40 in which the amount of the substance (C) for controlling conductivity contained in the layer region (PN) is $0.01-5\times10^4$ atomic ppm.

60. A photoconductive member according to claim 40 in which there is contained in a layer region (Z) other than the layer region (PN) a substance (C) for controlling conductivity characteristics which has a polarity of conductivity type opposite to that of the substance (C) for controlling conductivity characteristics contained in the layer region (PN).

61. A photoconductive member according to claim 1, wherein the distribution state of carbon atoms is nonuniform in the layer thickness direction.

62. A photoconductive member according to claim 13, wherein the distribution state of carbon atoms is nonuniform in the layer thickness direction.

* * * * *

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

COLUMN 5

Line 54, "(I) 02" should read --(I) 202--.

COLUMN 9

Line 37, "and" should read --end--.

COLUMN 13

Line 63, "from" should read --form--.

COLUMN 14

Line 66, "(n-$C_4H_{10}$) pentane" should read --(n-$C_4H_{10}$), pentane--.

COLUMN 19

Line 51, "halo-/gen atoms (hereinafter" should read --halogen atoms (X) (hereinafter--.

COLUMN 21

Line 42, "each" should read --easy--.

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

COLUMN 22

Line 15, "The starging material" should read --The starting material--.

Line 48-49, "a-/$(Si_xN_{1-x})_{1-y}(H,X)_{1-y}$" should read --a-$(Si_xN_{1-x})_y(H,X)_{1-y}$--.

Line 67, "a-$(Si_xN_{1-x})_{1-y}(H,X)_{1-y}$" should read --a-$(Si_xN_{1-x})_y(H,X)_{1-y}$--.

COLUMN 24

Line 28, "a-$Si_dN_{1-d})_e(H,X)_{1-e}$, should " should read --a-$(Si_dN_{1-d})_e(H,X)_{1-e}$, d should--.

COLUMN 25

Line 63, "oxygen atoms (N)" should read --oxygen atoms (O)--.

COLUMN 28

Line 30, "a-$(Si_bO_{1\ \ 1-b})_c/H_{1-c}$," should read --a-$(Si_bO_{1-b})_cH_{1-c}$,--.

COLUMN 29

Line 65, "inflIow" should read --inflow--.

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

COLUMN 31

Line 15, "SiH4" should read --$SiH_4$--.

COLUMN 33

Line 54, "$SiF_4$/He gas" should read --$SiF_4$/He) gas--.

COLUMN 37

Line 18, "$SiF_4$/He gas" should read --$SiF_4$/He) gas--.

COLUMN 40

Line 33, "that ($SiF_4$/He" should read --that $SiF_4$/He--.

COLUMN 41

Line 50, "layer" should read --laser--.

Signed and Sealed this

Twenty-second Day of December, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

Tables A-1 to A-14, Tables B-1 to B-14A, Tables C-1 to C-19, Tables D-1 to D-19, Tables E-1 to E-19 and Tables F-1 to F-19, should appear as shown on the attached sheets.

TABLE A-1

| Layer Constitution | Gases employed | Flow rate (SCCM) | Flow rate ratio | Discharging power ($W/cm^2$) | Layer formation rate (Å/sec) | Layer thickness ($\mu$) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 4/10 \sim 3/100$<br>$C_2H_4/(GeH_4 + SiH_4) = 3/100$ | 0.18 | 5 | 2 |
| Second layer | $SiH_4/He = 0.05$<br>$GeH_4/He = 0.05$ | $SiH_4 + GeH_4 = 50$ | $GeH_4/SiH_4 = 3/100 \sim 0$ | 0.18 | 5 | 8 |
| Third layer | $SiH_4/He = 0.5$ | $SiH_4 = 200$ | | 0.18 | 15 | 10 |

TABLE A-2

| Layer Constitution | Gases employed | Flow rate (SCCM) | Flow rate ratio | Discharging power ($W/cm^2$) | Layer formation rate (Å/sec) | Layer thickness ($\mu$) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 4/100$<br>$C_2H_4/(GeH_4 + SiH_4) = 3/100$ | 0.18 | 5 | 5 |
| Second layer | $SiH_4/He = 0.05$<br>$GeH_4/He = 0.05$ | $SiH_4 + GeH_4 = 50$ | $GeH_4/SiH_4 = 4/100 \sim 0$ | 0.18 | 5 | 3 |
| Third layer | $SiH_4/He = 0.5$ | $SiH_4 = 200$ | | 0.18 | 15 | 10 |

TABLE A-3

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 4/10 \sim 4/100$<br>$C_2H_4/(GeH_4 + SiH_4) = 3/100$ | 0.18 | 5 | 1 |
| Second layer | $SiH_4/He = 0.05$<br>$GeH_4/He = 0.05$ | $SiH_4 + GeH_4 = 50$ | $GeH_4/SiH_4 = 4/100$ | 0.18 | 5 | 1 |
| Third layer | $SiH_4/He = 0.5$ | $SiH_4 = 200$ | | 0.18 | 15 | 15 |

TABLE A-4

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 15/100 \sim 1/100$<br>$C_2H_4/(GeH_4 + SiH_4) = 3/100$ | 0.18 | 5 | 0.4 |
| Second layer | $SiH_4/He = 0.05$<br>$GeH_4/He = 0.05$ | $SiH_4 + GeH_4 = 50$ | $GeH_4/SiH_4 = 1/100 \sim 0$ | 0.18 | 5 | 0.6 |
| Third layer | $SiH_4/He = 0.5$ | $SiH_4 = 200$ | | 0.18 | 15 | 20 |

TABLE A-5

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 1/1 \sim 14/100$<br>$C_2H_4/(GeH_4 + SiH_4) = 3/100$ | 0.18 | 5 | 0.2 |
| Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| Third layer | $SiH_4/He = 0.5$ | $SiH_4 = 200$ | | 0.18 | 15 | 20 |

TABLE A-6

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 2/10 \sim 45/1000$<br>$C_2H_4/(GeH_4 + SiH_4) = 1/100$ | 0.18 | 5 | 2 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| Third layer | $SiH_4/He = 0.5$ | $SiH_4 = 200$ | | 0.18 | 15 | 10 |

TABLE A-7

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| Third layer | $SiH_4/He = 0.5$ | $SiH_4 = 200$ | | 0.18 | 15 | 10 |

TABLE A-8

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| Third layer | $Si_2H_6/He = 0.5$ | $Si_2H_6 = 200$ | | 0.18 | 15 | 10 |

TABLE A-9

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| Third layer | $SiF_4/He = 0.5$ | $GeF_4 = 200$ | | 0.18 | 15 | 10 |

TABLE A-10

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 15 | 8 |
| Third layer | $SiH_4/He = 0.5$<br>$SiF_4/He = 0.5$ | $SiH_4 + SiF_4 = 200$ | | 0.18 | 15 | 10 |

TABLE A-11

| Layer Constitution | Gases employed | Flow rate (SCCM) | Flow rate ratio | Discharging power ($W/cm^2$) | Layer formation rate (Å/sec) |
|---|---|---|---|---|---|
| Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 |

TABLE A-11A

| Sample No. | 1101 | 1102 | 1103 | 1104 | 1105 | 1106 | 1107 | 1108 | 1109 | 1110 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | | | | | | | | | | |

: Excellent
: Good

TABLE A-12

| Layer Constitution | Gases employed | Flow rate (SCCM) | Flow rate ratio | Discharging power ($W/cm^2$) | Layer formation rate (Å/sec) |
|---|---|---|---|---|---|
| Third | $SiH_4/He = 0.5$ | $SiH_4 = 200$ | $PH_3/SiH_4 = 2 \times 10^{-4}$ | 0.18 | 15 |

TABLE A-12-continued

| Layer Constitution | Gases employed | Flow rate (SCCM) | Flow rate ratio | Discharging power (W/cm²) | Layer formation rate (Å/sec) |
|---|---|---|---|---|---|
| layer | $PH_3/He = 10^{-3}$ | | | | |

TABLE A-12A

| Sample No. | 1201 | 1202 | 1203 | 1204 | 1205 | 1206 | 1207 | 1208 | 1209 | 1210 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | | | | | | | | | | |

: Excellent
: Good

TABLE A-13

| Layer Constitution | Gases employed | Flow rate (SCCM) | Flow rate ratio | Discharging power (W/cm²) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiF_4 = 3/10 \sim 0$<br>$C_2H_4/SiH_4 = 4/10 \sim 2/100$ | 0.18 | 5 | 2 |
| Second layer | $SiH_4/He = 0.5$<br>$C_2H_4$ | $SiH_4 = 200$ | $C_2H_4/SiH_4 = 2/100 \sim 0$ | 0.18 | 5 | 2 |
| Third layer | $SiH_4/He = 0.5$ | $SiH_4 = 200$ | | 0.18 | 15 | 15 |

TABLE A-14

| Layer Constitution | Gases employed | Flow rate (SCCM) | Flow rate ratio | Discharging power (W/cm²) | Layer formation rate (Å/sec) | Layer thickness (μ) |
|---|---|---|---|---|---|---|
| First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| Second layer | $SiH_4/He = 0.5$<br>$C_2H_4$ | $SiH_4 = 200$ | $C_2H_4/SiH_4 = 5/100 \sim 0$ | 0.18 | 15 | 1 |
| Third layer | $SiH_4/He = 0.5$ | $SiH_4 = 200$ | | 0.18 | 15 | 18 |

TABLE B-1

| Layer Constitution | Gases employed | Flow rate (SCCM) | Flow rate ratio | Discharging power (W/cm²) | Layer formation rate (Å/sec) | Layer thickness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |
| Second layer | $SiH_4/He = 0.5$ | $SiH_4 = 200$ | | 0.18 | 15 | 19 |

TABLE B-2

| Layer Constitution | Gases employed | Flow rate (SCCM) | Flow rate ratio | Discharging power (W/cm²) | Layer formation rate (Å/sec) | Layer thickness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 1/100$ | 0.18 | 5 | 2 |
| Second | $SiH_4/He = 0.5$ | $SiH_4 = 200$ | | 0.18 | 15 | 15 |

TABLE B-2-continued

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| layer | | | | | | |

TABLE B-3

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| Second layer | $SiH_4/He = 0.5$ | $SiH_4 = 200$ | | 0.18 | 15 | 15 |

TABLE B-4

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 15/100 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |

TABLE B-5

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |

TABLE B-6

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 2/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |

TABLE B-7

| Layer Consti-tution | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| Second layer | $SiH_4/He = 0.5$ | $SiH_4 = 200$ | | 0.18 | 15 | 15 |

TABLE B-8

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| Second layer | $Si_2H_6/He = 0.5$ | $Si_2H_6 = 200$ | | 0.18 | 15 | 19 |

TABLE B-9

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| Second layer | $SiF_4/He = 0.05$ | $SiF_4 = 200$ | | 0.18 | 15 | 19 |

TABLE B-10

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$SiF_4/He = 0.05$<br>$GeH_4/He = 0.05$<br>$B_2H_6/He = 10^{-3}$<br>$C_2H_4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(GeH_4 + SiH_4 + SiF_4) = 1/100$ | 0.18 | 5 | 1 |
| Second layer | $SiH_4/He = 0.5$<br>$SiF_4/He = 0.5$ | $SiH_4 + SiF_4 = 200$ | | 0.18 | 5 | 19 |

TABLE B-11

| Layer Constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |
| Second layer | $SiH_4/He = 0.5$<br>$B_2H_6/He = 10^{-3}$ | $SiH_4 = 200$ | $B_2H_6/SiH_4 = 3 \times 10^{-3}$ | 0.18 | 15 | 19 |

TABLE B-12

| Sample No. | 1201 | 1202 | 1203 | 1204 | 1205 | 1206 | 1207 | 1208 |
|---|---|---|---|---|---|---|---|---|
| $B_2H_6/SiH_4$ Flow rate ratio | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B content (atomic/ppm) | $1 \times 10^4$ | $6 \times 10^3$ | $2.5 \times 10^3$ | $1 \times 10^3$ | 800 | 500 | 300 | 100 |
| Evaluation | | | | | | | | |

: Excellent
: Good

TABLE B-13

| Layer Constitution | Gases employed | Flow rate (SCCM) | Flow rate ratio | Discharging power ($W/cm^2$) | Layer formation rate (Å/sec) |
|---|---|---|---|---|---|
| Second layer | $SiH_4/He = 0.5$<br>$B_2H_6/He = 10^{-3}$ | $SiH_4 = 200$ | $B_2H_6/SiH_4 = 8 \times 10^{-5}$ | 0.18 | 15 |

TABLE B-13A

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | | | | | | | | | | |

: Excellent
: Good

TABLE B-14

| Layer Constitution | Gases employed | Flow rate (SCCM) | Flow rate ratio | Discharging power (W/cm²) | Layer formation rate (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 1 \times 10^{-5}$ | 0.18 | 15 |

TABLE B-14A

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evaluation | | | | | | | | | | |

: Excellent
: Good

TABLE C-1

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 4/10 \sim 3/100$<br>$C_2H_4/(GeH_4 + SiH_4) = 3/100$ | 0.18 | 5 | 2 |
| | Second layer | $SiH_4/He = 0.05$<br>$GeH_4/He = 0.05$ | $SiH_4 + GeH_4 = 50$ | $GeH_4/SiH_4 = 3/100 \sim 0$ | 0.18 | 5 | 8 |
| | Third layer | $SiH_4/He = 0.5$ | $SiH_4 = 200$ | | 0.18 | 15 | 10 |
| Layer (II) | | $SiH_4/He = 0.5$<br>$NH_3$ | $SiH_4 = 100$ | $SiH_4/NH_3 = 1/30$ | 0.18 | 10 | 0.5 |

TABLE C-2

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 4/100$<br>$C_2H_4/(GeH_4 + SiH_4) = 3/100$ | 0.18 | 5 | 5 |
| | Second layer | $SiH_4/He = 0.05$<br>$GeH_4/He = 0.05$ | $SiH_4 + GeH_4 = 50$ | $GeH_4/SiH_4 = 4/100 \sim 0$ | 0.18 | 5 | 3 |
| | Third layer | $SiH_4/He = 0.5$ | $SiH_4 = 200$ | | 0.18 | 15 | 10 |

TABLE C-3

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 4/10 \sim 4/100$<br>$C_2H_4/(GeH_4 + SiH_4) = 3/100$ | 0.18 | 5 | 1 |
| | Second layer | $SiH_4/He = 0.05$<br>$GeH_4/He = 0.05$ | $SiH_4 + GeH_4 = 50$ | $GeH_4/SiH_4 = 4/100$ | 0.18 | 5 | 1 |
| | Third layer | $SiH_4/He = 0.5$ | $SiH_4 = 200$ | | 0.18 | 15 | 15 |

TABLE C-4

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 15/100 \sim 1/100$<br>$C_2H_4/(GeH_4 + SiH_4) = 3/100$ | 0.18 | 5 | 0.4 |
| | Second layer | $SiH_4/He = 0.05$<br>$GeH_4/He = 0.05$ | $SiH_4 + GeH_4 = 50$ | $GeH_4/SiH_4 = 1/100 \sim 0$ | 0.18 | 5 | 0.6 |
| | Third layer | $SiH_4/He = 0.5$ | $SiH_4 = 200$ | | 0.18 | 15 | 20 |

TABLE C-5

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 14/100$<br>$C_2H_4/(GeH_4 + SiH_4) = 3/100$ | 0.18 | 5 | 0.2 |
| | Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| | Third layer | $SiH_4/He = 0.5$ | $SiH_4 = 200$ | | 0.18 | 15 | 20 |

TABLE C-6

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 2/10 \sim 45/1000$<br>$C_2H_4/(GeH_4 + SiH_4) = 1/100$ | 0.18 | 5 | 2 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| | Third layer | $SiH_4/He = 0.5$ | $SiH_4 = 200$ | | 0.18 | 15 | 10 |

TABLE C-7

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| | Third layer | $SiH_4/He = 0.5$ | $SiH_4 = 200$ | | 0.18 | 15 | 10 |

TABLE C-8

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| | Second layer | $Si_2H_6/He = 0.05$<br>$GeH_4/He = 0.05$ | $Si_2H_6 + GeH_4 = 50$ | $GeH_4/Si_2H_6 = 3/100 \sim 0$ | 0.18 | 5 | 8 |
| | Third layer | $Si_2H_6/He = 0.5$ | $Si_2H_6 = 200$ | | 0.18 | 15 | 10 |

TABLE C-9

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| | Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| | Third layer | $SiF_4/He = 0.5$ | $SiF_4 = 200$ | | 0.18 | 15 | 10 |

TABLE C-10

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| | Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 5 | 8 |
| | Third layer | $SiH_4/He = 0.5$<br>$SiF_4/He = 0.5$ | $SiH_4 + SiF_4 = 200$ | | 0.18 | 15 | 10 |

TABLE C-11

| Layer Constitution | | Gases employed | Flow rate (SCCM) | Flow rate ratio | Dis-charging power ($W/cm^2$) | Layer formation rate (Å/sec) |
|---|---|---|---|---|---|---|
| Layer (I) | Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 |

TABLE C-11A

| Sample No. | | 1101 | 1102 | 1103 | 1104 | 1105 | 1106 | 1107 | 1108 | 1109 | 1110 |
|---|---|---|---|---|---|---|---|---|---|---|---|
| Layer (I) | First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| | Thick-ness of third layer (μ) | 10 | 10 | 15 | 20 | 20 | 10 | 10 | 10 | 10 | 10 |
| Evaluation | | | | | | | | | | | |

: Excellent
: Good

TABLE C-12

| Layer Constitution | | Gases employed | Flow rate (SCCM) | Flow rate ratio | Discharging power (W/cm²) | Layer formation rate (Å/sec) |
|---|---|---|---|---|---|---|
| Layer (I) | Third layer | $SiH_4/He = 0.5$<br>$PH_3/He = 10^{-3}$ | $SiH_4 = 200$ | $PH_3/SiH_4 = 2 \times 10^{-5}$ | 0.18 | 15 |

TABLE C-12A

| Sample No. | | 1201 | 1202 | 1203 | 1204 | 1205 | 1206 | 1207 | 1208 | 1209 | 1210 |
|---|---|---|---|---|---|---|---|---|---|---|---|
| Layer (I) | First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| | Thickness of third layer (μ) | 10 | 10 | 15 | 20 | 20 | 10 | 10 | 10 | 10 | 10 |
| Evaluation | | | | | | | | | | | |

: Excellent
: Good

TABLE C-13

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 4/10 \sim 2/100$ | 0.18 | 5 | 2 |
| | Second layer | $SiH_4/He = 0.05$<br>$C_2H_4$ | $SiH_4 = 200$ | $C_2H_4/SiH_4 = 2/100 \sim 0$ | 0.18 | 15 | 2 |
| | Third layer | $SiH_4/He = 0.5$ | $SiH_4 = 200$ | | 0.18 | 15 | 15 |

TABLE C-14

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| | Second layer | $SiH_4/He = 0.05$<br>$C_2H_4$ | $SiH_4 = 200$ | $C_2H_4/SiH_4 = 5/100 \sim 0$ | 0.18 | 15 | 1 |
| | Third layer | $SiH_4/He = 0.5$ | $SiH_4 = 200$ | | 0.18 | 15 | 18 |

TABLE C-15

| Conditions | Gases employed | Flow rate (SCCM) | Flow rate ratio or Area ratio | Discharging power (W/cm²) | Layer thickness (μ) |
|---|---|---|---|---|---|
| 12-1 | $Ar(NH_3/Ar)$ | 200(1/1) | Si Wafer:Silicon nitride = 1:30 | 0.3 | 0.5 |
| 12-2 | $Ar(NH_3/Ar)$ | 200(1/1) | Si Wafer:Silicon nitride = 1:30 | 0.3 | 0.3 |
| 12-3 | $Ar(NH_3/Ar)$ | 200(1/1) | Si Wafer:Silicon nitride = 6:4 | 0.3 | 1.0 |
| 12-4 | $SiH_4/He = 1$<br>$NH_3$ | $SiH_4 = 15$ | $SiH_4:NH_3 = 1:100$ | 0.18 | 0.3 |
| 12-5 | $SiH_4/He = 0.5$<br>$NH_3$ | $SiH_4 = 100$ | $SiH_4:NH_3 = 1:30$ | 0.18 | 1.5 |
| 12-6 | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 12-7 | $SiH_4/He = 0.5$<br>$SiF_4/He = 0.5$<br>$NH_3$ | $SiH_4 + SiF_4 = 15$ | $SiH_4:SiF_4:NH_3 = 2:1:90$ | 0.18 | 0.3 |
| 12-8 | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE C-15A

| Preparation conditions for layer (II) | Sample No./Evaluation | | | | | | | | |
|---|---|---|---|---|---|---|---|---|---|
| 12-1 | 12-201 | 12-301 | 12-401 | 12-501 | 12-601 | 12-701 | 12-801 | 12-901 | 12-1001 |
| 12-2 | 12-202 | 12-302 | 12-402 | 12-502 | 12-602 | 12-702 | 12-802 | 12-902 | 12-1002 |
| 12-3 | 12-203 | 12-303 | 12-403 | 12-503 | 12-603 | 12-703 | 12-803 | 12-903 | 12-1003 |
| 12-4 | 12-204 | 12-304 | 12-404 | 12-504 | 12-604 | 12-704 | 12-804 | 12-904 | 12-1004 |
| 12-5 | 12-205 | 12-305 | 12-405 | 12-505 | 12-605 | 12-705 | 12-805 | 12-905 | 12-1005 |
| 12-6 | 12-206 | 12-306 | 12-406 | 12-506 | 12-606 | 12-706 | 12-806 | 12-906 | 12-1006 |
| 12-7 | 12-207 | 12-307 | 12-407 | 12-507 | 12-607 | 12-707 | 12-807 | 12-907 | 12-1007 |
| 12-8 | 12-208 | 12-308 | 12-408 | 12-508 | 12-608 | 12-708 | 12-808 | 12-908 | 12-1008 |

| Sample No. | |
|---|---|
| Overall image evaluation | Durability evaluation |

Evaluation standard:
. . . Excellent
. . . Good

TABLE C-16

| Sample No. | 1401 | 1402 | 1403 | 1404 | 1405 | 1406 | 1407 |
|---|---|---|---|---|---|---|---|
| $Si:Si_3N_4$ Target (Area ratio) ($NH_3Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | | | | | Δ | X |

: Very Good
: Good
Δ: Sufficiently practically usable
X: Image defect formed

TABLE C-17

| Sample No. | 1501 | 1502 | 1503 | 1504 | 1505 | 1506 | 1507 | 1508 |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | | | | | Δ | Δ | X |

: Very good
: Good
Δ: Practically satisfactory
X: Image defect formed

TABLE C-18

| Sample No. | 1601 | 1602 | 1603 | 1604 | 1605 | 1606 | 1607 | 1608 |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | | | | | Δ | Δ | X |

: Very good
: Good
Δ: Practically satisfactory
X: Image defect formed

TABLE C-19

| Sample No. | Thickness of layer (II) (μ) | Results |
|---|---|---|
| 1601 | 0.001 | Image defect liable to occur |
| 1602 | 0.02 | No image defect during 20,000 repetitions |
| 1603 | 0.05 | Stable for 50,000 repetitions or more |

TABLE C-19-continued

| Sample No. | Thickness of layer (II) (μ) | Results |
|---|---|---|
| 1604 | 1 | Stable for 200,000 repetitions or more |

TABLE D-1

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3/10^{-3}$<br>$C_2H_5/(GeH_4 + SiH_4) = 3/100$ | 0.18 | 5 | 1 |
| | Second layer | $SiH_4/He = 0.5$ | $SiH_4 = 200$ | | 0.18 | 5 | 19 |
| Layer (II) | | $SiH_4/He = 0.5$<br>$NH_3$ | $SiH_4 = 100$ | $SiH_4/NH_3 = 1/30$ | 0.18 | 10 | 0.5 |

TABLE D-2

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) + 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 15 |

TABLE D-3

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.05$ | $SiH_4 = 200$ | | 0.18 | 15 | 15 |

TABLE D-4

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 15/100 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE D-5

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE D-6

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 2/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE D-7

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE D-8

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| | Second layer | $Si_2H_6/He = 0.5$ | $Si_2H_6 = 200$ | | 0.18 | 15 | 19 |

TABLE D-9

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| | Second layer | $SiF_4/He = 0.05$ | $SiF_4 = 200$ | $GeH_4/SiF_4 = 8/100 \sim 0$ | 0.18 | 5 | 19 |

TABLE D-10

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$SiF_4/He = 0.05$<br>$GeH_4/He = 0.05$<br>$B_2H_6/He = 10^{-3}$<br>$C_2H_4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(Ge_4 + SiH_4 + SiF_4) = 1/100$ | 0.18 | 5 | 1 |
| | Second layer | $SiH_4/He = 0.5$<br>$SiF_4/He = 0.5$ | $SiH_4 + SiF_4 = 200$ | | 0.18 | 5 | 19 |

TABLE D-11

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) =$ | 0.18 | 5 | 1 |

TABLE D-11-continued

| Layer Constitution | Gases employed | Flow rate (SCCM) | Flow rate ratio | Dis-charging power (W/cm²) | Layer formation rate (Å/sec) | Layer thick-ness (μ) |
|---|---|---|---|---|---|---|
| | | | 3/100 | | | |
| Second layer | $SiH_4/He = 0.5$ $B_2H_6/He = 10^{-3}$ | $SiH_4 = 100$ | $B_2H_6/SiH_4 = 3 \times 10^{-3}$ | 0.18 | 15 | 19 |
| Layer (II) | $SiH_4/He = 0.5$ $NH_3$ | $SiH_4 = 100$ | $SiH_4/NH_3 = 1/30$ | 0.18 | 9 | 0.5 |

TABLE D-12

| Sample No. | 1201 | 1202 | 1203 | 1204 | 1205 | 1206 | 1207 | 1208 |
|---|---|---|---|---|---|---|---|---|
| $B_2H_6 + SiH_4$ (Flow rate ratio) | $1 \times 10^{-2}$ | $5 \times 10^{-3}$ | $2 \times 10^{-3}$ | $1 \times 10^{-3}$ | $8 \times 10^{4}$ | $5 \times 10^{4}$ | $3 \times 10^{-4}$ | $1 \times 10^{-4}$ |
| B content (atomic ppm) | $1 \times 10^{4}$ | $6 \times 10^{3}$ | $25 \times 10^{3}$ | $1 \times 10^{3}$ | 800 | 500 | 300 | 100 |
| Image quality evaluation | | | | | | | | |

: Excellent
: Good

TABLE D-13

| Layer Constitution | | Gases employed | Flow rate (SCCM) | Flow rate ratio | Dis-charging power (W/cm²) | Layer formation rate (Å/sec) |
|---|---|---|---|---|---|---|
| Layer (I) | Second layer | $SiH_4/He = 0.5$ $B_2H_6/He = 10^{-3}$ | $SiH_4 = 200$ | $B_2H_6/SiH_4 = 8 \times 10^{-5}$ | 0.18 | 15 |

TABLE D-13A

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of Second layer (μ) | 10 | 10 | 20 | 15 | 20 | 15 | 10 | 10 | 10 | 10 |
| Evalua-tion | | | | | | | | | | |

: Excellent
: Good

TABLE D-14

| Layer Constitution | | Gases employed | Flow rate (SCCM) | Flow rate ratio | Dis-charging power (W/cm²) | Layer formation rate (Å/sec) |
|---|---|---|---|---|---|---|
| Layer (I) | Second layer | $SiH_4/He = 0.5$ $PH_3/He = 10^{-3}$ | $SiH_4 = 200$ | $PH_3/SiH_4 = 1 \times 10^{-5}$ | 0.18 | 15 |

TABLE D-14A

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evalua- | | | | | | | | | | |

TABLE D-14A-continued

| Sample No. | 1401 | 1402 | 1403 | 1404 | 1405 | 1406 | 1407 | 1408 | 1409 | 1410 |
|---|---|---|---|---|---|---|---|---|---|---|
| tion | | | | | | | | | | |

: Excellent
: Good

TABLE D-15

| Conditions | Gases employed | Flow rate (SCCM) | Flow rate ratio or Area ratio | Discharging power ($W/cm^2$) | Layer thickness ($\mu$) |
|---|---|---|---|---|---|
| 12-1 | $Ar(NH_3/Ar)$ | 200(1/1) | Si Wafer:Silicon nitride = 1:30 | 0.3 | 0.5 |
| 12-2 | $Ar(NH_3/Ar)$ | 200(1/1) | Si Wafer:Silicon nitride = 1:30 | 0.3 | 0.3 |
| 12-3 | $Ar(NH_3/Ar)$ | 200(1/1) | Si Wafer:Silicon nitride = 6:4 | 0.3 | 1.0 |
| 12-4 | $SiH_4/He = 1$ $NH_3$ | $SiH_4 = 15$ | $SiH_4:NH_3 = 1:100$ | 0.18 | 0.3 |
| 12-5 | $SiH_4/He = 0.5$ $NH_3$ | $SiH_4 = 100$ | $SiH_4:NH_3 = 1:30$ | 0.18 | 1.5 |
| 12-6 | $SiH_4/He = 0.5$ $SiF_4/He = 0.5$ $NH_3$ | $SiH_4 + SiF_4 = 150$ | $SiH_4:SiF_4:NH_3 = 1:1:60$ | 0.18 | 0.5 |
| 12-7 | $SiH_4/He = 0.5$ $SiF_4/He = 0.5$ $NH_3$ | $SiH_4 + SiF_4 = 15$ | $SiH_4:SiF_4:NH_3 = 2:1:90$ | 0.18 | 0.3 |
| 12-8 | $SiH_4/He = 0.5$ $SiF_4/He = 0.5$ $NH_3$ | $SiH_4 + SiF_4 = 150$ | $SiH_4:SiF_4:NH_3 = 1:1:20$ | 0.18 | 1.5 |

TABLE D-15A

| Preparation conditions for layer (II) | Sample No./Evaluation | | | | | | | | |
|---|---|---|---|---|---|---|---|---|---|
| 12-1 | 12-201 | 12-301 | 12-401 | 12-501 | 12-601 | 12-701 | 12-801 | 12-901 | 12-1001 |
| 12-2 | 12-202 | 12-302 | 12-402 | 12-502 | 12-602 | 12-702 | 12-802 | 12-902 | 12-1002 |
| 12-3 | 12-203 | 12-303 | 12-403 | 12-503 | 12-603 | 12-703 | 12-803 | 12-903 | 12-1003 |
| 12-4 | 12-204 | 12-304 | 12-404 | 12-504 | 12-604 | 12-704 | 12-804 | 12-904 | 12-1004 |
| 12-5 | 12-205 | 12-305 | 12-405 | 12-505 | 12-605 | 12-705 | 12-805 | 12-905 | 12-1005 |
| 12-6 | 12-206 | 12-306 | 12-406 | 12-506 | 12-606 | 12-706 | 12-806 | 12-906 | 12-1006 |
| 12-7 | 12-207 | 12-307 | 12-407 | 12-507 | 12-607 | 12-707 | 12-807 | 12-907 | 12-1007 |
| 12-8 | 12-208 | 12-308 | 12-408 | 12-508 | 12-608 | 12-708 | 12-808 | 12-908 | 12-1008 |

Sample No.

Overall image evaluation  Durability evaluation

Evaluation standard:
. . . Excellent
. . . Good

TABLE D-16

| Sample No. | 1401 | 1402 | 1403 | 1404 | 1405 | 1406 | 1407 |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) (1/1) | 2:60 (2/1) | 1:100 (3/1) | 1:100 (4/1) | 1:100 |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | | | | | Δ | X |

: Very good
: Good
Δ: Sufficiently practically usuable
X: Image defect formed

TABLE D-17

| Sample No. | 1501 | 1502 | 1503 | 1504 | 1505 | 1506 | 1507 | 1508 |
|---|---|---|---|---|---|---|---|---|
| $SiH_4$:$NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | | | | | Δ | Δ | X |

: Very good
: Good
Δ: Practically satisfactory
X: Image defect formed

TABLE D-18

| Sample No. | 1601 | 1602 | 1603 | 1604 | 1605 | 1606 | 1607 | 1608 |
|---|---|---|---|---|---|---|---|---|
| $SiH_4$:$SiF_4$:$NH_3$ (Flow rate ratio) | 5:4.1 | 1:1.6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | | | | | Δ | Δ | X |

: Very good
: Good
Δ: Practically satisfactory
X: Image defect formed

TABLE D-19

| Sample No. | Thickness of layer (II) (μ) | Results |
|---|---|---|
| 1601 | 0.001 | Image defect liable to occur |
| 1602 | 0.02 | No image defect during 20,000 repetitions |
| 1603 | 0.05 | Stable for 50,000 repetitions or more |
| 1604 | 1 | Stable for 200,000 repetitions or more |

TABLE E-1

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4$/He = 0.05<br>$GeH_4$/He = 0.05<br>$C_2H_4$ | $SiH_4 + GeH_4 = 50$ | $GeH_4/SiH_4$ = 4/10~3/100<br>$C_2H_4/(GeH_4 + SiH_4)$ = 3/100 | 0.18 | 5 | 2 |
| | Second layer | $SiH_4$/He = 0.05<br>$GeH_4$/He = 0.05 | $SiH_4 + GeH_4 = 50$ | $GeH_4/SiH_4$ = 3/100~0 | 0.18 | 5 | 8 |
| | Third layer | $SiH_4$/He = 0.5 | $SiH_4 = 200$ | | 0.18 | 15 | 10 |
| Layer (II) | | $SiH_4$/He = 0.5<br>NO | $SiH_4 = 100$ | $SiH_4$/NO = 1 | 0.18 | 10 | 0.5 |

TABLE E-2

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4$/He = 0.05<br>$GeH_4$/He = 0.05<br>$C_2H_4$ | $SiH_4 + GeH_4 = 50$ | $GeH_4/SiH_4$ = 1/10~4/100<br>$C_2H_4/(GeH_4 + SiH_4)$ = 3/100 | 0.18 | 5 | 5 |
| | Second layer | $SiH_4$/He = 0.05<br>$GeH_4$/He = 0.05 | $SiH_4 + GeH_4 = 50$ | $GeH_4/SiH_4$ = 4/100~0 | 0.18 | 5 | 3 |
| | Third layer | $SiH_4$/He = 0.5 | $SiH_4 = 200$ | | 0.18 | 15 | 10 |

TABLE E-3

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4$/He = 0.05<br>$GeH_4$/He = 0.05<br>$C_2H_4$ | $SiH_4 + GeH_4 = 50$ | $GeH_4/SiH_4$ = 4/10~4/100<br>$C_2H_4/(GeH_4 + SiH_4)$ = 3/100 | 0.18 | 5 | 1 |
| | Second | $SiH_4$/He = 0.05 | $SiH_4 + GeH_4 = 50$ | $GeH_4/SiH_4$ = 4/100 | 0.18 | 5 | 1 |

TABLE E-3-continued

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| | layer | $GeH_4/He = 0.05$ | | | | | |
| | Third layer | $SiH_4/He = 0.5$ | $SiH_4 = 200$ | | 0.18 | 15 | 15 |

TABLE E-4

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 15/100 \sim 1/100$<br>$C_2H_4/(GeH_4 + SiH_4) = 3/100$ | 0.18 | 5 | 0.4 |
| | Second layer | $SiH_4/He = 0.05$<br>$GeH_4/He = 0.05$ | $SiH_4 + GeH_4 = 50$ | $GeH_4/SiH_4 = 1/100 \sim 0$ | 0.18 | 5 | 0.6 |
| | Third layer | $SiH_4/He = 0.5$ | $SiH_4 = 200$ | | 0.18 | 15 | 20 |

TABLE E-5

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 14/100$<br>$C_2H_4/(GeH_4 + SiH_4) = 3/100$ | 0.18 | 5 | 0.2 |
| | Second layer | $SiH_4/He = 0.05$<br>$GeH_4/He = 0.05$ | $SiH_4 + GeH_4 = 50$ | $GeH_4/SiH_4 = 14/100 \sim 0$ | 0.18 | 5 | 0.8 |
| | Third layer | $SiH_4/He = 0.5$ | $SiH_4 = 200$ | | 0.18 | 15 | 20 |

TABLE E-6

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 2/10 \sim 45/1000$<br>$C_2H_4/(GeH_4 + SiH_4) = 1/100$ | 0.18 | 5 | 2 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 6 |
| | Third layer | $SiH_4/He = 0.5$ | $SiH_4 = 200$ | | 0.18 | 15 | 10 |

TABLE E-7

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 1/10 \sim 45/1000$<br>$C_2H_4/(GeH_4 + SiH_4) = 1/100$ | 0.18 | 5 | 4 |
| | Second layer | $SiH_4/He = 0.05$<br>$GeH_4/He = 0.05$ | $SiH_4 + GeH_4 = 50$ | $GeH_4/SiH_4 = 45/1000 \sim 0$ | 0.18 | 5 | 4 |
| | Third layer | $SiH_4/He = 0.5$ | $SiH_4 = 200$ | | 0.18 | 15 | 10 |

TABLE E-8

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $Si_2H_6/He = 0.05$<br>$GeH_4/He = 0.05$<br>$C_2H_4$ | $Si_2H_6 + GeH_4 = 50$ | $GeH_4/Si_2H_6 = 4/10 \sim 3/100$<br>$C_2H_4/(GeH_4 + Si_2H_6) = 3/100$ | 0.18 | 5 | 2 |
| | Second | $Si_2H_6/He = 0.05$ | $Si_2H_6 + GeH_4 =$ | $GeH_4/Si_2H_6 = 3/100 \sim 0$ | 0.18 | 5 | 8 |

TABLE E-8-continued

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| | layer | $GeH_4/He = 0.05$ | 50 | | | | |
| | Third layer | $Si_2H_6/He = 0.5$ | $Si_2H_6 = 200$ | | 0.18 | 15 | 10 |

TABLE E-9

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiF_4/He = 0.05$<br>$GeH_4/He = 0.05$<br>$C_2H_4$ | $SiF_4 + GeH_4 = 50$ | $GeH_4/SiF_4 = 4/10 \sim 3/100$<br>$C_2H_4/(GeH_4 + SiF_4) = 3/100$ | 0.18 | 5 | 2 |
| | Second layer | $SiF_4/He = 0.05$<br>$GeH_4/He = 0.05$ | $SiF_4 + GeH_4 = 50$ | $GeH_4/SiF_4 = 3/100 \sim 0$ | 0.18 | 5 | 8 |
| | Third layer | $SiF_4/He = 0.5$ | $SiF_4 = 200$ | | 0.18 | 15 | 10 |

TABLE E-10

| Layer Constitution | | Gases employed | Flow rate (SCCM) | Flow rate ratio | Dis-charging power ($W/cm^2$) | Layer formation rate (Å/sec) | Layer thick-ness (μ) |
|---|---|---|---|---|---|---|---|
| Layer (I) | First layer | $SiH_4/He = 0.05$<br>$SiF_4/He = 0.05$<br>$GeH_4/He = 0.05$<br>$C_2H_4$ | $SiH_4 + SiF_4 + GeH_4 = 50$ | $GeH_4/(SiH_4 + SiF_4) = 4/10 \sim 3/100$<br>$C_2H_4/(GeH_4 + SiH_4 + SiF_4) = 3/100$ | 0.18 | 5 | 2 |
| | Second layer | $SiH_4/He = 0.05$<br>$SiF_4/He = 0.05$<br>$GeH_4/He = 0.05$ | $SiH_4 + SiF_4 + GeH_4 = 50$ | $GeH_4/(SiH_4 + SiF_4) = 3/100 \sim 0$ | 0.18 | 5 | 8 |
| | Third layer | $SiH_4/He = 0.5$<br>$SiF_4/He = 0.5$ | $SiH_4 + SiF_4 = 200$ | | 0.18 | 15 | 10 |

TABLE E-11

| Layer Constitution | | Gases employed | Flow rate (SCCM) | Flow rate ratio | Dis-charging power ($W/cm^2$) | Layer formation rate (Å/sec) |
|---|---|---|---|---|---|---|
| Layer (I) | Third layer | $SiH_4/He = 0.5$<br>$B_2H_6/He = 10^{-3}$ | $SiH_4 = 200$ | $B_2H_6/SiH_4 = 4 \times 10^{-4}$ | 0.18 | 15 |

TABLE E-11A

| Sample No. | 1101 | 1102 | 1103 | 1104 | 1105 | 1106 | 1107 | 1108 | 1109 | 1110 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | | | | | | | | | | |

: Excellent
: Good

TABLE E-12

| Layer Constitution | | Gases employed | Flow rate (SCCM) | Flow rate ratio | Dis-charging power ($W/cm^2$) | Layer formation rate (Å/sec) |
|---|---|---|---|---|---|---|
| Layer (I) | Third layer | $SiH_4/He = 0.5$<br>$PH_3/He = 10^{-3}$ | $SiH_4 = 200$ | $PH_3/SiH_4 = 2 \times 10^{-5}$ | 0.18 | 15 |

TABLE E-12A

| Sample No. | 1201 | 1202 | 1203 | 1204 | 1205 | 1206 | 1207 | 1208 | 1209 | 1210 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of third layer (μ) | 10 | 10 | 15 | 20 | 20 | 10 | 10 | 10 | 10 | 10 |
| Evaluation | | | | | | | | | | |

: Excellent
: Good

TABLE E-13

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 4/10 \sim 2/100$ | 0.18 | 5 | 2 |
| | Second layer | $SiH_4/He = 0.05$<br>$C_2H_4$ | $SiH_4 = 200$ | $C_2H_4/SiH_4 = 2/100 \sim 0$ | 0.18 | 15 | 2 |
| | Third layer | $SiH_4/He = 0.5$ | $SiH_4 = 200$ | | 0.18 | 15 | 15 |

TABLE E-14

| Layer Constitution | | Gases employed | Flow rate (SCCM) | Flow rate ratio | Discharging power ($W/cm^2$) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$C_2H_4$ | $SiH_4 + GeH_4 = 50$ | $GeH_4/SiH_4 = 3/10 \sim 0$<br>$C_2H_4/SiH_4 = 1/10 \sim 5/100$ | 0.18 | 5 | 1 |
| | Second layer | $SiH_4/He = 0.05$<br>$C_2H_4$ | $SiH_4 = 200$ | $C_2H_4/SiH_4 = 5/100 \sim 0$ | 0.18 | 15 | 1 |
| | Third layer | $SiH_4/He = 0.5$ | $SiH_4 = 200$ | | 0.18 | 15 | 18 |

TABLE E-15

| Conditions | Gases employed | Flow rate (SCCM) | Flow rate ratio or Area ratio | Discharging power ($W/cm^2$) | Layer thickness (μ) |
|---|---|---|---|---|---|
| 15-1 | Ar(NO/Ar) | 200(1/1) | Si Wafer:$SiO_2$ = 1:30 | 0.3 | 0.5 |
| 15-2 | Ar(NO/Ar) | 200(1/1) | Si Wafer:$SiO_2$ = 1:60 | 0.3 | 0.3 |
| 15-3 | Ar(NO/Ar) | 200(1/1) | Si Wafer:$SiO_2$ = 6:4 | 0.3 | 1.0 |
| 15-4 | $SiH_4/He = 1$<br>NO | $SiH_4 = 15$ | $SiH_4$:NO = 5:1 | 0.18 | 0.3 |
| 15-5 | $SiH_4/He = 0.5$<br>NO | $SiH_4 = 100$ | $SiH_4$:NO = 1:1 | 0.18 | 1.5 |
| 15-6 | $SiH_4/He = 0.5$<br>$SiF_4/He = 0.5$<br>NO | $SiH_4 + SiF_4 = 150$ | $SiH_4$:$SiF_4$:NO = 1:1:1 | 0.18 | 0.5 |
| 15-7 | $SiH_4/He = 0.5$<br>$SiF_4/He = 0.5$<br>NO | $SiH_4 + SiF_4 = 15$ | $SiH_4$:$SiF_4$:NO = 2:1:4 | 0.18 | 0.3 |
| 15-8 | $SiH_4/He = 0.5$<br>$SiF_4/He = 0.5$<br>NO | $SiH_4 + SiF_4 = 150$ | $SiH_4$:$SiF_4$:NO = 1:1:3 | 0.18 | 1.5 |

TABLE E-15A

| Preparation conditions for layer (II) | Sample No./Evaluation | | | | | | | | |
|---|---|---|---|---|---|---|---|---|---|
| 15-1 | 15-201 | 15-301 | 15-401 | 15-501 | 15-601 | 15-701 | 15-801 | 15-901 | 15-1001 |
| 15-2 | 15-202 | 15-302 | 15-402 | 15-502 | 15-602 | 15-702 | 15-802 | 15-902 | 15-1002 |

TABLE E-15A-continued

| | | | | | | | | | |
|---|---|---|---|---|---|---|---|---|---|
| 15-3 | 15-203 | 15-303 | 15-403 | 15-503 | 15-603 | 15-703 | 15-803 | 15-903 | 15-1003 |
| 15-4 | 15-204 | 15-304 | 15-404 | 15-504 | 15-604 | 15-704 | 15-804 | 15-904 | 15-1004 |
| 15-5 | 15-205 | 15-305 | 15-405 | 15-505 | 15-605 | 15-705 | 15-805 | 15-905 | 15-1005 |
| 15-6 | 15-206 | 15-306 | 15-406 | 15-506 | 15-606 | 15-706 | 15-806 | 15-906 | 15-1006 |
| 15-7 | 15-207 | 15-307 | 15-407 | 15-507 | 15-607 | 15-707 | 15-807 | 15-907 | 15-1007 |
| 15-8 | 15-208 | 15-308 | 15-408 | 15-508 | 15-608 | 15-708 | 15-808 | 15-908 | 15-1008 |

Sample No.

Overall image evaluation — Durability evaluation

Evaluation standard:

. . . Excellent

. . . Good

TABLE E-16

| Sample No. | 1601 | 1602 | 1603 | 1604 | 1605 | 1606 | 1607 |
|---|---|---|---|---|---|---|---|
| $Si:SiO_2$ Target (Area ratio) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) (NO/AR) | 9.7:0.3 | 8.8:1.2 | 7.3:2.7 | 5.0:5.0 | 4.5:5.5 | 4:6 | 3:7 |
| Image quality evaluation | Δ | | | | | Δ | X |

: Very good

: Good

Δ: Sufficiently practically usable

X: Image defect formed

TABLE E-17

| Sample No. | 1701 | 1702 | 1703 | 1704 | 1705 | 1706 | 1707 |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.999:0.0001 | 9.9:0.1 | 9:1 | 6:4 | 5:5 | 3.3:6.7 | 2:8 |
| Image quality evaluation | Δ | | | | | Δ | X |

:8c Very good

: Good

Δ: Practically satisfactory

X: Image defect formed

TABLE E-18

| Sample No. | 1801 | 1802 | 1803 | 1804 | 1805 | 1806 | 1807 |
|---|---|---|---|---|---|---|---|
| $SiH_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:0.0002 | 9.8:0.2 | 8.8:1.2 | 6.3:3.7 | 5.1:4.9 | 3.5:6.5 | 2.3:7.7 |
| Image quality evaluation | Δ | | | | | Δ | X |

: Very good

: Good

Δ: Practically satisfactory

X: Image defect formed

TABLE E-19

| Sample No. | Thickness of layer (II) (μ) | Results |
|---|---|---|
| 1901 | 0.001 | Image defect liable to occur |
| 1902 | 0.02 | No image defect during 20,000 repetitions |
| 1903 | 0.05 | Stable for 50,000 repetitions |
| 1904 | 1 | Stable for 200,000 repetitions |

TABLE F-1

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3/10^{-3}$<br>$C_2H_4/(GeH_4 + SiH_4) = 3/100$ | 0.18 | 5 | 1 |
| | Second layer | $SiH_4/He = 0.5$ | $SiH_4 = 200$ | | 0.18 | 15 | 19 |
| Layer (II) | | $SiH_4/He = 0.5$<br>NO | $SiH_4 = 100$ | $SiH_4/NO = 1$ | 0.18 | 10 | 0.5 |

TABLE F-2

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 19 |

TABLE F-3

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 2/1000$<br>$B_2H_6/(GeH_4 + SiH_4) = 1 \times 10^{-3}$<br>$C_2H_4/(GeH_4 + SiH_4) = 1/100$ | 0.18 | 5 | 2 |
| | Second layer | $SiH_4/He = 0.5$ | $SiH_4 = 200$ | | 0.18 | 15 | 15 |

TABLE F-4

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE F-5

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/1 \sim 5/100$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE F-6

| Layer Constitution | | Gases employed | Flow rate (SCCM) | Flow rate ratio | Discharging power (W/cm²) | Layer formation rate (Å/sec) | Layer thickness (μ) |
|---|---|---|---|---|---|---|---|
| Layer | First | $SiH_4/He = 0.05$ | $SiH_4 + GeH_4 = 50$ | $GeH_4/SiH_4 = 2/10 \sim 0$ | 0.18 | 5 | 1 |

TABLE F-6-continued

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| (I) | layer | $GeH_4/He = 0.05$<br>$B_2H_6/He = 10^{-3}$<br>$C_2H_4$ | | $B_2H_6/(GeH_4 + SiH_4) = 3 \times 10^{-3}$<br>$C_2H_4/(GeH_4 + SiH_4) = 2/100$ | | | |
| | Second layer | $SiH_4/He = 0.5$ | $SiH_4 = 200$ | | 0.18 | 15 | 15 |

TABLE F-7

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 1/10 \sim 0$<br>$B_2H_6/(GeH_4 + SiH_4) = 3 \times 10^{-3}$<br>$C_2H_4/(GeH_4 + SiH_4) = 2/100$ | 0.18 | 5 | 1 |
| | Second layer | $SiH_4/He = 0.5$ | $SiH_4 = 200$ | | 0.18 | 15 | 15 |

TABLE F-8

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $Si_2H_6/He = 0.05$<br>$GeH_4/He = 0.05$<br>$B_2H_6/He = 10^{-3}$<br>$C_2H_4$ | $Si_2H_6 + GeH_4 = 50$ | $GeH_4/Si_2H_6 = 4/10 \sim 0$<br>$B_2H_6/(GeH_4 + Si_2H_6) = 3 \times 10^{-3}$<br>$C_2H_4/(GeH_4 + Si_2H_6) = 2/100$ | 0.18 | 5 | 1 |
| | Second layer | $Si_2H_6/He = 0.5$ | $Si_2H_6 = 200$ | | 0.18 | 15 | 19 |

TABLE F-9

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiF_4/He = 0.05$<br>$GeH_4/He = 0.05$<br>$B_2H_6/He = 10^{-3}$<br>$C_2H_4$ | $SiF_4 + GeH_4 = 50$ | $GeH_4/SiF_4 = 4/10 \sim 0$<br>$B_2H_6/(GeH_4 + SiF_4) = 3 \times 10^{-3}$<br>$C_2H_4/(GeH_4 + SiF_4) = 1/100$ | 0.18 | 5 | 1 |
| | Second layer | $SiF_4/He = 0.05$ | $SiF_4 = 200$ | | 0.18 | 5 | 19 |

TABLE F-10

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$SiF_4/He = 0.05$<br>$GeH_4/He = 0.05$<br>$B_2H_6/He = 10^{-3}$<br>$C_2H_4$ | $SiH_4 + SiF_4 + GeH_4 = 50$ | $GeH_4/(SiH_4 + SiF_4) = 4/10 \sim 0$<br>$B_2H_6/(GeH_4 + SiH_4 + SiF_4) = 3 \times 10^{-3}$<br>$C_2H_4/(GeH_4 + SiH_4 + SiF_4) = 1/100$ | 0.18 | 5 | 1 |
| | Second layer | $SiH_4/He = 0.5$<br>$SiF_4/He = 0.5$ | $SiH_4 + SiF_4 = 200$ | | 0.18 | 5 | 19 |

TABLE F-11

| Layer Constitution | | Gases employed | Flow rate (SCCM) | Flow rate ratio | Dis-charging power (W/cm²) | Layer formation rate (Å/sec) | Layer thick-ness (μ) |
|---|---|---|---|---|---|---|---|
| Layer (I) | First layer | $SiH_4/He = 0.05$<br>$GeH_4/He = 0.05$<br>$B_2H_6/He = 10^{-3}$<br>$C_2H_4$ | $SiH_4 + GeH_4 = 50$ | $GeH_4/SiH_4 = 4/10 \sim 0$<br>$B_2H_6/(GeH_4 + SiH_4) = 3 \times 10^{-3}$<br>$C_2H_4/(GeH_4 + SiH_4) = 3/100$ | 0.18 | 5 | 1 |

TABLE F-11-continued

| Layer Constitution | Gases employed | Flow rate (SCCM) | Flow rate ratio | Dis-charging power (W/cm²) | Layer formation rate (Å/sec) | Layer thick-ness (μ) |
|---|---|---|---|---|---|---|
| Second layer | $SiH_4/He = 0.5$<br>$B_2H_6/He = 10^{-3}$ | $SiH_4 = 200$ | $B_2H_6/SiH_4 = 3 \times 10^{-3}$ | 0.18 | 15 | 19 |
| Layer (II) | $SiH_4/He = 0.5$<br>NO | $SiH_4 = 100$ | $SiH_4/NO = 1$ | 0.18 | 10 | 0.5 |

TABLE F-12

| Sample No. | 1201 | 1202 | 1203 | 1204 | 1205 | 1206 | 1207 | 1208 |
|---|---|---|---|---|---|---|---|---|
| $B_2H_6/SiH_4$ (Flow rate ratio) | $1 \times 10^{-2}$ | $5 \times 10^{-3}$ | $2 \times 10^{-3}$ | $1 \times 10^{-3}$ | $8 \times 10^{-4}$ | $5 \times 10^{-4}$ | $3 \times 10^{-4}$ | $1 \times 10^{-4}$ |
| B Content (atomic ppm) | $1 \times 10^4$ | $6 \times 10^3$ | $2.5 \times 10^3$ | $1 \times 10^3$ | 800 | 500 | 300 | 100 |
| Image quality evaluation | | | | | | | | |

: Excellent
: Good

TABLE F-13

| Layer Consti-tution | Gases employed | Flow rate (SCCM) | Flow rate ratio | Dis-charging power (W/cm²) | Layer formation rate (Å/sec) |
|---|---|---|---|---|---|
| Second layer | $SiH_4/He = 0.5$<br>$B_2H_6/He = 10^{-3}$ | $SiH_4 = 200$ | $B_2H_6/SiH_4 = 8 \times 10^{-5}$ | 0.18 | 15 |

TABLE F-13A

| Sample No. | 1301 | 1302 | 1303 | 1304 | 1305 | 1306 | 1307 | 1308 | 1309 | 1310 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evalua-tion | | | | | | | | | | |

: Excellent
: Good

TABLE F-14

| Layer Consti-tution | Gases employed | Flow rate (SCCM) | Flow rate ratio | Dis-charging power (W/cm²) | Layer formation rate (Å/sec) |
|---|---|---|---|---|---|
| Second layer | $SiH_4/He = 0.5$<br>$PH_3/He = 10^{-3}$ | $SiH_4 = 200$ | $PH_3/SiH_4 = 1 \times 10^{-5}$ | 0.18 | 15 |

TABLE F-14A

| Sample No. | 1401 | 1402 | 1403 | 1404 | 1405 | 1406 | 1407 | 1408 | 1409 | 1410 |
|---|---|---|---|---|---|---|---|---|---|---|
| First layer | The same as that in Example 1 | The same as that in Example 2 | The same as that in Example 3 | The same as that in Example 4 | The same as that in Example 5 | The same as that in Example 6 | The same as that in Example 7 | The same as that in Example 8 | The same as that in Example 9 | The same as that in Example 10 |
| Thickness of second layer (μ) | 10 | 10 | 20 | 15 | 20 | 15 | 10 | 10 | 10 | 10 |
| Evalua-tion | | | | | | | | | | |

: Excellent
: Good

TABLE F-15

| Conditions | Gases employed | Flow rate (SCCM) | Flow rate ratio or Area ratio | Discharging power ($W/cm^2$) | Layer thickness ($\mu$) |
|---|---|---|---|---|---|
| 15-1 | Ar(NO/Ar) | 200(1/1) | Si Wafer:$SiO_2$ = 1:30 | 0.3 | 0.5 |
| 15-2 | Ar(NO/Ar) | 200(1/1) | Si Wafer:$SiO_2$ = 1:60 | 0.3 | 0.3 |
| 15-3 | Ar(NO/Ar) | 200(1/1) | Si Wafer:$SiO_2$ = 6:4 | 0.3 | 1.0 |
| 15-4 | $SiH_4$/He = 1<br>NO | $SiH_4$ = 15 | $SiH_4$:NO = 5:1 | 0.18 | 0.3 |
| 15-5 | $SiH_4$/He = 0.5<br>NO | $SiH_4$ = 100 | $SiH_4$:NO = 1:1 | 0.18 | 1.5 |
| 15-6 | $SiH_4$/He = 0.5<br>$SiF_4$/He = 0.5<br>NO | $SiH_4$ + $SiF_4$ = 150 | $SiH_4$:$SiF_4$:NO = 1:1:1 | 0.18 | 0.5 |
| 15-7 | $SiH_4$/He = 0.5<br>$SiF_4$/He = 0.5<br>NO | $SiH_4$ + $SiF_4$ = 15 | $SiH_4$:$SiF_4$:NO = 2:1:4 | 0.18 | 0.3 |
| 15-8 | $SiH_4$/He = 0.5<br>$SiF_4$/He = 0.5<br>NO | $SiH_4$ + $SiF_4$ = 150 | $SiH_4$:$SiF_4$:NO = 1:1:3 | 0.18 | 1.5 |

TABLE F-15A

| Preparation conditions for layer (II) | Sample No./Evaluation | | | | | | | | |
|---|---|---|---|---|---|---|---|---|---|
| 15-1 | 15-201 | 15-301 | 15-401 | 15-501 | 15-601 | 15-701 | 15-801 | 15-901 | 15-1001 |
| 15-2 | 15-202 | 15-302 | 15-402 | 15-502 | 15-602 | 15-702 | 15-802 | 15-902 | 15-1002 |
| 15-3 | 15-203 | 15-303 | 15-403 | 15-503 | 15-603 | 15-703 | 15-803 | 15-903 | 15-1003 |
| 15-4 | 15-204 | 15-304 | 15-404 | 15-504 | 15-604 | 15-704 | 15-804 | 15-904 | 15-1004 |
| 15-5 | 15-205 | 15-305 | 15-405 | 15-505 | 15-605 | 15-705 | 15-805 | 15-905 | 15-1005 |
| 15-6 | 15-206 | 15-306 | 15-406 | 15-506 | 15-606 | 15-706 | 15-806 | 15-906 | 15-1006 |
| 15-7 | 15-207 | 15-307 | 15-407 | 15-507 | 15-607 | 15-707 | 15-807 | 15-907 | 15-1007 |
| 15-8 | 15-208 | 15-308 | 15-408 | 15-508 | 15-608 | 15-708 | 15-808 | 15-908 | 15-1008 |

Sample No.

Overall image evaluation  Durability evaluation

Evaluation standard:

. . . Excellent

. . . Good

TABLE F-16

| Sample No. | 1601 | 1602 | 1603 | 1604 | 1605 | 1606 | 1607 |
|---|---|---|---|---|---|---|---|
| Si:$SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | | | | | Δ | X |

: Very good

. : Good

Δ: Sufficiently practically usable

X: Image defect formed

TABLE F-17

| Sample No. | 1701 | 1702 | 1703 | 1704 | 1705 | 1706 | 1707 |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999:0.0001 | 9.9:0.1 | 9:1 | 6:4 | 5:5 | 3.3:6.7 | 2:8 |
| Image quality evaluation | Δ | | | | | Δ | X |

: Very good

: Good

Δ: Practically satisfactory

X: Image defect formed

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

TABLE F-18

| Sample No. | 1801 | 1802 | 1803 | 1804 | 1805 | 1806 | 1807 |
|---|---|---|---|---|---|---|---|
| $SiH_4$:$SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:0.0002 | 9.8:0.2 | 8.8:1.2 | 6.3:3.7 | 5.1:4.9 | 3.5:6.5 | 2.3:7.7 |
| Image quality evaluation | Δ | | | | | Δ | X |

: Very good
: Good
Δ: Practically satisfactory
X: Image defect formed

TABLE F-19

| Sample No. | Thickness of layer (II) (μ) | Results |
|---|---|---|
| 1901 | 0.001 | Image defect liable to occur |
| 1902 | 0.02 | No image defect during 20,000 repetitions |
| 1903 | 0.05 | Stable for 50,000 repetitions |
| 1904 | 1 | Stable for 200,000 repetitions |

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

COLUMN 81

Line 27, "atoms germanium" should read --atoms, germanium--.
Line 29, "amorphours" should read --amorphous--.
Line 48, "the first distribution" should read --the distribution--.

COLUMN 82

Line 57, "seocnd" should read --second--.
Line 62, "region(S)." should read --region (S).--.

COLUMN 83

Line 8, "claim/18 in" should read --claim 18 in--.
Line 24, "Periorid" should read --Periodic--.

UNITED STATES PATENT AND TRADEMARK OFFICE

CERTIFICATE OF CORRECTION

PATENT NO. : 4,579,798

DATED : April 1, 1986

INVENTOR(S) : KEISHI SAITOH, ET AL.

It is certified that error appears in the above-identified patent and that said Letters Patent is hereby corrected as shown below:

COLUMN 84

Line 23, "us" should read --is--.
Line 27, "membre" should read --member--.
Line 45, "region(S) is" should read --region (S) is--.